US005128238A

United States Patent [19]

Nakazyo et al.

[11] Patent Number: 5,128,238

[45] Date of Patent: Jul. 7, 1992

[54] METHOD OF FORMING COLOR IMAGES

[75] Inventors: Kiyoshi Nakazyo; Shinji Ueda; Akira Abe; Noriyuki Inoue, all of Kanagawa, Japan

[73] Assignee: Fuji Photo Film Co., Ltd., Kanagawa, Japan

[21] Appl. No.: 519,341

[22] Filed: May 3, 1990

Related U.S. Application Data

[63] Continuation-in-part of Ser. No. 354,664, May 22, 1989, abandoned.

[30] Foreign Application Priority Data

May 23, 1988 [JP] Japan ..... 63-125425
May 25, 1988 [JP] Japan ..... 63-127443
Jun. 28, 1988 [JP] Japan ..... 63-157902
Jul. 4, 1988 [JP] Japan ..... 63-164903

[51] Int. Cl.[5] ..... G03C 7/46

[52] U.S. Cl. ..... 430/378; 430/547; 430/380; 430/409; 430/410; 430/434

[58] Field of Search ..... 430/378, 547, 380, 409, 430/410, 434

[56] References Cited

U.S. PATENT DOCUMENTS 4,395,478 7/1983 Hoyen ..... 430/378
4,798,783 1/1989 Ishikawa et al. ..... 430/372
4,830,948 5/1989 Ishikawa et al. ..... 430/372
4,876,174 10/1989 Ishikawa et al. ..... 430/434
4,966,833 10/1990 Inoue ..... 430/378
4,968,592 11/1990 Deguchi et al. ..... 430/378

FOREIGN PATENT DOCUMENTS 32456 7/1987 European Pat. Off. .
262930 9/1987 European Pat. Off. .
249239 12/1987 European Pat. Off. .
264192 4/1988 European Pat. Off. .
266797 5/1988 European Pat. Off. .
267482 5/1988 European Pat. Off. .
269227 6/1988 European Pat. Off. .

OTHER PUBLICATIONS

Patent Abstracts of Japan, vol. 12, No. 331 (p. 755) (3178) Sep. 7, 1988, JP-A-63 092949 (Konishiroku Photo Industry) Apr. 1988, (the whole document).

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A method for producing color images comprising developing a negative silver halide color photographic materials and an internal latent-image type direct positive silver halide color photogaphic material, with the same developer having a pH of 9.0 to 11.5, said direct positive photographic material containing at least one compound represented by formula (N-I) as nucleating agent and at least one compound represented by (I) or (II) as magenta coupler, thereby ensuring high color reproducibility to both photographic materials:

(N-I)

(I)

(II)

wherein the symbols and substituents of said formulae are as defined in the specification.

25 Claims, No Drawings

METHOD OF FORMING COLOR IMAGES

This is a continuation-in-part of application Ser. No. 07/354,664, filed on May 22, 1989, now abandoned.

FIELD OF THE INVENTION

This invention relates to a method of processing silver halide color photographic light-sensitive materials and, more particularly, to a method of processing internal latent-image type direct positive silver halide color photographic light-sensitive materials and negative silver halide color photographic light-sensisitive materials using the same developing solution.

BACKGROUND OF THE INVENTION

Silver halide color photographic light-sensitive materials (which are abbreviated as "color photographic materials", hereinafter) are roughly divided into negative silver halide color photographic materials represented by color negative films and color papers for printing from color negative films, and internal latent-image type direct positive silver halide color photographic materials. In the past, these color photographic materials have been processed only in large-scale photofinishing laboratories. As for the negative color photographic materials, however, they have come to be processed also in storefronts of photo studios and so on owing to recent development of small-scale processing systems called minilab systems.

On the other hand, internal latent-image type direct positive color photographic materials have come to be increasingly used, e.g., in copying of color originals, and development of novel color copy systems have been undertaken. In addition to their copying use, internal latent-image type direct positive color photographic materials have many uses, e.g., as materials for printing from reversal films, and as materials for photographing directly. Therefore, if the processing with the foregoing minilab system in a storefront occurs, opportunities to use the system speedily and easily can be offered to users.

However, the above-described minilab system is installed in a narrow shop in many cases, so particularly important factors therein are narrowness of the installation area and smallness of the necessary working space.

On the other hand, it has so far been necessary to use processing solutions with different compositions in photographic processing of negative color photographic materials and internal latent-image type color photographic materials. As a result these two types of materials have been processed with separate automatic developing machines. However, it is impossible to install these machines together in a narrow space. This has so far constituted a serious obstacle to the development of storefront processing. Accordingly, it is strongly desired to develop processing methods so as to enable the minaturization of an automatic developing machine for the above described system and to simplify the processing.

With the intention of fulfilling the foregoing requirement, the processing of negative color photographic materials and internal latent-image type color photographic materials with the same automatic developing machine is proposed in JP-A-62-139548 (the term "JP-A" as used herein means an "unexamined published Japanese patent application"). However, the above-proposal only teaches that generally used bromine ion concentrations are suitable also for a color developer to be used in the processing. Furthermore, the proposal is unsuitable for the simplification of the system because the internal latent-image type color photographic materials used are those requiring a photo-fogging treatment during development and, therefore, the automatic developing machine has a complex structure since it must be equipped with an exposure device selective for internal latent-image type color photographic materials, and so on.

JP-A-62-89044 provides another proposal such that overflow of the processing solutions used for negative color photographic materials are reused in processing internal latent-image type color photographic materials. This proposal also cannot be said to contribute to the reduction of space.

When the processing of internal latent-image type silver halide photographic materials and negative silver halide photographic materials was tried according to the same processing steps using the same processing solutions, respectively, in one automatic developing machine, it was found that internal latent-image type silver halide photographic materials were subject to changes in finishing characteristics. In particular, fluctuations in the maximum density and fog were remarkable in that case. Therefore, pressing need for realization of the processing has been to solve the above-described problem.

Although many causes of such fluctuations can be postulated, the main one is attributable to a difference in quantity of developed silver (quantity of metal silver produced in a developer through development) due to the difference of use between an internal latent-image type silver halide photographic material and a negative silver halide photographic material. That is, the quantity of developed silver is appreciably smaller in internal latent-image type silver halide photographic materials than in negative silver halide photographic materials since the former photographic materials are mainly used for copy, and originals to be copied contain many line drawings such as letters, characters and the like. Consequently, the quantities of halogen released from these two types of photographic materials during development are vastly different from each other. In addition, emulsions which are used in the two types of photographic materials, respectively, differ in halogen composition itself in many cases, so that the halogen concentration in the developer is greatly changed by the processing. The above-described difference in quantity of developed silver also gives rise to a change in developing agent concentration. This change in developer composition as described above exerts a particularly remarkable influence upon the characteristic changes of internal latent-image type silver halide photographic materials causing the foregoing problem.

Moreover, preservatives including sulfites and hydroxylamines, which have so far been used in color developers for silver halide color photographic materials, enhance the changes in finishing characteristics of internal latent-image type silver halide photographic materials when fluctuations of halogen and developing agent concentrations, as described above, occur in the processing. As a result, a decrease in the maximum density and an increase in fog occur to a great extent. Accordingly, it has been strongly desired to develop the art of using preservatives which are more suitable for the processing.

SUMMARY OF THE INVENTION

Therefore, a first object of this invention is to provide a processing method where photographic materials of two different types, i.e., internal latent-image type direct positive color photographic materials and negative type color photographic materials, are processed with the same processing solution.

A second object of this invention is to provide a processing method capable of producing direct positive color images and negative ones, both of which have excellent color reproducibility.

The above-described objects are attained with a method of producing color images comprising developing (1) negative silver halide photographic materials, which has at least one silver halide emulsion layer on a support and contains a nondiffusible coupler capable of forming a dye by a coupling reaction with the oxidation product of an aromatic primary amine developing agent, and (2) a direct positive silver halide color photographic light-sensitive material, which has at least one silver halide emulsion layer on a support and contains a nondiffusible coupler capable of forming a dye by a coupling reaction with an oxidation product of an aromatic primary amine developing agent, with the same developer having a pH of 9.0 to 11.5, same direct positive photographic material containing (i) at least one compound represented by formula (N-I),

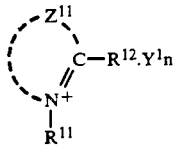

(N-I)

wherein $Z^{11}$ represents a nonmetallic atomic group necessary to complete a 5- or 6-membered heterocyclic ring, which may be substituted; $R^{11}$ represents an unsubstituted or substituted aliphatic hydrocarbon residue: $R^{12}$ represents a hydrogen atom, an unsubstituted or substituted aliphatic or aromatic hydrocarbon residue, or a residue to form a ring by binding to the heterocyclic ring completed by $Z^{11}$; wherein at least one of the groups $R^{11}$, $R^{12}$ and $Z^{11}$ contains an alkynyl group, an aliphatic or aromatic acyl group, a hydrazino group or a hydrazono group, or $R^{11}$ and $R^{12}$ combine with each other to complete a 6-membered ring to form a dihydropyridinium skeleton, and at least one of the groups $R^{11}$, $R^{12}$ and $Z^{11}$ may contain a group capable of accelerating the adsorption onto silver halide grains:

$Y^1$ represents a counter ion for maintaining charge balance; and n represents 0 or 1, and (ii) at least one compound selected from the group consisting of compounds represented by formula (I) or (II):

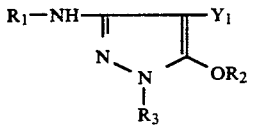

(I)

-continued

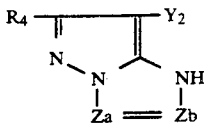

(II)

wherein $R_1$ and $R_3$ each represents a substituted or unsubstituted phenyl group; $R_2$ represents a hydrogen atom, an aliphatic or aromatic acyl group, or an aliphatic or aromatic sulfonyl group, the aliphatic moiety including straight chain, branched chain and cyclic alkyl, alkenyl and alkynyl moieties; $R_4$ represents a hydrogen atom, or a substituent group; Za and Zb each represent an unsubstituted or substituted methine group, or =N—; $Y_1$ represents a hydrogen atom, or a group capable of eliminating upon coupling with the oxidation product of a developing agent (hereinafter a "eliminating" group for brevity); $Y_2$ represents a eliminating group; (I) may form a polymer, including a dimer, via $R_1$, $R_2$, $R_3$ or $Y_1$, and (II) may also form a polymer, including a dimer, via $R_4$, Za, Zb or $Y_2$.

DETAILED DESCRIPTION OF THE INVENTION

The compounds represented by the foregoing general formula (I) are magenta couplers and they described below in detail.

When $R_2$ in the general formula (I) is a hydrogen atom, it is well known in this art that the compounds exhibit the following keto-enol tautomerism. Therefore, the structure on the left side is equivalent to that on the right side.

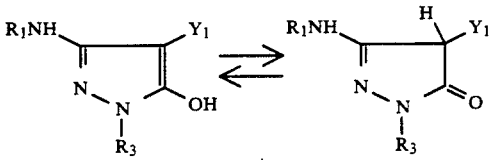

Groups suitable for $R_1$ and $R_3$ in the general formula (I) are substituted and unsubstituted phenyl groups. Examples for substituents of phenyl group include an alkyl group, an aryl group, a heterocyclic group (preferably 5- or 6-membered ring having at least one of N, S and O atom as hetero atom; the same hereinafter), an alkoxy group (preferably containing 1 to 20 carbon atoms (hereinafter the preferred carbon number is simply represented by, e.g., $C_{1-20}$); e.g., methoxy, 2-methoxyethoxy), an aryloxy group ($C_{6-20}$; e.g., 2,4-di-tert-amylphenoxy, 2-chlorophenoxy, 4-cyanophenoxy), an alkenyloxy group ($C_{2-20}$; e.g., 2-propenyloxy), an aliphatic or aromatic acyl group ($C_{2-20}$, $C_{7-20}$, respectively; e.g., acetyl, benzoyl), an ester group ($C_{1-20}$; e.g., butoxycarbonyl, phenoxycarbonyl, acetoxy, benzoyloxy, butoxysulfonyl, toluenesulfonyloxy), an amido group ($C_{1-20}$; e.g., acetylamino, ethylcarbamoyl, dimethylcarbamoyl, methanesulfonamido, N,N-dibutylsulfamoyl, 3-(2,4-di-tert-amylphenoxy)propylsulfamoyl, benzenesulfonamido, 2-butoxy-5-tert-octylbenzenesulfonamido, dodecanesulfonamido, butylsulfamoyl), a sulfamido group ($C_{1-20}$; e.g., dipropylsulfamoylamino), an imido group (e.g., succinimido, hydantoinyl), a ureido group ($C_{2-20}$; e.g., phenylureido, dimethylureido), an aliphatic or aromatic sulfonyl group ($C_{1-20}$, $C_{7-20}$, respectively; e.g., methanesulfonyl, phenylsulfonyl, 2-butoxy-5-tert-octylphenylsulfonyl), an aliphatic or aromatic thio group ($C_{1-20}$, $C_{7-20}$, respectively; e.g., ethylthio, phenylthio), a hydroxy group, a cyano group, a carboxyl group, a nitro group, a sulfo group, a halogen atom, or so on.

When two substituent groups are present, they may be the same or different.

$Y_1$ in the general formula (I) is a hydrogen atom or an eliminatable group, which includes a halogen atom, a group binding an aliphatic hydrocarbon group, an aromatic hydrocarbon group, a heterocyclic group, an aliphatic, aromatic or heterocyclic sulfonyl group or an aliphatic, aromatic or heterocyclic carbonyl group to a coupling active carbon atom via the oxygen, nitrogen, sulfur or carbon atom, a nitrogen-containing heterocyclic group binding to the coupling site via the nitrogen atom, a halogen atom, an aromatic azo group, and so on. The aliphatic or aromatic hydrocarbon moiety or the heterocyclic moiety contained in these eliminatable groups may be substituted with a substituent group suitable for $R_1$, and when two or more of these substituents are present therein, they may be the same or different. These substituent groups may further be substituted by those groups suitable for $R_1$. $Y_2$ in the formula (II) represents eliminatable group as disclosed above for $Y_1$.

Specific examples of coupling eliminatable groups as described above include a halogen atom (e.g., fluorine, chlorine, bromine), an alkoxy group (e.g., ethoxy, dodecyloxy, methoxyethylcarbamoylmethoxy, 3-(methanesulfonamido)propyloxy, carboxypropyloxy, methylsulfonylethoxy), an aryloxy group (e.g., 4-chlorophenoxy, 4-methoxyphenoxy, 3-sulfonamidophenoxy, 4-(N,N'-diethylsulfamoyl)phenoxy, 4-carboxyphenoxy), an aliphatic or aromatic acyloxy group (e.g., acetoxy, tetradecanoyloxy, benzoyloxy), an aliphatic or aromatic sulfonyloxy group (e.g., methanesulfonyloxy, toluenesulfonyloxy), an aliphatic or aromatic acylamino group (e.g., dichloroacetylamino, heptafluorobutyrylamino), an aliphatic or aromatic sulfonamido group (e.g., methanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic, aromatic or heterocyclic thio group (e.g., ethylthio, phenylthio, tetrazolylthio), a carbamoylamino group (e.g., N-methylcarbamoylamino, N-phenylcarbamoylamino), a 5- or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), an aromatic azo group (e.g., phenylazo), and an acylamino group containing 1 to 20 carbon atoms (e.g., acetamido, benzamido, tetradecanamido). The aliphatic hydrocarbon moieties, aliphatic oxy groups, and acylamino groups each may further be substituted by such a group as is described for $R_1$.

$R_2$ in the general formula (I) is preferably a hydrogen atom, an aliphatic acyl group, or an aliphatic sulfonyl group, particularly preferably a hydrogen atom. Preferred groups as $Y_1$ are those of the type which can split off at the site of the sulfur, oxygen or nitrogen atom, particularly preferably at the site of the sulfur atom.

The compounds represented by the general formula (II) are couplers of such a type that two 5-membered nitrogen-containing rings are condensed (which are called 5,5-N-hetero ring type couplers, hereinafter), and their color-producing mother nuclei have an aromaticity isoelectronic with naphthalene and assume a chemical structure called collectively azapentalene. Among the couplers represented by the general formula (II), 1H-imidazo[1,2-b]pyrazoles, 1H-pyrazolo[5,1-c]-[1,2,4]triazoles, 1H-pyrazolo[1,5-b][1,2,4]triazoles and 1H-pyrazolo[1,5-d]tetrazoles, which are represented by the following general formula (II-1), (II-2), (II-3) and (II-4), respectively are preferred over others.

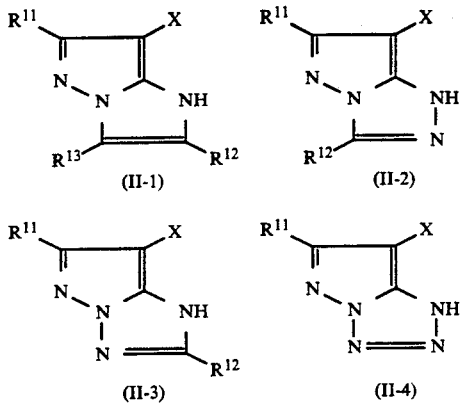

The substituent groups in the general formulae from (II-1) to (II-4) are illustrated below in detail. Substituent groups represented by $R^{11}$ (which corresponds to $R_4$ in formula (II), $R^{12}$ and $R^{13}$ include a hydrogen atom, a halogen atom, a cyano group, aliphatic or aromatic hydrocarbon or heterocyclic groups,

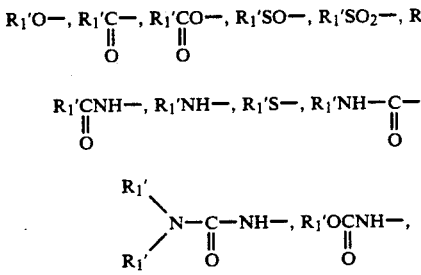

($R_1'$ represents a hydrogen atom, a halogen atom, a cyano group, aliphatic or aromatic hydrocarbon or heterocyclic groups,) silyl groups, silyloxy groups, sililamino groups, and imido groups. In addition to the above-cited groups, $R^{11}$, $R^{12}$ and $R^{13}$ each may be a carbamoyl, a sulfamoyl or a sulfamoylamino group. The nitrogen atom contained in these groups may be substituted by a substituent group as described for $R_1$. X has the same meaning as $Y_2$. Moreover, $R^{11}$, $R^{12}$, $R^{13}$ and X each may be a divalent group via which the corresponding coupler may form a dimer, or a linking group connecting a polymer chain to the mother nucleus of the corresponding coupler.

Groups preferred as $R^{11}$, $R^{12}$ and $R^{13}$ are a hydrogen atom, a halogen atom, an aliphatic hydrocarbon group, an aromatic hydrocarbon group, a heterocyclic group,

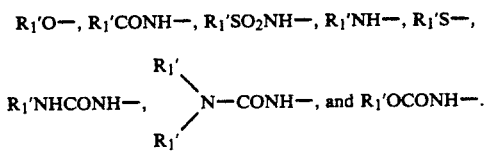

Groups referred as X are a halogen atom, an aliphatic or aromatic acylamino group, an imido group, an aliphatic or aromatic sulfonamido group, a nitrogen-containing 5- or 6-membered heterocyclic group to bind to the coupling active site via its nitrogen atom, an aryloxy group, an alkoxy group, an arylthio group, and an alkylthio group.

Magenta couplers to be used in this invention are preferably those of the general formula (I) which have a splitting-off group other than a hydrogen atom, and those of the general formulae (II-2) and (II-3). In particular, those of the general formulae (II-2) and (II-3) are particularly preferred.

Specific examples of the couplers represented by the general formula (I) and (II) are illustrated below.

(M-1)

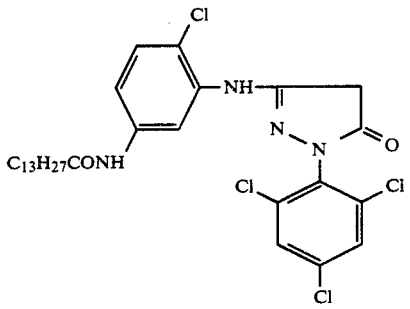

(M-2)

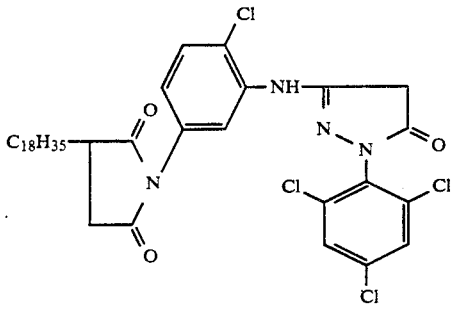

(M-3)

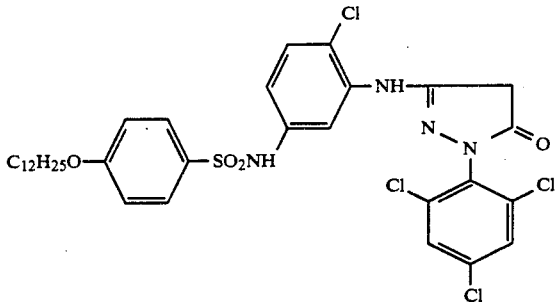

(M-4)

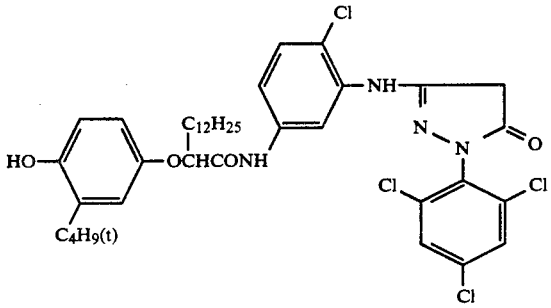

-continued
(M-5)
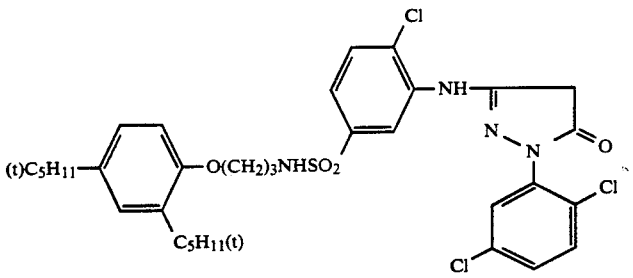
(M-6)
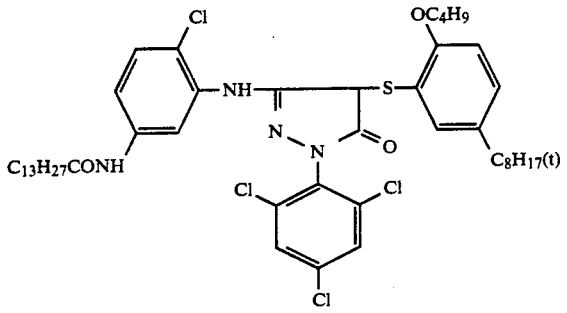
(M-7)
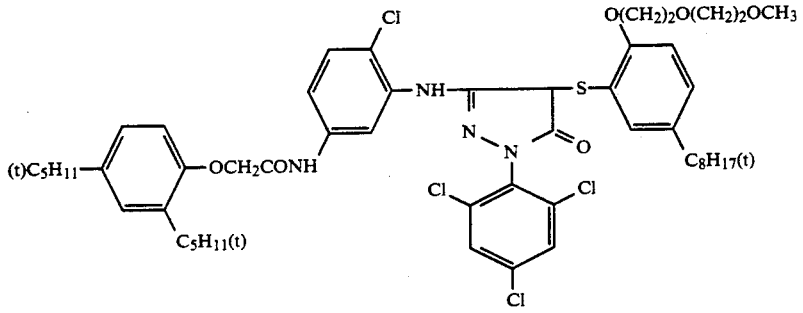
(M-8)
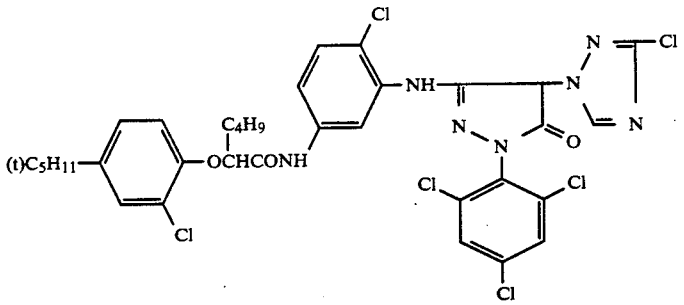
(M-9)
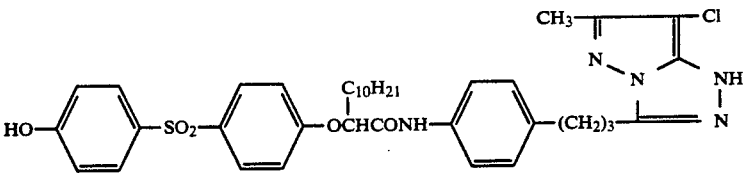
(M-10)
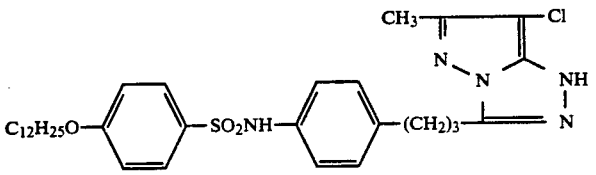

-continued
(M-11)
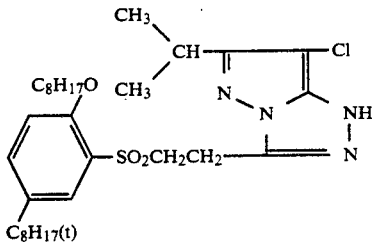
(M-12)
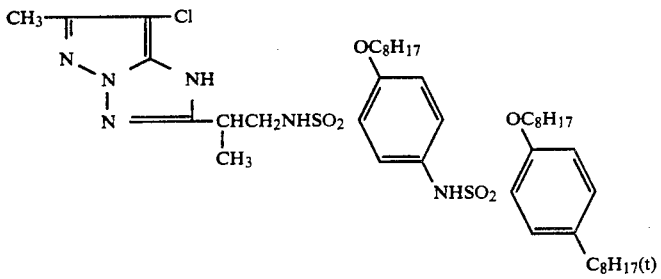
(M-13)
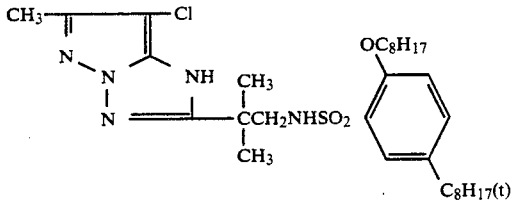
(M-14)
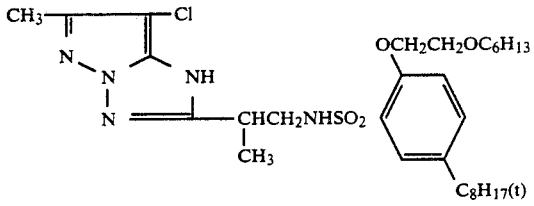
(M-15)
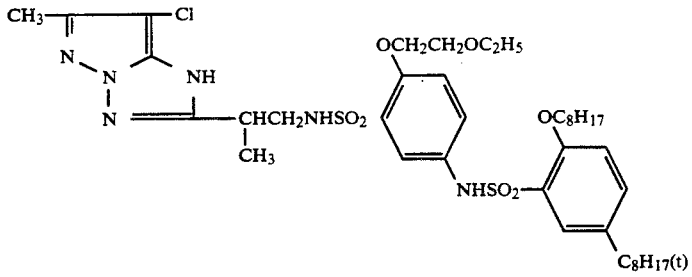
(M-16)
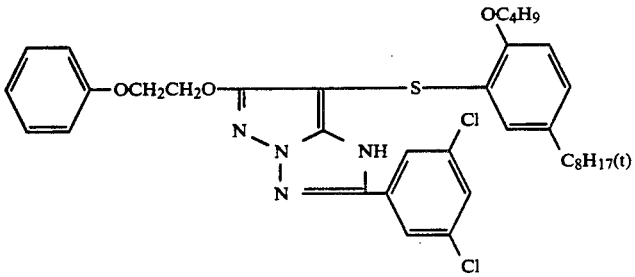

-continued
(M-17)
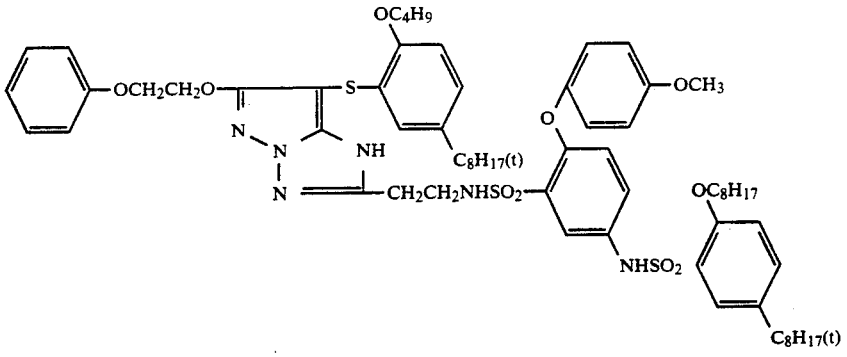
(M-18)
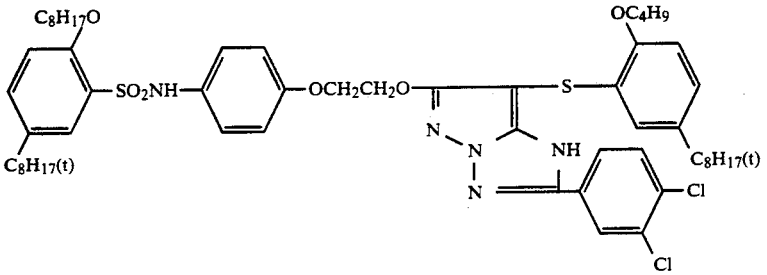
(M-19)
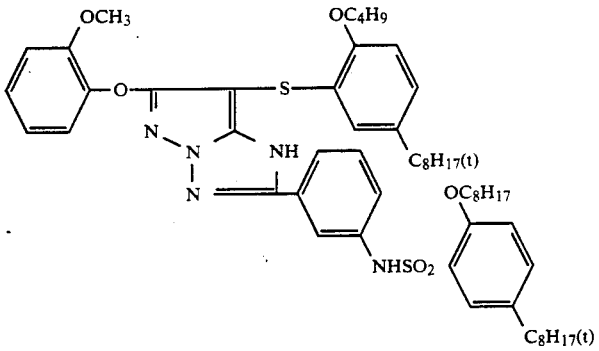
(M-20)
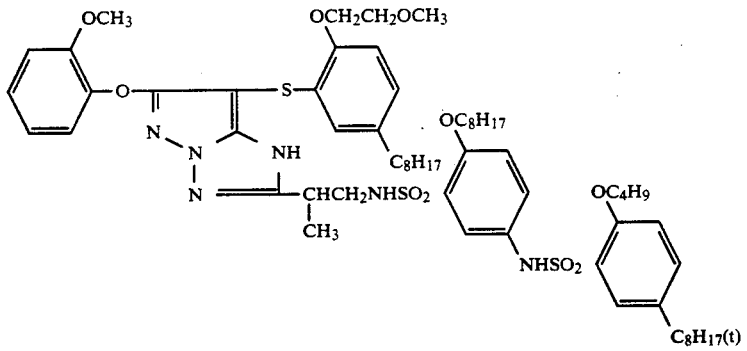
(M-21)
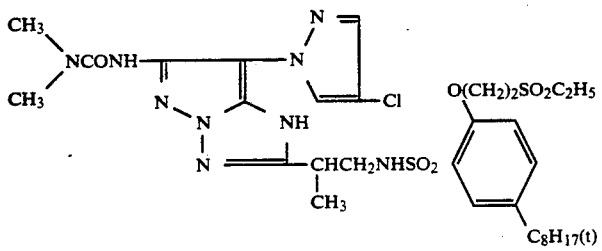

-continued (M-22)

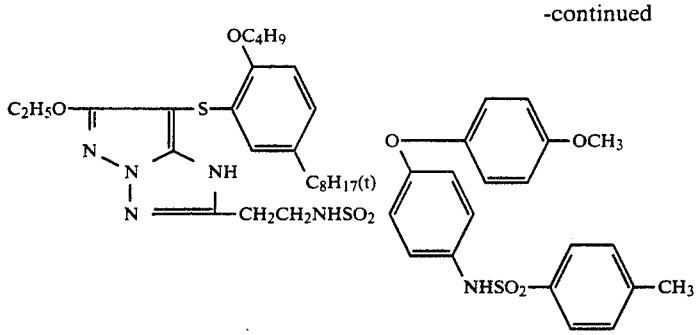

(M-23)

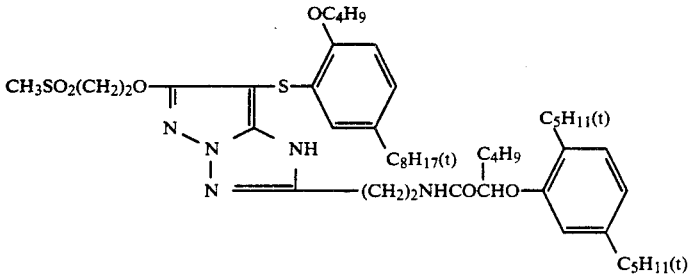

(M-24)

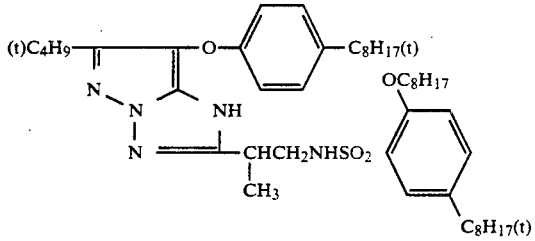

The nucleating agent represented by the general formula (N-I) are illustrated in detail below.

(N-I)

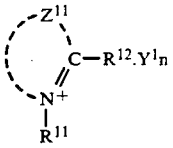

In the foregoing formula (N-I), $Z^{11}$ represents a nonmetallic atomic group necessary to complete a 5- or 6-membered hetero ring, which may further be substituted. $R^{11}$ represents an unsubstituted or substituted aliphatic hydrocarbon group, and $R^{12}$ represents a hydrogen atom, or an unsubstituted or substituted aliphatic or aromatic hydrocarbon group. Further $R^{12}$ may form a ring by attaching to the hetero ring completed by $Z^{11}$. At least one among the groups represented by $R^{11}$, $R^{12}$ and $Z^{11}$ must contain an alkynyl group, an aliphatic or aromatic acyl group, a hydrazino group or a hydrazono group, or $R^{11}$ and $R^{12}$ combine with each other to complete a 6-membered ring to result in the formation of dihydropyridinium skeleton. Furthermore, at least one among $R^{11}$, $R^{12}$ and $Z^{11}$ may contain a group capable of accelerating adsorption onto silver halide grains. $Y^1$ represent a counter ion for maintaining the charge balance, and n is a number of the counter ion necessary to achieve charge balance.

The compounds represented by the general formula (N-I) function as a nucleating agent, and detailed description thereof is given below.

Specific examples of the heterocyclic ring completed by $Z^{11}$ include quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium naphthoxazolium, and benzoxazolinium nuclei. $Z^{11}$ may be substituted with a substituent, such as an alkyl group ($C_{1-20}$), an alkenyl group ($C_{2-20}$), an aralkyl group ($C_{7-25}$), an aryl group ($C_{6-20}$), an alkynyl group ($C_{2-20}$), a hydroxy group, an alkoxy group ($C_{1-20}$), an aryloxy group ($C_{6-20}$), a halogen atom, an amino group, an alkylthio group ($C_{1-20}$), an arylthio group ($C_{6-20}$), an aliphatic or aromatic acyloxy group, an aliphatic or aromatic acylamino group, an aliphatic or aromatic sulfonyl group, an aliphatic or aromatic sulfonyloxy group, an aliphatic or aromatic sulfonylamino group a carboxyl group, an aliphatic or aromatic acyl group, a carbamoyl group, a sulfamoyl group, a sulfo group, a cyano group, a ureido group, a urethane group, a carboxylate group, a hydrazino group, a hydrazono group, an imino group, and so on. As for the substituent groups with which $Z^{11}$ may be substituted, at least one substituent is chosen from those cited above. When $Z^{11}$ has two or more substituent groups, they may be the same or different. The substituents as set forth above may further be substituted with any of the foregoing substituent.

Further, $Z^{11}$ may have as a substituent a heterocyclic quaternary ammonium group completed by $Z^{11}$ via an appropriate linking group L (L represents a bonding, an atom or atomic group containing at least one atom selected from among C, N, S, and O, with specific examples including an alkylene group, an alkenylene group, an alkynylene group, an arylene group, —O—, —S—, —NH—, —CO—, —$SO_2$— (these groups may have a substituent), and combinations of two or more thereof, such as —COO—, —CONH—, —$SO_2$NH—, —OCONH—, —NHCONH—, —NH$SO_2$NH—, —(alkylene)—CONH—, —(arylene)—$SO_2$NH—, —(arylene)—NHCONH—, —(arylene)—CONH—, etc.). In this case, the nucleating agent assumes a bis compound.

Preferred examples of the heterocyclic nucleus completed by $Z^{11}$ include quinolinium, benzothiazolium, benzimidazolium, pyridinium, acridinium, phenanthridinium, and isoquinolinium nuclei. Of these nuclei, quinolinium and benzimidazolium nuclei are more desirable than others, and a quinolinium nucleus is most preferable.

The aliphatic hydrocarbon group represented by $R^{11}$ and $R^{12}$ is preferably an unsubstituted alkyl group containing 1 to 18 carbon atoms, or a substituted alkyl group whose alkyl moiety contains 1 to 18 carbon atoms. As for the substituent group with which these alkyl groups may be substituted, those described as substituent groups for $Z^{11}$ can be cited as examples.

Aryl groups represented by $R^{12}$ are those containing 6 to 20 carbon atoms, e.g., phenyl, naphthyl and the like. As for the substituent groups with which the foregoing aryl groups may be substituted, those described as substituent groups for $Z^{11}$ can be cited as examples. Groups preferred as $R^{12}$ are aliphatic hydrocarbon groups, and the most preferable groups are a methyl group, substituted methyl groups, and those capable of forming a ring by bonding to the hetero ring completed by $Z^{11}$.

Of the groups represented by $R^{11}$, $R^{12}$ and $Z^{11}$, it is preferred for at least one group to contain an alkynyl group, an aliphatic or aromatic acyl group, a hydrazino group or a hydrazono group, or $R^{11}$ and $R^{12}$ is connected to each other to form a 6-membered ring to form a dihydropyridinium skeleton. More preferably, they contain at least one alkynyl group, particularly propargyl group.

The groups capable of accelerating adsorption onto silver halide grains, with which the substituent groups of $R^{11}$, $R^{12}$ and $Z^{1}$ can be substituted, are preferably those represented by the formula $X^1$—$(L^1)_m$—. In this formula $X^1$ represents a group capable of accelerating adsorption onto silver halide grains, $L^1$ represents a divalent linking group, and m is 0 or 1. Preferred examples of the adsorption accelerating group represented by $X^1$ are a thioamido group, a mercapto group and 5- or 6-membered nitrogen-containing heterocyclic groups.

These groups may be substituted with those described as substituent groups for $Z^{11}$. As for the thioamido group, acyclic thioamido groups (e.g., thiourethane, thioureido) are preferred.

As for the mercapto group represented by $X^1$, heterocyclic mercapto groups (e.g., 5-mercaptotetrazolyl, 3-mercapto-1,2,4-triazolyl, 2-mercapto-1,3,4-thiadiazolyl, 2-mercapto-1,3,4-oxadiazolyl) are preferred.

As for the 5- or 6-membered nitrogen-containing heterocyclic group represented by $X^1$, those containing nitrogen, oxygen, sulfur and carbon atoms as constituent elements, preferably those capable of producing iminosilver, such as benzotriazolyl, aminothiatriazolyl, etc., are cited as examples.

The divalent linking group represented by $L^1$ is an atom or atomic group containing at least one selected from among C, N, S, and O, with specific examples including an alkylene group, an alkenylene group, an alkynylene group, an arylene group, —O—, —S—, —NH—, —CO—, —$SO_2$— (these groups may have a substituent), and combinations of two or more thereof, such as —COO—, —CONH—, —$SO_2$NH—, —OCONH—, NHCONH—, —NH$SO_2$NH—, —(alkylene)—CONH—, —(arylene)—$SO_2$NH—, —(arylene)—NHCONH—, —(arylene)—CONH—, etc.

Examples of the counter ion Y' for charge balance include a bromine ion, a chlorine ion, an iodine ion, a p-toluenesulfonic acid ion, an ethylsulfonic acid ion, a perchloric acid ion, a trifluoromethanesulfonic acid ion, a thiocyanic acid ion, $BF_4^-$, $PF_6^-$, and so on.

Specific examples of these compounds and synthetic methods thereof are described, e.g., in the patents cited in *Research Disclosure,* No. 22534, pp. 50–54 (Jun. 1983) and No. 23213, pp. 267–270 (Aug. 1983) JP-B-49-38164, JP-B-52-19452, JP-B-52-47326 (the term "JP-B" as used herein means an "examined Japanese patent publication"), JP-A-52-69613, JP-A-52-3426, JP-A-55-138742, JP-A-60-11837, and U.S. Pat. Nos. 4,306,016 and 4,471,044.

Specific examples of compounds represented by the general formula (N-I) are illustrated below. However, the invention is not to be construed as being limited to these examples.

| | |
|---|---|
| (N-I-1) | 5-Ethoxy-2-methyl-1-propargylquinolinium bromide, |
| (N-I-2) | 2,4-Dimethyl-1-propargylquinolinium bromide, |
| (N-I-3) | 3,4-Dimethyl-dihydropyrido[2,1-b]benzothiazolium bromide, |
| (N-I-4) | 6-Ethoxythiocarbonylamino-2-methyl-1-propargylquinolinium trifluoromethanesulfonate, |
| (N-I-5) | 6-(5-Benzotriazolecarboxamido)-2-methyl-1-propargylquinolinium trifluoromethanesulfonate, |
| (N-I-6) | 6-(5-Mercaptotetrazole-1-yl)-2-methyl-1-propargylquinolinium iodide, |
| (N-I-7) | 6-Ethoxythiocarbonylamino-2-(2-methyl-1-propenyl)-1-propargylquinolinium trifluoromethanesulfonate, |
| (N-I-8) | 10-Propargyl-1,2,3,4-tetrahydroacridinium trifluoromethanesulfonate |
| (N-I-9) | 7-Ethoxythiocarbonylamino-10-propargyl-1,2,3,4-tetrahydroacridinium trifluoromethanesulfonate, |
| (N-I-10) | 7-[3-(5-Mercaptotetrazole-1-yl)benzamido]10-propargyl-1,2,3,4-tetrahydroacridinium perchlorate, |
| (N-I-11) | 7-(5-Mercaptotetrazole-1-yl)-9-methyl-10-propargyl-1,2,3,4-tetrahydroacridinium bromide, |
| (N-I-12) | 7-Ethoxythiocarbonylamino-10-propargyl-1,2-dihydroacridinium trifluoromethanesulfonate, |
| (N-I-13) | 10-Propargyl-7-[3-(1,2,3,4-thiatriazole-5-yl-amino)-benzamido]1,2,3,4-tetrahydroacridinium perchlorate, |
| (N-I-14) | 7-(3-Cyclohexylmethoxythiocarbonylaminobenzamido)-10-propargyl-1,2,3,4-tetrahydroacridinium trifluoromethanesulfonate, |
| (N-I-15) | 7-(3-Methoxythiocarbonylaminobenzamido)-10-propargyl-1,2,3,4-tetrahydroacridinium trifluoromethanesulfonate |
| (N-I-16) | 7[3-(3-Ethoxythiocarbonylaminophenyl)ureido]-10-propargyl-1,2,3,4-tetrahydroacridinium trifluoromethanesulfonate, |
| (N-I-17) | 7-(3-Ethoxythiocarbonylaminobenzenesulfonamido)-10-propargyl-1,2,3,4-tetrahydroacridinium trifluoromethanesulfonate, |
| (N-I-18) | 7-[3-{3-(5-Mercaptotetrazole-1-yl)phenyl}-ureido-benzamido]-10-propargyl-1,2,3,4- |

-continued

| | |
|---|---|
| | tetrahydroacridinium trifluoromethanesulfonate, |
| (N-I-19) | 7-[3-(5-Mercapto-1,3,4-thiadiazole-1-ylamino)-benzamido]-10-propargyl-1,2,3,4-tetrahydroacridinium trifluoromethanesulfonate, |
| (N-I-20) | 7-[3-(3-Butylthioureido)benzamido]-10-propargyl-1,2,3,4-tetrahydroacridinium trifluoromethanesulfonate |

When incorporated in the photographic material of the internal latent image type, the nucleating agent of this invention is preferably added to an internal latent-image type silver halide emulsion layer. However, the nucleating agent may be added to another layer, e.g., an interlayer, a subbing layer or a backing layer, so long as it can diffuse into a silver halide emulsion layer during the coating or processing step to result in adsorption on silver halide grains.

The nucleating agent is incorporated into the photographic material in an amount of from 0.2 to 2.0 g/m$^2$, preferably from 0.3 to 1.5 g/m$^2$.

The compounds represented by formulae (I), (II) and (N-1) are disclosed in U.S. Pat. No. 4,801,520 wherein they are used in combination.

The expression "processing with one and the same developer" as used in this invention is intended to include, as described, e.g., in JP-A-60-129747, such an embodiment that in separate processing tanks installed in one or two automatic developing machines, either of the photographic materials is processed in one processing tank, the overflow therefrom is introduced into another tank, and therein the other kind of photographic material is processed, in addition to the processing of different kinds of color photographic materials which is performed with one and the same developer tank installed in one automatic developing machine. The processing in this invention may be also carried out in a bleach-fix bath and a washing or stabilization tank directly thereafter.

In the present invention it is preferable that two kinds of photographic materials mentioned hereinabove are processed also with the same processing solution(s) after the development processing. These two photographic materials are preferably processed in the same developing machine, under the same temperature for the same period of time.

In the present invention the developer which can be preferbly used is that which has been used for development of the internal latent-image type direct positive silver halide color photographic material and the negative silver halide color photographic material in a ratio of the area of the former to that of the latter of from about 5/95 to 95/5, and it is more preferred that the ratio is from about 10/90 to 90/10, and which has become stable by using continuously and replenished until the constitutents of the developer has become substantially equilibrium state.

The color developer to be used in the development processing of the photographic materials of this invention is preferably an alkaline aqueous solution containing an aromatic primary amine color developing agent as a main component. p-Phenylenediamine compounds are preferably used, as the color developing agent, although aminophenol compounds also are useful. Typical examples of p-phenylenediamine type color developing agents include 3-methyl-4-amino-N,N-diethylaniline, 3-methyl-4-amino-N-ethyl-N-β-hydroxyethylaniline, 3-methyl-4-amino-N-β-methanesulfonamidoethylaniline, 3-methyl-4-amino-N-ethyl-N-β-methoxyethylaniline, and the sulfates, hydrochlorides or p-toluenesulfonates of the above-cited anilines. These compounds may be used as mixture of two or more thereof, if desired.

The pH of such the color developer as described above is maintained at 10.15 to 11.0, preferably 10.20 to 10.5.

In the processing method of this invention, it is desirable for the suppression of fluctuation in image quality due to the processing that the bromine ion concentration in a color developer should be maintained at from $1.0\times10^{-2}$ to $2.5\times10^{-2}$ gram ion/l, more preferably $1.0\times10^{-2}$ to $2.0\times10^{-2}$ gram ion/l. The bromine ion concentrations as described above can be obtained by properly controlling the bromine ion concentration in the mother liquor or the replenisher of the color developer. For example, the bromine ion concentration can be controlled by addition of replenisher after processing a unit area of photographic material. The replenishing amount can be determined according to the coating amount of silver in the photographic material and development ratio (the image density). The color developer is substantially free from iodide ions. In other words, the amount of iodine ions is from 0 to $0.5\times10^{-5}$ mol/l.

In the processing of the silver halide color photographic materials of this invention, it is preferred at least one of compounds represented by the general formula (III) or (IV) and salts thereof be used in the color developer as a preservative, and it is especially effective when this preservative is used in a developer having the above-described bromine ion concentration. The compounds of the general formulae (III) and (IV) are illustrated in detail below.

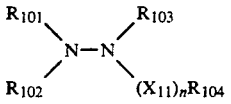

(III)

In the above formula (III), $R_{101}$, $R_{102}$ and $R_{103}$ each represents a hydrogen atom, an alkyl group, an aryl group, or a heterocyclic group; $R_{104}$ represents a hydrogen atom, a hydroxyl group, a hydrazino group, an alkyl group, an aryl group, a heterocyclic group, an alkoxy group, an aryloxy group, a carbamoyl group, or an amino group; $X_{11}$ represents a divalent group; and n represents 0 or 1. However, when n is 0, $R_{104}$ must be an alkyl group, an aryl group or a heterocyclic group. In addition, $R_{103}$ and $R_{104}$ may combine together to complete a hetero ring.

The hydrazine analogues represented by the general formula (III) (including hydrazines and hydrazides) are described more specifically below.

$R_{101}$, $R_{102}$ and $R_{103}$ each represents a hydrogen atom, a substituted or unsubstituted alkyl group (preferably one which contains 1 to 20 carbon atoms, e.g., methyl, ethyl, sulfopropyl, carboxybutyl, hydroxyethyl, cyclohexyl, benzyl and phenethyl groups), a substituted or unsubstituted aryl group (preferably one which contains 6 to 20 carbon atoms, e.g., phenyl, 2,5-dimethoxyphenyl, 4-hydroxyphenyl, 2-carboxyphenyl, etc.), or a substituted or unsubstituted heterocyclic group (preferably a 5- to 6-membered one containing 1 to 10 carbon atoms and at least one hetero atom, such as oxygen, nitrogen, sulfur or so on, e.g., pyridine-4-yl, N-acetylpiperidine-4-yl).

$R_{104}$ represents a hydrogen atom, a hydroxyl group, a substituted or unsubstituted hydrazino group (e.g., hydrazino, methylhydrazino, phenylhydrazino), a substituted or unsubstituted alkyl group (preferably containing 1 to 20 carbon atoms, e.g., methyl, ethyl, sulfopropyl, carboxylbutyl, hydroxyethyl, cyclohexyl, benzyl, t-butyl, n-octyl), a substituted or unsubstituted aryl group (preferably containing 6 to 20 carbon atoms, e.g., phenyl, 2,5-dimethoxyphenyl, 4-hydroxyphenyl, 2-carboxyphenyl, 4-sulfophenyl), a substituted or unsubstituted heterocyclic group (which is preferably a 1–20 C, 5- or 6-membered ring containing at least one oxygen, nitrogen or sulfur atom as a hetero atom, e.g., pyridine-4-yl, imidazolyl), a substituted or unsubstituted alkoxy group (preferably containing 1 to 20 carbon atoms, e.g., methoxy, ethoxy, methoxyethoxy, benzyloxy, cyclohexyloxy, octyloxy), a substituted or unsubstituted aryloxy group (preferably containing 6 to 20 carbon atoms, e.g., phenoxy, p-methoxyphenoxy, p-carboxyphenyl, p-sulfophenoxy), a substituted or unsubstituted carbamoyl group (preferably containing 1 to 20 carbon atoms, e.g., unsubstituted carbamoyl, N,N-diethylcarbamoyl, phenylcarbamoyl), or a substituted or unsubstituted amino group (preferably containing 0 to 20 carbon atoms, e.g., amino, hydroxyamino, methylamino, hexylamino, methoxyethylamino, carboxyethylamino, sulfoethylamino, N-phenylamino, p-sulfophenylamino).

Preferred substituent groups with which the groups represented by $R_{101}$, $R_{102}$, $R_{103}$ and $R_{104}$ may further be substituted include a halogen atom (e.g., chlorine, bromine), a hydroxy group, a carboxy group, a sulfo group, an amino group, an alkoxy group, an amido group, a sulfonamido group, a carbamoyl group, a sulfamoyl group, an alkyl group, an aryl group, an aryloxy group, an alkylthio group, an arylthio group, a nitro group, a cyano group, an aliphatic or aromatic sulfonyl group, an aliphatic or aromatic sulfinyl group, and so on. These substituent groups may further be substituted.

$X_{11}$ is preferably a divalent organic residue, such as $$-CO-,\ -SO-\ \text{or}\ -\overset{\overset{\displaystyle NH}{\|}}{C}-.$$

n is 0 or 1. When n is 0, $R_{104}$ is a group selected from substituted and unsubstituted alkyl, aryl and heterocyclic groups. $R_{101}$ and $R_{102}$, and $R_{103}$ and $R_{104}$ may combine together to complete a hetero ring. In the case of n=0, at least one of $R_{101}$, $R_{102}$, $R_{103}$ and $R_{104}$ is preferably a substituted or unsubstituted alkyl group. In particular, it is preferred for $R_{101}$, $R_{102}$, $R_{103}$ and $R_{104}$ to be a hydrogen atom and substituted or unsubstituted alkyl groups, except they are all hydrogen atoms. Where $R_{101}$, $R_{102}$ and $R_{103}$ are hydrogen atoms, and $R_{104}$ is a substituted or unsubstituted alkyl group, where $R_{101}$ and $R_{103}$ are both hydrogen atoms, and $R_{102}$ and $R_{104}$ are both substituted or unsubstituted alkyl groups, and where $R_{101}$ and $R_{102}$ are both hydrogen atoms, and $R_{103}$ and $R_{104}$ are both substituted or unsubstituted alkyl groups (or they may combine with each other to complete a hetero ring) are particularly preferred.

When n is 1, on the other hand, $X_{11}$ is preferably —CO—, $R_{104}$ is preferably a substituted or unsubstituted amino group, and $R_{101}$, $R_{102}$ and $R_{103}$ are preferably hydrogen atoms, or substituted or unsubstituted alkyl groups.

The case of n=0 is preferred.

Alkyl groups represented by $R_{101}$ to $R_{104}$ are preferably those containing 1 to 10 carbon atoms, more preferably those containing 1 to 7 carbon atoms. Suitable examples of substituents which these alkyl groups may have, are a hydroxyl group, a carboxyl group, a sulfo group and a phospho group. When two or more substituent groups are present in these alkyl groups, they may be the same or different.

The compounds of the general formula (III) may form a bis-body, a tris-body or a polymer connected via $R_{101}$, $R_{102}$, $R_{103}$ or $R_{104}$.

Specific examples of compounds represented by the general formula (III) are illustrated below.

$CH_3NHNHCH_3$ (III-1)

$(HOC_2H_4)_2NNH_2$ (III-2)

$(NH_2N(CH_2COOH)_2)$ (III-3)

$HOOCCH_2NHNHCH_2COOH$ (III-4)

$NH_2NHCH_2CH_2OH$ (III-5)

$NH_2NH-(CH_2)_3-SO_3H$ (III-6)

(III-7)

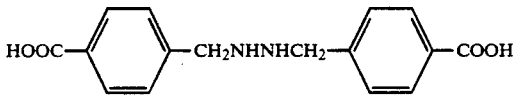

$(NH_2N((CH_2)_2COONa)_2)$ (III-8)

$(H_2NN(C_4H_9(n))(CHCOOH)_2)$ (III-9)

$(H_2NN(CH_2CH_2SO_3Na)_2)$ (III-10)

$(H_2NN(C_2H_5)(CHCOOH)_2)$ (III-11)

$NH_2NHCONH-(CH_2)_3-NHCONHNH_2$ (III-12)

$NH_2NHCOCONHNH_2$ (III-13)

(III-14)

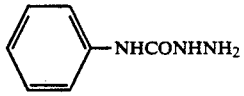

$NH_2COCONHNH_2$ (III-15)

(III-16)

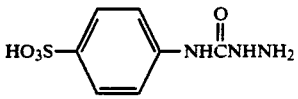

$(HOOCCH_2)_2N-C(=O)NHNH_2$ (III-17)

-continued $$HOOCCH_2CH_2NHC(=O)NHNH_2 \quad \text{(III-18)}$$

$$H_2NN(CH_2PO_3H_2)_2 \quad \text{(III-19)}$$

$$-(CH_2N(NH_2)CH_2CH(OH))_n- \quad \text{(III-20)}$$

Specific examples other than the above-illustrated ones are compounds described, e.g., in U.S. Pat. No. 4,801,521.

$$R^{105}-N(OH)-R^{106} \quad \text{(IV)}$$

In the above formula, $R^{105}$ and $R^{106}$ each represent a hydrogen atom, an unsubstituted or substituted alkyl group, an unsubstituted or substituted alkenyl group, an unsubstituted or substituted aryl group, or an unsubstituted or substituted aromatic heterocyclic group. Also, $R^{105}$ and $R^{106}$ may combine together to form a hetero ring together with the nitrogen atom. However, the case of $R^{105}=R^{106}=H$ is excluded.

Alkyl groups and alkenyl groups represented by $R^{105}$ and $R^{106}$ may have a straight-chain, branched chain or cyclic structure.

Examples of substituents with which the alkyl, alkenyl and aryl groups represented by $R^{105}$ and $R^{106}$ can be substitutedm include halogen atoms (e.g., F, Cl, Br), aryl groups (e.g., phenyl, p-chlorophenyl), alkyl groups (e.g., methyl, ethyl, isopropyl), alkoxy groups (e.g., methoxy, ethoxy, methoxyethoxy), aryloxy groups (e.g., phenoxy), an aliphatic or aromatic sulfonyl groups (e.g., methanesulfonyl, p-toluenesulfonyl), sulfonamido groups (e.g., methanesulfonamido, benzenesulfonamido), sulfamoyl groups (e.g., diethylsulfamoyl, unsubstituted sulfamoyl), carbamoyl groups (e.g., unsubstituted carbamoyl, diethylcarbamoyl), amido groups (e.g., acetamido, benzamido, naphthoamido), ureido groups (e.g., methylureido, phenylureido), alkoxycarbonylamino groups (e.g. methoxycarbonylamino), aryloxycarbonylamino groups (e.g., phenoxycarbonylamino), alkoxycarbonyl groups (e.g., methoxycarbonyl), aryloxycarbonyl groups (e.g., phenoxycarbonyl), a cyano group, a hydroxyl group, a carboxyl group, a sulfo group, a nitro group, amino groups (e.g., unsubstituted amino, diethylamino), alkylthio groups (e.g., methylthio), arylthio groups (e.g., phenylthio), a hydroxyamino group, and heterocyclic groups (e.g., morpholino, pyridyl). In the formula (IV), $R^{105}$ and $R^{106}$ may represent the same group, or groups different from each other.

Suitable examples of aromatic hetero rings from which groups represented by $R^{105}$ and $R^{106}$ are derived include pyrrole, pyrazole, imidazole, 1,2,4-triazole, tetrazole, benzimidazole, benzoxazole, benzothiazole, 1,2,4-thiadiazole, pyridine, pyrimidine, triazine (including s-triazine and 1,3,4-triazine), indazole, purine, quinoline, isoquinoline, quinazoline, perimidine, isooxazole, oxazole, thiazole, selenazole, tetraazaindene, s-triazolo[1,5-a]pyrimizine, s-triazolo[1,5-b]pyridazine, pentaazaindene, s-triazolo[1,5-b][1,2,4]triazine, s triazolo[5,1 d]-s-triazine, triazaindene (imidazolo[4,5-b]pyridine), and so on. These heterocyclic groups may further have substituents. Suitable examples of such substituents include those described as examples regarding the above-described alkyl, alkenyl and aryl groups.

Suitable examples of nitrogen-containing hetero ring groups completed by combining $R^{105}$ with $R^{106}$ include piperidyl, pyrrolidilyl, N-alkylpiperazyl, morpholyl, indolinyl, benzotriazolyl, and so on.

In the general formula (IV), an alkyl group and an alkenyl group are preferred as $R^{105}$ and $R^{106}$, and these groups preferably contain 1 to 10 carbon atoms, particularly 1 to 5 carbon atoms.

Substituents with which $R^{105}$ and $R^{106}$ are preferably substituted are a hydroxyl group, an alkoxy group, an alkyl- or aryl-sulfonyl group, an amido group, carboxyl group, a cyano group, a sulfo group, a nitro group, and an amino group.

Specific examples of the compounds represented by the general formula (IV), which are preferred for use in this invention, are illustrated below.

$$CH_3-NH-OH \quad \text{(IV-1)}$$

$$C_2H_5-NH-OH \quad \text{(IV-2)}$$

$$n\text{-}C_3H_7-NH-OH \quad \text{(IV-3)}$$

$$HO-CH_2-NH-OH \quad \text{(IV-4)}$$

$$HO-C_2H_4-NH-OH \quad \text{(IV-5)}$$

$$HOOC-C_2H_4-NH-OH \quad \text{(IV-6)}$$

$$HO-C_2H_4-O-C_2H_4-NH-OH \quad \text{(IV-7)}$$

$$(CH_3)_2N-OH \quad \text{(IV-8)}$$

$$(CH_3)(C_3H_7)N-OH \quad \text{(IV-9)}$$

$$(C_2H_5)_2N-OH \quad \text{(IV-10)}$$

$$(C_2H_5)(CH_3OC_2H_4)N-OH \quad \text{(IV-11)}$$

$$(C_2H_5OC_2H_4)_2N-OH \quad \text{(IV-12)}$$

$$(CH_3OC_2H_4)(CH_2{=}CHCH_2)N-OH \quad \text{(IV-13)}$$

$$(CH_3OC_2H_4)(C_6H_5)N-OH \quad \text{(IV-14)}$$

-continued (IV-15)

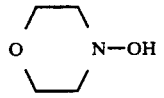

(IV-16)

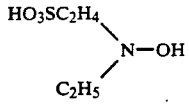

(IV-17)

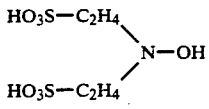

(IV-18)

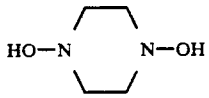

The compounds of the general formula (IV) are commercially available. In addition, these compounds can be synthesized according to the methods described in U.S. Pat. Nos. 3,661,996, 3,362,961, 3,293,034, 3,491,151, 3,655,764, 3,467,711, and so on. Moreover, they may form salts together with various kinds of organic or inorganic acids, such as hydrochloric acid, sulfuric acid, phosphoric acid, oxalic acid, acetic acid and so on.

The compound of the formula (III) and/or (IV) as described above is present in an amount of $1\times10^{-4}$ to $5\times10^{-1}$ mol, preferably $1\times10^{-3}$ to $3\times10^{-1}$ mol, and more preferably $5.0\times10^{-3}$ to $2\times10^{-1}$ mol, per liter of the color developer.

Further, it is preferred in this invention that at least one of compounds of the following general formula (V), those of the following general formula (VI), and salts thereof be added to a color developer in addition to at least one of compounds of the general formula (III) those of the general formula (IV), and salts thereof.

The compounds represented by the general formulae (V) and (VI) are illustrated in detail below.

(V)

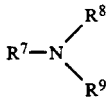

where $R^7$ represents a $C_{2-6}$ hydroxyalkyl group; $R^8$ and $R^9$ each represent a hydrogen atom, a $C_{1-6}$ alkyl group, a $C_{2-6}$ hydroxyalkyl group, a benzyl group, or a group represented by

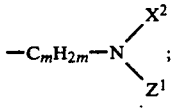

m is an integer of 1 to 6; $X^2$ and $Z^1$ each represent a hydrogen atom, a $C_{1-6}$ alkyl group, or a $C_{2-6}$ hydroxyalkyl group).

Specific examples of the compounds of the foregoing general formula (V) are given below. However, the invention is not to be construed as being limited to the following examples.

| | |
|---|---|
| V-1 | Ethanolamine |
| V-2 | Diethanolamine |
| V-3 | Triethanolamine |
| V-4 | Diisopropanolamine |
| V-5 | 2-Methylaminoethanol |
| V-6 | 2-Ethylaminoethanol |
| V-7 | Dimethylaminoethanol |
| V-8 | 2-Diethylaminoethanol |
| V-9 | 1-Diethylamino-2-propanol |
| V-10 | Benzylethanolamine |
| V-11 | Isopropylaminoethanol |

The above alkanolamines may form various kinds of salts together with hydrochloric acid, sulfuric acid, nitric acid, acetic acid, oxalic acid, and so on.

Addition of alkanolamines is desirable for improvement of preservation ability, and they are used in an amount of 0.01 to 20 g, preferably 0.1 to 10 g, and more preferably 1 to 8 g per liter of the color developer.

(VI)

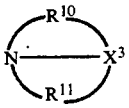

where $X^3$ represents a trivalent group necessary to complete a condensed ring; $R^{10}$ and $R^{11}$ may be the same or different, each being an alkylene group, an arylene group, an alkenylene group, or an aralkylene group.

In the general formula (VI), the number of carbons present in $X^3$ is preferably 20 or less, more preferably 10 or less, and particularly preferably 6 or less. $X^3$ may contain an nitrogen atom, an oxygen atom, a sulfur atom, or the like.

In the general formula (VI), the number of carbons present in $R^{10}$ and $R^{11}$ is preferably 10 or less, more preferably 6 or less, and particularly preferably 3 or less. $R^{10}$ and $R^{11}$ are preferably an alkylene group or an arylene group, particularly preferably an alkylene group.

The compound of the general formula (VI) may be a bisbody or a tris-body connected via $X^3$.

Suitable examples of $X^3$ in the general formula (VI) include

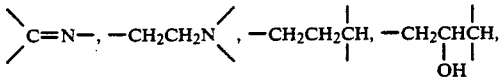

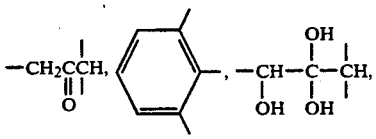

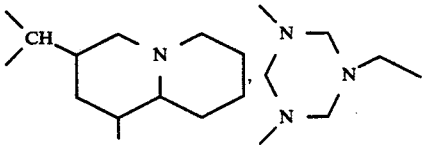

and so on.

Examples of groups represented by $R^{10}$ and $R^{11}$ in the general formula (VI) include methylene, ethylene, propylene, butylene, pentylene, 1,2-cyclohexylene, 1-methylethylene, 1,2-dimethylethylene, 1-carboxyethylene, 1,2-phenylene, 1,2-vinylene, 1,3-propenylene, and so on. These groups may be substituted with an alkyl group, a halogen atom, a carboxyl group, a sulfo group, a hydroxyl group, an alkoxy group, an alkylthio group, an amino group, an amido group, an aliphatic or aromatic acyl group, a carbamoyl group, a sulfamoyl group, a heterocyclic group, or so on.

Of the compounds represented by the general formula (VI), those represented by the general formulae (VI-a) and (VI-b) are particularly preferred.

(VI-a)

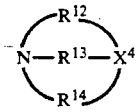

In the above formula, $X^4$ represents

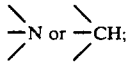

$R^{12}$ and $R^{13}$ are defined as $R^{10}$ and $R^{11}$ in the general formula (VI); and $R^{14}$ represents the same group as $R^{12}$ and $R^{13}$, or $—CH_2CO—$.

In the general formula (VI-a),

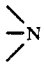

is preferred as $X^4$. The number of carbons present in each of $R^{12}$, $R^{13}$ and $R^{14}$ is preferably 6 or less, more preferably 3 or less, and most preferably 2 or less.

Preferred groups represented by $R^{12}$ $R^{13}$ and $R^{14}$ each are alkylene groups and arylene groups, especially alkylene groups.

(VI-b)

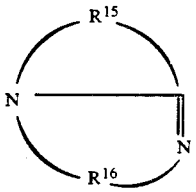

In the above formula, $R^{15}$ and $R^{16}$ have the same meaning as $R^{10}$ and $R^{11}$.

In the general formula (VI-b), the number of carbons present in each of $R^{15}$ and $R^{16}$ is preferably 6 or less. Preferred groups represented by $R^{15}$ and $R^{16}$ are alkylene groups and arylene groups, especially alkylene groups.

The compounds represented by the general formula (VI-a) are preferable to those represented by the general formula (VI-b).

Specific examples of the compounds represented by the general formula (VI), are illustrated below. However, this invention is not to be construed as being limited to the following examples.

VI-1

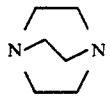

VI-2

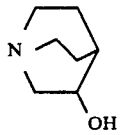

VI-3

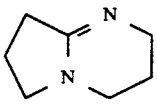

VI-4

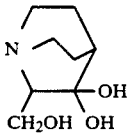

VI-5

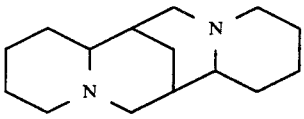

VI-6

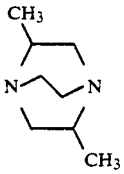

VI-7

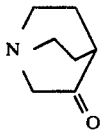

VI-8

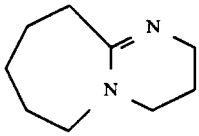

VI-9

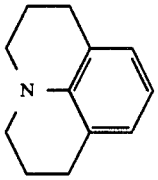

VI-10

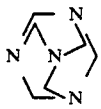

-continued

VI-11

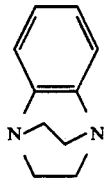

VI-12

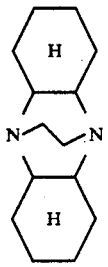

VI-13

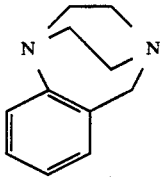

VI-14

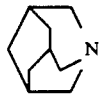

VI-15

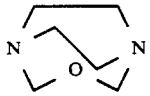

Most of the compounds represented by the general formula (VI) to be used in this invention can be easily obtained as commercial products.

The compounds represented by the general formula (VI) are employed in an amount of preferably 0.01 to 100 g, more preferably 0.1 to 20 g, per liter of the color developer.

The amount of benzyl alcohol in the color developer is from $5\times10^{-2}$ to $2\times10^{-1}$ mol/l, with $1\times10^{-1}$ to $2\times10^{-1}$ mol/l as the preferred amount.

The foregoing color developer used are this invention may contain a sulfite. Further, it can contain an organic solvent such as ethylene glycol or diethylene glycol, a development accelerator such as polyethylene glycol, quaternary ammonium salts or amines, dye forming couplers, competing couplers, a fogging agent such as sodium boronhydride, an auxiliary developing agent such as 1-phenyl-3-pyrazolidone, and a viscosity imparting agent. The processing temperature of the color developer is from 36° to 50° C.

After color development, the photographic emulsion layers are generally subjected to a bleach processing. The bleach processing may be carried out simultaneously with a fixation processing (a bleach-fix processing), or separately therefrom. For the purpose of speeding up the photographic processing, the bleach processing may be followed by bleach fix processing. Also, the processing may be performed with two successive bleach-fix baths, or fixation processing may be followed by bleach-fix processing, or bleach-fix processing may be followed by bleach processing, if desired. Examples of bleaching agents which can be used include compounds of polyvalent metals, such as Fe(III), Co(III), Cr(VI), Cu(II), etc.; peroxy acids; quinones; nitro compounds; and so on. More specifically, ferricyanides; dichromates; organic complex salts formed by Fe(III) or Co(III), and aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diamine tetraacetic acid, etc., citric acid, tartaric acid, malic acid, or so on; persulfates; hydrobromides; permanganates; nitrobenzenes; and so on can be cited as the representative examples of bleaching agents.

The pH of the bleaching or bleach-fix bath which uses an aminopolycarboxylic acid-Fe(III) complex salt as a bleaching agent generally ranges from 5.5 to 8, but the processing can be performed at a lower pH for the purpose of increasing the processing speed.

In the bleaching bath, the bleach-fix bath and the prebath thereof, bleach accelerators can be used, if desired.

Specific examples of useful bleach accelerators include compounds containing a mercapto group or a disulfide linkage, as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124,424, JP-A-53-141623, JP-A-53-28426, *Research Disclosure,* No. 17129 (Jul. 1978), and so on; thiazolidine derivatives described in JP-A-50-140129; thiourea derivatives described in JP-B-45-8506, JP-A-52-20832, JP-A-53-32735, and U.S. Pat. No. 3,706,561; iodides described in West German Patent 1,127,715, and JP-A-58-16235; polyoxyethylene compounds described in West German Patents 966,410 and 2,748,430; polyamine compounds described in JP-B-45-8836; the compounds described in JP-A-49-42434, JP-A-49-59644, JP-A-53-94927, JP-A-54-35727, JP-A-55-26506, and JP-A-58-163940; and bromide ion. Of these bleach accelerators, the compounds containing a mercapto group or a disulfide linkage are preferred from the standpoint of the height of their acceleration effect. In particular, the compounds described in U.S. Pat. No. 3,893,858, West German Patent 1,290,812, and JP-A-53-95630 are preferred over others. In addition, the compounds described in U.S. Pat. No. 4,552,834 are also effective. These bleach accelerators may be incorporated in the photographic materials. These bleach accelerators are particularly effective in the bleach-fix step of color photographic materials for photograph-taking use.

Examples of fixers which can be used are thiosulfates, thiocyanates, thioether compounds, thioureas, a large amount of iodide, and so on. Generally used fixers are thiosulfates, especially ammonium thiosulfate. As for the preservatives for a bleach-fix bath, sulfites, bisulfites, or adducts of carbonyl compounds and bisulfites are preferably used.

After a desilvering step, the silver halide color photographic materials of the present invention are, in general, subjected to a washing step and/or a stabilizing step. The volume of washing water required can be determined variously depending on the characteristics of the photosensitive materials to be processed (e.g., on what kinds of couplers are incorporated therein), enduse purposes of the photosensitive materials to be processed, the temperature of the washing water, the number of washing tanks (stage number), the way of replenishing the washing water (e.g., whether a current of water flows in a counter direction, or not), and other various conditions. Of these conditions, the relationships between the number of washing tanks and the volume of washing water in the multistage counter current process can be determined according to the methods described in *Journal of the Society of Motion Picture and Television Engineers,* volume 64, pages 248–253 (May 1955).

According to the mutlistage counter current process described in the above-cited literature, the volume of washing water can be sharply decreased. However, the process has disadvantages, e.g., in that bacteria propagate in the tanks because of an increase in the residence time of water in the tanks, and suspended matter produced by the bacteria sticks to photographic materials processed therein. In the processing of the color photographic materials of this invention, the method of reducing calcium and magnesium ion concentrations, which is disclosed in JP-A-62-288838, can be employed to great advantage as a means of solving the above-described problem. Further, bactericides such as isothiazolone compounds and thiabendazoles disclosed in JP-A-57-8542, chlorine-containing germicides such as the sodium salt of chlorinated isocyanuric acid, and benzotriazoles, as described in Hiroshi Horiguchi, *Bohkin Bohbai Zai no Kagaku* ("Chemistry of Antibacteria and Antimolds"), *Biseibutsu no Mekkin Sakkin Bohbai Gijutsu* ("Arts of Sterilizing and Pasteurizing Microbes, and Proofing Against Mold"), compiled by Eisei Gijutsu Kai, and *Bohkin- and Bohbaizai Jiten* ("Thesaurus of Antibacteria and Antimolds"), compiled by Nippon Bohkin Bohbai Gakkai.

Washing water to be used in the processing of the photographic materials of the present invention is adjusted to a pH of 4–9, preferably to a pH of 5–8. The washing temperature and the washing time, which can be chosen variously depending on the characteristics and the intended use of the photographic materials to be washed, generally range from 20 sec. to 10 min. at 15° to 45° C., preferably 30 sec. to 5 min. at 25° to 40° C.

Also, the photographic materials of the present invention can be processed directly with a stabilizing solution instead of using the above-described washing water. Known methods, which are described in JP-A-57-8543, JP-A-58-14834 and JP-A-60-220345, can be applied to the stabilization step in the present invention.

In certain cases, the stabilization step is also performed subsequently to the above-described washing step. As an example, a stabilizing bath containing formaldehyde and a surfactant, which is used as the final bath for color photographic materials used for photographing, can be cited.

Various kinds of chelating agents and antimold agents can also be added to the stabilizing bath.

The washing water and/or the stabilizing solution overflowing the processing baths with the replenishing thereof can also be reused in other steps such as the desilvering step.

For the purposes of simplification and speedup of the photographic processing of the silver halide photographic materials to be used in the present invention, a color developing agent may be incorporated into the photographic materials. It is desirable that the color developing agent should be used in the form of precursors of various types. As examples, compounds of an indoaniline type described in U.S. Pat. No. 3,342,597, compounds of a Schiff base type described in U.S. Pat. No. 3,342,599 and *Research Disclosure, Nos.* 14850 and 15159, aldol compounds described in *Supra,* No. 13924, metal complex salts described in U.S. Pat. No. 3,719,492, and urethane compounds described in JP-A-53-135628 can be employed.

In the silver halide photographic materials to be used in the present invention, various 1-phenyl-3-pyrazolidones may be incorporated for the purpose of accelerating color development, if desired. Typical examples of such compounds are described in JP-A-56-64339, JP-A-57-144547 and JP-A-115438.

The temperature of each processing bath used in the present invention ranges from 10° to 50° C. Although a standard temperature is within the range of 33° to 38° C., temperatures higher than standard can be employed for reduction of the processing time through acceleration of the processing, while those lower than standard enable the achievements of improved image quality and enhanced stability of the processing bath. Moreover, a processing utilizing cobalt intensification or hydrogen peroxide intensification as described in West German Patent 2,226,770 or U.S. Pat. No. 3,674,499 may be carried out for the purpose of saving silver.

It is preferred in this invention for the color developer to contain a chelating agent of the organic phosphonic acid type.

Any organic phosphonic acid, including alkylphosphonic acids, phosphonocarboxylic acids, aminopolyphosphonic acids and so on, can be used as the chelating agent of the above-described type.

The silver halide emulsions of the photographic materials to be used in this invention may have any halide composition, including silver iodobromide, silver bromide, silver chlorobromide, silver chloride, and so on. However, in the processing according to this invention, wherein silver halide color photographic materials of internal latent-image type and silver halide color photographic materials of negative type are processed by means of one and the same automatic developing machine using one and the same developer, silver bromide or silver chlorobromide is preferred over other compositions. In particular, silver chlorobromide having a bromide content of 50–100 mol % is desirable in the former case and in the later case any of silver chlorobromide, silver iodochlorobromide, silver bromide and silver iodobromide may be used so long as it has a bromide content of 20 mol % or more, however, silver chlorobromides having substantially no iodide content are particularly preferred. The expression "substantially no iodide content" is intended to include silver iodide contents of 3 mol % or less, preferably 1 mol % or less, based on the total weight of silver halide.

An unprefogged, internal latent-image type silver halide emulsion to be employed in the present invention comprises silver halide grains whose surfaces are not prefogged, and which form a latent image predominantly inside thereof. More specifically, it is defined as an emulsion which gains at least 5-fold, preferably at least 10-fold, maximum density when a silver halide emulsion is coated on a transparent support at a prescribed coverage (e.g. 0.5 to 3 $g/m^2$ based on the silver), exposed to light for a fixed period of time (e.g. 0.01 to 10 sec), and then developed at 18° C. for 5 min. using Developer A described below (Internal Developer A), and thereafter the maximum density is determined according to a usual photographic density measuring method, compared with the case where the silver halide emulsion coated at the same coverage is exposed in the same manner, and developed at 20° C. for 6 minutes using Developer B described below (Surface Developer B).

| | |
|---|---|
| Internal Developer A | |
| Metol | 2 g |
| Sodium Sulfite (anhydrous) | 90 g |
| Hydroquinone | 8 g |
| Sodium Carbonate (monohydrate) | 52.5 g |
| KBr | 5 g |
| KI | 0.5 g |
| Water to make | 1 l |
| Surface Developer B | |
| Metol | 2.5 g |
| L-Ascorbic Acid | 10 g |
| $NaBO_2.4H_2O$ | 35 g |
| KBr | 1 g |
| Water to make | 1 l |

Specific examples of internal latent-image type emulsions include conversion type emulsions disclosed in U.S. Pat. No. 2,592,250 and core/shell type silver halide emulsions disclosed in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137, JP-A-62-215272, and the patents disclosed in *Research Disclosure,* No. 23510, p. 236 (Nov. 1983).

The silver halide grains to be used in the present invention may have a regular crystal form, such as that of a cube, an octahedron, a dodecahedron, a tetradecahedron or so on, an irregular crystal form, such as that of a sphere or so on, or a tabular form having a length/thickness ratio of 5 or above. In addition, silver halide grains having a composite form of these various crystal forms may be used, or a mixture of emulsions containing silver halide grains with various crystal forms may be used.

The silver halide grains have a mean grain size of preferably from 0.1 to 2 μm, particularly preferably from 0.15 to 1 μm. The size distribution of the silver halide grains to be used in the present invention, may be narrow or broad, and is preferably a so-called "monodisperse" in respect of improvements in granularity, sharpness and so on. The terminology monodisperse system as used herein refers to a disperse system wherein 90% or more of the grains have their individual sizes within the range of ±40% of the number or weight average grain size, and preferably within ±20%. In order to satisfy the gradation aimed at, two or more of monodisperse silver halide emulsions, which have substantially the same color sensitivity, but different grain sizes, or plural kinds of grains having the same size but different sensitivities can be coated as a mixture in the same layer, or separately in superposed layers. In addition, a combination of two or more of polydisperse silver halide emulsions, or a combination of monodisperse and polydisperse emulsions can be used as a mixture, or coated separately in superposed layers.

The interior or the surface of silver halide emulsion grains to be used in the present invention can be chemically sensitized by using a sulfur or selenium sensitization process, a reduction sensitization process, a noble metal sensitization process and so on individually or as a combination thereof. Specific examples of these processes are described in the patents cited, e.g., in *Research Disclosure,* No. 17643-III, p. 23 (Dec. 1978), and so on.

The silver chlorobromide emulsions to be used in this invention can be prepared using various methods, as described, for example, in P. Glafkides, *Chimie et Phisique Photographique,* Paul Montel, Paris (1967), G. F. Duffin, *Photographic Emulsion Chemistry,* The Focal Press, London (1966), and V. L. Zelikman et al, *Making and Coating Photographic Emulsion,* The Focal Press, London (1964).

More specifically, any known processes, including the acid process, the neutral process, the alkali process, the ammoniacal processes and so on, can be employed. Suitable methods for reacting a water-soluble silver salt with a water-soluble halide include, e.g., a single jet method, a double jet method or a combination thereof. Also, a method in which silver halide grains are produced in the presence of excess silver ion (the so-called reverse mixing method) can be employed in this invention. As one embodiment of a double jet method, the so-called controlled double jet methods, in which the pAg of the liquid phase in which silver halide grains are to be precipitated is maintained constant, may be also employed. According to this method, a monodisperse silver halide emulsion having a regular crystal form as described above and a narrow size distribution can be obtained. It is preferred for such silver halide emulsion grains as described above to be prepared on the basis of the double jet method.

Emulsions to be used in this invention are generally ripened physically and chemically, and further sensitized spectrally. Additives to be used in these steps are described in *Research Disclosure,* Vol. 176, No. 17643 (Dec. 1978), and Ibid., Vol. 187, No. 18716 (Nov. 1979), and the columns in which descriptions thereof are given are set forth together in the following table.

Photographic additives which can be used in the present invention are also described in these *Research Disclosure* citations, and where they are described is also tabulated in the following table.

| Kind of Additives | RD 17643 | RD 18716 |
|---|---|---|
| 1. Chemical Sensitizers | Page 23 | Page 648, right column |
| 2. Sensitivity-Increasing Agents | | Page 648, right column |
| 3. Spectral Sensitizers | Pages 23 to 24 | Page 648, right column et seq. |
| 4. Supersensitizers | | Page 649, right column |
| 5. Brightening Agents | Page 24 | |
| 6. Antifoggants and Stabilizers | Pages 24 to 25 | Page 649, right column |
| 7. Couplers | Page 25 | |
| 8. Organic Solvents | Page 25 | |
| 9. Light-Absorbers, Filter Dyes and UV-Ray Absorbers | Pages 25 to 26 | Page 649, right column to page 650, left column |
| 10. Stain Inhibitor | Page 25, right column | Page 650, left column to right column |
| 11. Dye Image Stabilizing Agents | Page 25 | |
| 12. Hardeners | Page 26 | Page 651, left column |
| 13. Binders | Page 26 | Page 651, left column |
| 14. Plasticizers and Lubricants | Page 27 | Page 650, right column |
| 15. Coating Aids and Surface Active Agents | Pages 26 to 27 | Page 650, right column |
| 16. Antistatic Agents | Page 27 | Page 650, |

-continued

| Kind of Additives | RD 17643 | RD 18716 |
|---|---|---|
| | | right column |

In the direct positive photographic materials to be used in this invention, the foregoing nucleating agents of the formula (N-I) can be used together with the nucleating agents represented by the following general formula (N-II). In this case, it is preferred for the nucleating agent of the formula (N-I) to be used in a proportion of 50 wt % or more, preferably 70 wt % or more, of the total amount of nucleating agent.

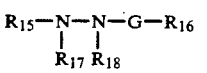

(N-II)

In the above formula (N-II), $R_{15}$ represents an aliphatic hydrocarbon residue, an aromatic hydrocarbon residue or a heterocyclic group; $R_{16}$ represents a hydrogen atom, an alkyl group, an aralkyl group, an aryl group, an alkoxy group, an aryloxy group, oran amino group: G represents a carbonyl group, a sulfonyl group, a sulfoxy group, a phosphoryl group, or an iminomethylene

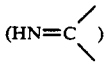

group; $R_{17}$ and $R_{18}$ are both a hydrogen atom, or one of them is a hydrogen atom and the other is an alkylsulfonyl group, an arylsulfonyl group or an acyl group; and wherein G, $R_{16}$, $R_{18}$ and the hydrazine nitrogen together may form a hydrazone structure

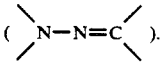

The group set forth above may be substituted, if appropriate.

Specific examples of the foregoing nucleating agent are described below.

| | |
|---|---|
| (N-II-1) | 1-Formyl-2-{4-[3-(2-methoxyphenyl)ureido]-phenyl}-hydrazine |
| (N-II-2) | 1-Formyl-2-{4-[3-{3-[3-(2,4-di-tert-pentyl-phenoxy)propyl]ureido}phenylsulfonylamino]-phenyl}hydrazine |
| (N-II-3) | 1-Formyl-2-{4-[3-(5-mercaptotetrazole-1-yl)-benzamido]phenyl}hydrazine |
| (N-II-4) | 1-Formyl-2-[4-{3-[3-(5-mercaptotetrazole-1-yl)-phenyl]ureido}phenyl]hydrazine |
| (N-II-5) | 1-Formyl-2-[4-{3-[N-(5-mercapto-4-methyl-1,2,4-triazole-3-yl)carbamoyl]propanamido}-phenyl]hydrazine |
| (N-II-6) | 1-Formyl-2-{4-[3-{N-[4-(3-mercapto-1,2,4-triazole-4-yl)phenyl]carbamoyl}propanamido]-phenyl}hydrazine |
| (N-II-7) | 1-Formyl-2-[4-{3-[N-(5-mercapto-1,3,4-thia-diazole-2-yl)carbamoyl]propanamido}phenyl]-hydrazine |
| (N-II-8) | 2-[4-Benzotriazole-5-carboxamido)phenyl]-1-formylhydrazine |
| (N-II-9) | 2-[4-{3-[N-(Benzotriazole-5-carboxamido)-carbamoyl]propanamido}phenyl]-1-formyl-hydrazine |
| (N-II-10) | 1-Formyl-2-{4-[1-(N-phenylcarbamoyl)thiosemi-carbazido]phenyl}hydrazine |

In addition to the foregoing magenta couplers, various color couplers can also be incorporated in the photographic materials to be processed in accordance with this invention. The term color couplers refer to compounds capable of producing dyes by undergoing a coupling reaction with the oxidation products of aromatic primary amine color developing agents. Typical examples of useful color couplers include naphthol or phenol compounds, and open-chain or heterocyclic ketomethylene compounds. Specific examples of these cyan, and yellow couplers which can be used in the present invention are described in *Research Disclosure,* No. 17643, Item VII-D, p.25 (Dec. 1978), and ibid, No. 18717 (Nov. 1979).

It is preferred for the color couplers to be incorporated in the photographic materials to be diffusion resistant and this is achieved by introduction of a ballast group thereinto or assumption of a polymerized form. Also, couplers from which dyes having moderate diffusibility are produced, colorless couplers, DIR couplers capable of releasing a development inhibitor as the coupling reaction progresses, couplers capable of releasing a development accelerator as the coupling reaction pregresses, or colored couplers compensating for unnecessary absorption in a short wavelength region can be employed.

Representative examples of yellow couplers which can be used in this invention are oil-protected acylacetamido type couplers. Specific examples of such couplers are described, e.g., in U.S. Pat. Nos. 2,407,210, 2,875,057 and 3,265,506. In this invention, two-equivalent yellow couplers are preferred. Typical examples of two-equivalent yellow couplers include those of the oxygen atom-splitting-off type, as described, e.g., in U.S. Pat. Nos. 3,408,194, 3,447,928, 3,933,501 and 4,022,620; and those of a nitrogen atom-splitting-off type, as described, e.g., in JP-B-58-10739, U.S. Pat. Nos. 4,401,752 and 4,326,024, *Research Disclosure,* No. 18053 (Apr. 1979), British Patent 1,425,020, and West German Patent Application (OLS) Nos. 2,219,917, 2,261,361, 2,329,587 and 2,433,812. Of these yellow couplers, α-pivaloylacetoanilide couplers are preferred because the dyes produced therefrom have excellent fastness, especially to light, and α-benzoylacetoanilide couplers have the advantage that they ensure high color density in the developed image.

Cyan couplers which can be preferably used in the present invention include oil-protected naphthol type and phenol type couplers. Representative examples of such naphthol couplers are those disclosed in U.S. Pat. No. 2,474,293, more preferably two equivalent naphthol couplers of the oxygen atom-splitting-off type, as disclosed in U.S. Pat. Nos. 4,502,212, 4,146,396, 4,228,233 and 4,296,200. Specific examples of other phenol type couplers are disclosed, e.g., in U.S. Pat. Nos. 2,369,929, 2,801,171, 2,772,162 and 2,895,826. Cyan couplers fast to moisture and heat are preferably employed in this invention. Typical examples of such cyan couplers include phenol type couplers which have an ethyl or higher alkyl group at the meta-position of the phenol nucleus, as disclosed in U.S. Pat. No. 3,772,002; 2,5-diacylamino-substituted phenol type couplers as disclosed, e.g., in U.S. Pat. Nos. 2,772,162, 3,758,308, 4,126,396, 4,334,011 and 4,327,173, West German Patent Application (OLS) No. 3,329,729, and JP-A-59-166956; and phenol type couplers having a phenylureido group at the 2-position and an acylamino group at the 5-position, as disclosed, e.g., in U.S. Pat. Nos. 3,446,622, 4,333,999, 4,451,559 and 4,427,767.

A suitable amount of the color coupler used ranges from 0.001 to 1 mole per mole of light-sensitive silver halide. More specifically, a preferred amount is within the range of 0.01 to 0.5 mole in case of a yellow coupler, 0.003 to 0.3 mole in case of a magenta coupler, and 0.002 to 0.3 mole in case of a cyan coupler.

Couplers to be used in this invention can be incorporated into the photographic materials using various known dispersion methods. Suitable examples of high boiling organic solvents to be used in the oil-in-water dispersion method are described, e.g., in U.S. Pat. No. 2,322,027. As for the steps of a latex dispersion methods, effects obtained, and specific examples of latexes usable as impregnant are described, e.g., in U.S. Pat. No. 4,199,363, West German Patent Application (OLS) Nos. 2,541,274 and 2,541,230.

It is more preferred in this invention that the foregoing direct positive photographic material contain at least one of nucleation accelerators represented by the following general formula (VII) or (VIII):

(VII)

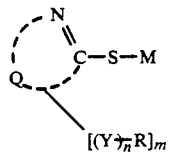

wherein Q represents the atoms necessary to complete a 5- or 6-membered hetero ring, which may be fused together with an aromatic carbon ring or an aromatic hetero ring; Y represents a divalent linking group comprising an atom or atoms selected from hydrogen, carbon, nitrogen, oxygen and sulfur atoms; R represents an organic group containing at least one fragment selected from among a thioether group, an amino group, an ammonium group, an ether group and a heterocyclic group; n represents 0 or 1; m represents 0, 1 or 2; and M represents a hydrogen atom, an alkali metal atom, an ammonio group, or a group dissociable under alkaline conditions.

(VIII)

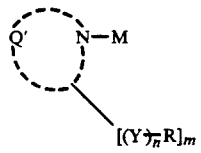

wherein Q' represents the atoms necessary to complete a 5- or 6-membered hetero ring capable of forming iminosilver; Y, R and n have the same meanings as in the foregoing formula (VII), respectively; m represents 1 or 2.

The term "nucleation accelerator" as used herein refers to a material of the kind which, although it cannot function as nucleating agent (the term "nucleating agent" describes a material which acts on an unprefogged internal latent-image type silver halide emulsion in the step of surface development to perform a function so as to form a direct positive image), accelerates the action of a nucleating agent or fogging light to heighten the maximum density of a direct positive image and/or to shorten the development time required for obtaining a definite density of direct positive image.

The nucleation accelerator of the foregoing general formulae (VII) and (VIII) are described below in more detail.

Q in the general formula (VII) is preferably the atoms necessary to complete a 5- or 6-membered hetero ring containing at least one carbon, nitrogen, oxygen, sulfur or selenium atom. Such a hetero ring may be fused together with an aromatic hydrocarbon or an aromtic heterocyclic ring.

Examples of the foregoing hetero ring are tetrazoles, triazoles, imidazoles, thiadiazoles, oxadiazoles, selenadiazoles, oxazoles, thiazoles, benzoxazoles, benzothiazoles, benzimidazoles, pyrimidines, and so on.

M represents a hydrogen atom, an alkali metal atom (e.g., sodium, potassium), an ammonium group (e.g., trimethylammonium, dimethylbenzylammonium), or a group capable of being converted to a hydrogen or alkali metal atom under alkaline conditions (e.g., acetyl, cyanoethyl, methanesulfonylethyl).

The hetero rings cited above may further be substituted with a nitro group, a halogen atom (e.g., chlorine, bromine), a mercapto group, a cyano group, or a substituted or unsubstituted alkyl (e.g., methyl, ethyl, propyl, t-butyl, cyanoethyl), aryl (e.g., phenyl, 4-methanesulfonamidophenyl, 4-methylphenyl, 3,4-dichlorophenyl, naphthyl), alkenyl (e.g., allyl), aralkyl (e.g., benzyl, 4-methylbenzyl, phenethyl), aliphatic or aromatic sulfonyl (e.g., methanesulfonyl, ethanesulfonyl, p-toluenesulfonyl), carbamoyl (e.g., unsubstituted carbamoyl, methylcarbamoyl, phenyl carbamoyl), sulfamoyl (e.g., unsubstituted sulfamoyl, methylsulfamoyl, phenylsulfamoyl), aliphatic or amomatic carbonamido (e.g., acetamido, benzamido), sulfonamido (e.g., methanesulfonamido, benzenesulfonamido, p-toluenesulfonamido), aliphatic or amomatic acyloxy (e.g., acetyloxy, benzolyloxy), aliphatic or amomatic sulfonyloxy (e.g., methanesulfonyloxy), ureido (e.g., unsubstituted ureido, methylureido, ethylureido, phenylureido), thioureido (e.g., unsubstituted thioureido, methylthioureido), aliphatic or amomatic acyl (e.g., acetyl, benzoyl), aliphatic or amomatic oxycarbonyl (e.g., methoxycarbonyl, phenoxycarbonyl) or aliphatic or amomatic oxycarbonylamino group (e.g., methoxycarbonylamino, phenoxycarbonylamino, 2-ethylhexyloxycarbonylamino); or a carboxyl group or a salt thereof, a sulfo group or a salt thereof, or a hydroxyl group. However, hetero rings which are not substituted by carboxyl group or a salt thereof, sulfo group or a salt thereof, or hydroxyl group are preferred from the standpoint of the nucleation accelerating effect.

Hetero rings suitable for Q are tetrazoles, triazoles, imidazoles, thiadiazoles, and oxadiazoles.

Y represents a divalent linking group formed of an atom or atoms selected from hydrogen, carbon, nitrogen, oxygen and sulfur atoms. Specific examples of divalent linking groups as described above include $$-S-,\ -O-,\ -\underset{\underset{R_1}{|}}{N}-,\ -\overset{\overset{O}{\|}}{C}O-,\ -O\overset{\overset{O}{\|}}{C}-,\ -\overset{\overset{O}{\|}}{C}-\underset{\underset{R_2}{|}}{N}-,$$

-continued

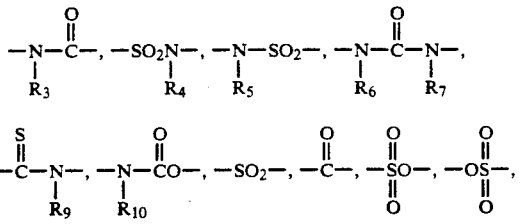

and so on.

These linking groups may be attached to the foregoing hetero rings via a straight- or branched-chain alkylene group (e.g., methylene, ethylene, propylene, butylene, hexylene, 1-methylethylene), or a substituted or unsubstituted arylene group (e.g., phenylene, naphthylene).

$R_1$, $R_2$, $R_3$, $R_4$, $R_5$, $R_6$, $R_7$, $R_8$, $R_9$ and $R_{10}$ each represent a hydrogen atom, or a substituted or unsubstituted alkyl ($C_{1-20}$; e.g., methyl, ethyl, propyl, n-butyl), aryl ($C_{6-20}$; e.g., phenyl 2-methylphenyl), alkenyl ($C_{2-20}$; e.g., propenyl, 1-methylvinyl) or aralkyl ($C_{6-20}$; e.g., benzyl, phenethyl) group.

R represents an organic group containing at least one fragment selected from a thioether group, an amino group (including salts thereof), an ammonium group, an ether group and a heterocyclic group (including salts thereof). R preferably contains from 1 to 20 carbon atoms. Examples of organic groups as described above include those formed by uniting any of the foregoing fragments with group(s) selected from substituted or unsubstituted alkyl, alkenyl, aralkyl and aryl groups. Also, these united groups may form a combination of two or more thereof. Specific examples of groups as described above include a dimethylaminoethyl group, an aminoethyl group, a diethylaminoethyl group, a dibutylaminoethyl group, a hydrochloride of a dimethylaminopropyl group, a hydrochloride of a dimethylaminohexyl group, a dimethylaminoethylthioethyl group, a 4-dimethylaminophenyl group, a 4-dimethylaminobenzyl group, a methylthioethyl group, an ethylthiopropyl group, a 4-methylthio-3-cyanophenyl group, methylthiomethyl group, a trimethylammoniumethyl group, a methoxyethyl group, a methoxyethoxyethoxyethyl group, a methoxyethoxylthioethyl group, a 3,4-dimethoxyphenyl group, a 3-chloro-4-methoxyphenyl group, a morpholinoethyl group, a 1-imidazolylethyl group, a morpholinoethylthioethyl group, a pyrrolidinoethyl group, a piperidinopropyl group, a 2-pyridylmethyl group, a 2-(1-imidazolyl)ethylthioethyl group, pyrazolylethyl group, a triazolylethyl group, a methoxyethoxyethoxyethoxycarbonylaminoethyl, and so on.

n represents 0 or 1, and m represents 0, 1 or 2.

Y, R, n and M in the general formula (VIII) have the same meanings as those in the general formula (VII), but m represents 1 or 2. Q' represents the atoms necessary to complete a 5- or 6-membered hetero ring capable of forming iminosilver. The atoms of such a hetero ring are preferably selected from carbon, nitrogen, oxygen, sulfur and selenium atoms. The resulting hetero ring may be fused together with an aromatic hydrocarbon or heterocyclic ring. Examples of the hetero ring completed by Q' are benzimidazoles, benzotriazoles, benzoxazoles, benzothiazoles, imidazoles, thiazoles, oxazoles, triazoles, tetrazoles, tetraazaindenes, triazaindenes, diazaindenes, pyrazoles, indoles and so on.

Of the compounds represented by the foregoing general formula (VII), those represented by the following general formulae (VII-1), (VII-2), (VII-3) and (VII-4) are preferred:

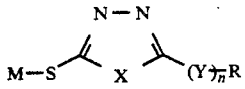

(VII-1)

(wherein M, R, Y and n have the same meaning as those in the general formula (VII); and X represents an oxygen, sulfur or selenium atom, preferably a sulfur atom)

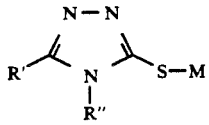

(VII-2)

wherein R' represents a hydrogen atom, a halogen atom (e.g., chlorine, bromine), a nitro group, a mercapto group, an unsubstituted amino group, a substituted or unsubstituted alkyl (e.g., methyl, ethyl), alkenyl (e.g., propenyl, 1-methylvinyl), aralkyl (e.g., benzyl, phenethyl) or aryl (e.g., phenyl, 2-methylphenyl) group, or $-Y\rangle_n R$; R" represents a hydrogen atom, unsubstituted amino, or $-Y\rangle_n R$; when both R' and R" represent $-Y\rangle_n R$, they may be the same or different; but where at least either R' or R" must represent $-Y\rangle_n R$; M, R, Y and n have the same meanings as in the foregoing general formula (VII), respectively.

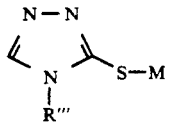

(VII-3)

wherein R''' represents $-Y\rangle_n R$; and M, R, Y and n have the same meanings as in the foregoing general formula (VII), respectively.

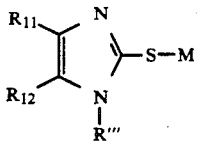

(VII-4)

wherein $R_{11}$ and $R_{12}$ each represent a hydrogen atom, a halogen atom, a substituted or unsubstituted amino group, a nitro group, or a substituted or unsubstituted alkyl, alkenyl, aralkyl or aryl group; and M and R''' have the same meanings as those in the foregoing general formula (VII-3), respectively.

Specific examples of the compounds represented by the general formulae (VII-1) to (VII-4) and (VIII) are illustrated below. However, the invention should not be construed as being limited to these example.

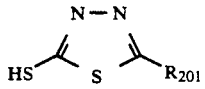

-continued

| No. | $R_{201}$ |
|---|---|
| A-1. | $-SCH_3$ |
| A-2. | $-S(CH_2)_3N(CH_3)_2.HCl$ |
| A-3. | 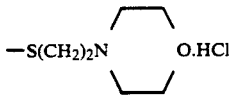 |
| A-4. | $-S(CH_2)_2OCH_3$ |
| A-5. | $-SCH_2SCH_3$ |
| A-6. | $-S(CH_2)_6N(CH_3)_2.HCl$ |
| A-7. | $-S(CH_2)_6N(C_2H_5)_2.HCl$ |
| A-8. | $-S(CH_2)_2S(CH_2)_2N(CH_3)_2.HCl$ |
| A-9. | 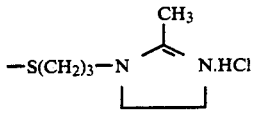 |
| A-10. | $-S(CH_2)_2\overset{\oplus}{N}(CH_3)_3.Cl^{\ominus}$ |
| A-11. | $-S(CH_2)_2NHCH_3.HCl$ |

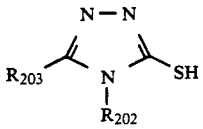

| No. | $R_{202}$ | $R_{203}$ |
|---|---|---|
| A-12. | 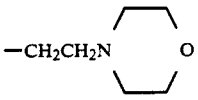 | H |
| A-13. | $-CH_3$ | H |
| A-14. | 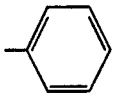 | H |
| A-15. | $-CH_2CH_2N(C_2H_5)_2$ | H |
| A-16. | $-CH_2CH_2N(CH_3)_2$ | H |
| A-17. | $-CH_3$ | $CH_3OCH_2$ |
| A-18. | 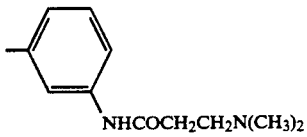 | H |
| A-19. | 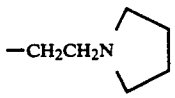 | H |
| A-20. | 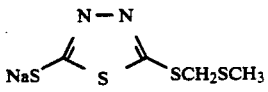 | |
| A-21. | 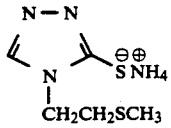 | |

-continued

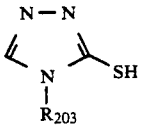

| No. | $R_{203}$ |
|---|---|
| A-22. | $-(CH_2)_2S(CH_2)_2N(CH_3)_2$ |
| A-23. | $-(CH_2)_2N(C_3H_{7}\text{-}n)_2$ |
| A-24. | $-(CH_2)_3N(CH_3)_2$ |
| A-25. | $-(CH_2)_2\overset{\oplus}{N}(CH_3)_3.Cl^{\ominus}$ |
| A-26. | 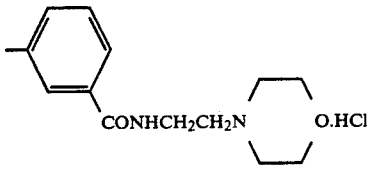 |

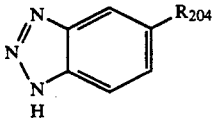

| No. | $R_{204}$ |
|---|---|
| A-27. | $-OCNH(CH_2)_2N(CH_3)_2$ |
| A-28. | $-OCNH(CH_2)_2SCH_3$ |

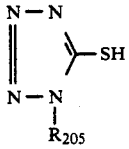

| No. | $R_{205}$ |
|---|---|
| A-29. | $-CH_3$ |
| A-30. | $-(CH_2)_2N(C_3H_{7}\text{-}n)_2$ |
| A-31. | $-(CH_2)_2N(C_2H_5)_2$ |
| A-32. | $-(CH_2)_2O-CH_3$ |
| A-33. | 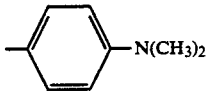 |
| A-34. | 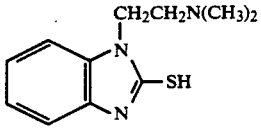 |

In this invention, a nucleation accelerator as illustrated above is incorporated in the photographic material, preferably in internal latent-image type silver halide emulsion layers or other hydrophilic colloid layers (including interlayers and protective layers), and particularly preferably in silver halide emulsion layers or adjacent layers thereto. It is most preferred that the accelarator is incorporated in the layer which contains a nucleation agent.

The nucleation accelerator is employed preferably in an amount of $1\times10^{-6}$ to $1\times10^{-2}$ mole, particularly preferably in an amount of $1\times10^{-5}$ to $1\times10^{-2}$ mol per mol of silver. Two or more of the nucleation accelerators may be used in combination, if desired.

Photographic coating compositions to be used in this invention are coated on a flexible support, such as a conventionally used plastic resin film (e.g., a cellulose nitrate film, a cellulose acetate film, a polyethylene terephthalate film, etc.) or paper, or a rigid support such as glass. Such supports and coating methods are described in detail, e.g., in *Research Disclosure*, vol. 176, No. 17643, Items XV (p.27) and XVII (p. 28) (Dec. 1978).

Light reflecting supports are preferred in this invention.

"Light reflecting supports" have the a function of render dye images formed in the silver halide emulsion layers clear through their high reflectivity, with specific examples including supporting materials coated with a hydrophobic resin in which a light reflecting substance, such as titanium oxide, zinc oxide, calcium carbonate, calcium sulfate, etc., is dispersed, and hydrophobic resin support in which a light reflecting material is present in a dispersed condition. The support as described above is generally provided with a subbing layer. For the purpose of further enhancing the adhesiveness of the support to a photographic layer provided thereon, the support surface may be subjected to a pretreatment, e.g., corona discharge, irradiation with ultraviolet rays, flame treatment, or so on.

The invention is now illustrated in greater detail by reference to the following nonlimiting examples. Unless otherwise indicated herein, all parts, percdents, ratios and the like are by weight.

EXAMPLE 1

The following layers from the first to the fourteenth were coated on the front surface of a paper support (100 microns thick) laminated with a polyethylene film on both sides thereof, and further the fifteenth and the sixteenth layers described below were coated on the back side of this paper support to prepare a multilayer color photographic light-sensitive material. The polyethylene film laminated on the first layer side contained titanium oxide as a white pigment and a trace amount of ultramarine blue as a blue tinting dye (the chromaticities of the support surface of L*, a*, and b* system were 88.0, −0.20 and −0.75, respectively).

The ingredients used and their coverages expressed in terms of g/m$^2$ are described below. However, only the coverage of silver halide is represented on a silver basis. Emulsions used for their respective color-sensitive layers were prepared according to the preparation method for Emulsion EM-1 described hereinafter. However, the emulsion used for the fourteenth layer was a Lippman emulsion whose grain surfaces had not been chemically sensitized.

| | |
|---|---|
| First Layer: Antihalation Layer | |
| Black Colloidal Silver | 0.10 |
| Gelatin | 0.70 |
| Second Layer: Interlayer | |
| Gelatin | 0.70 |
| Third Layer: Slow Red-Sensitive Layer | |
| Silver Bromide (having an average grain size of 0.25 micron, a variation coefficient of 8% in size distribution, and an octahedral crystal form) sensitized spectrally with red sensitizing dyes (ExS-1, ExS-2 and ExS-3) | 0.04 |
| Silver Chlorobromide (having a chloride content of 5 mol %, an average grain size of 0.40 micron, a variation coefficient of 10% in size distribution, and an octahedral crystal form) sensitized spectrally with red sensitizing dyes (ExS-1, ExS-2 and ExS-3) | 0.08 |
| Gelatin | 1.00 |
| Cyan Coupler (equimolar mixture of C-2 and C-23) | 0.30 |
| Discoloration Inhibitor (equimolar mixture of Cpd-1, Cpd-2, Cpd-3 and Cpd-4) | 0.18 |
| Stain Inhibitor (Cpd-5) | 0.003 |
| Coupler Dispersion Medium (Cpd-6) | 0.03 |
| Coupler Solvent (equimolar mixture of Solv-1, Solv-2 and Solv-3) | 0.12 |
| Fourth Layer: High-Speed Red-Sensitive Layer | |
| Silver Bromide (having an average grain size of 0.60 micron, a variation coefficient of 15% in size distribution, and an octahedral crystal form) sensitized spectrally with red sensitizing dyes (ExS-1, ExS-2 and ExS-3) | 0.14 |
| Gelatin | 1.00 |
| Cyan Coupler (equimolar mixture of C-2 and C-23) | 0.30 |
| Discoloration Inhibitor (equimolar mixture of Cpd-1, Cpd-2, Cpd-3 and Cpd-4) | 0.18 |
| Coupler Dispersion Medium (Cpd-6) | 0.03 |
| Coupler Solvent (equimolar mixture of Solv-1, Solv-2 and Solv-3) | 0.12 |
| Fifth Layer: Interlayer | |
| Gelatin | 1.00 |
| Color Stain Inhibitor (Cpd-7) | 0.08 |
| Color Stain Inhibitor Solvent (equimolar mixture of Solv-4 and Solv-5) | 0.16 |
| Polymer Latex (Cpd-8) | 0.10 |
| Sixth layer: Slow Green-Sensitive layer | |
| Silver Bromide (having an average grain size of 0.25 micron, a variation coefficient of 8% in size distribution, and an octahedral crystal form) sensitized spectrally with green sensitizing dye (ExS-4) | 0.04 |
| Silver Chlorobromide (having a chloride content of 5 mol %, an average grain size of 0.40 micron, a variation coefficient of 10% in size distribution, and an octahedral crystal form) sensitized spectrally with green sensitizing dye (ExS-4) | 0.06 |
| Gelatin | 0.80 |
| Magenta Coupler (equimolar mixture of M-12 and M-19) | 0.11 |
| Discoloration Inhibitor (Cpd-9) | 0.10 |
| Stain Inhibitor (10:7:7:1 mixture of Cpd-10, Cpd-11, Cpd-12 and Cpd-13) | 0.025 |
| Coupler Dispersion Medium (Cpd-6) | 0.05 |
| Coupler Solvent (equimolar mixture of Solv-4 and Solv-6) | 0.15 |
| Seventh Layer: High-Speed Green-Sensitive Layer | |
| Silver Bromide (having an average grain size of 0.65 micron, a variation coefficient of 16% in size distribution, and an octahedral crystal form) sensitized with green sensitizing dye (ExS-4) | 0.10 |
| Gelatin | 0.80 |
| Magenta Coupler (equimolar mixture of M-12 and M-19) | 0.11 |
| Discoloration Inhibitor (Cpd-9) | 0.10 |
| Stain Inhibitor (10:7:7:1 mixture of Cpd-10, Cpd-11, Cpd-12 and Cpd-13) | 0.025 |
| Coupler Dispersion Medium (Cpd-6) | 0.05 |
| Coupler Solvent (equimolar mixture of Solv-4 and Solv-6) | 0.15 |
| Eighth Layer: Interlayer | |

-continued

| | |
|---|---|
| The same as the Fifth Layer | |
| Ninth Layer: Yellow Filter Layer | |
| Yellow Colloidal Silver | 0.12 |
| Gelatin | 0.07 |
| Color Stain Inhibitor (Cpd-7) | 0.03 |
| Color Stain Inhibitor Solvent (equimolar mixture of Solv-4 and Solv-5) | 0.10 |
| Polymer Latex (Cpd 8) | 0.07 |
| Tenth Layer: Interlayer | |
| The same as the Fifth Layer | |
| Eleventh Layer: Slow Blue-Sensitive layer | |
| Silver Bromide (having an average grain size of 0.40 micron, a variation coefficient of 8% in size distribution, and an octahedral crystal form) sensitized spectrally with blue sensitizing dyes (ExS-5 and ExS-6) | 0.07 |
| Silver Chlorobromide (having a chloride content of 8 mol %, an average grain size of 0.60 micron, a variation coefficient of 11% in size distribution, and an octahedral crystal form) sensitized spectrally with blue sensitizing dyes (ExS-5 and ExS-6) | 0.14 |
| Gelatin | 0.80 |
| Yellow Coupler (Y-1) | 0.35 |
| Discoloration Inhibitor (Cpd-14) | 0.10 |
| Stain Inhibitor (1:5 mixture of Cpd-5 and Cpd-15) | 0.007 |
| Coupler Dispersion Medium (Cpd-6) | 0.05 |
| Coupler Solvent (Solv-2) | 0.10 |
| Twelfth Layer: High-Speed Blue-Sensitive Layer | |
| Silver Bromide (having an average grain size of 0.85 micron, a variation coefficient of 18% in size distribution, and an octahedral crystal form) sensitized spectrally with blue sensitizing dyes (ExS-5 and ExS-6) | 0.15 |
| Gelatin | 0.60 |
| Yellow Coupler (Y-1) | 0.30 |
| Discoloration Inhibitor (Cpd-14) | 0.10 |
| Stain Inhibitor (1:5 mixture of Cpd-5 and Cpd-15) | 0.007 |
| Coupler Dispersion Medium (Cpd-6) | 0.05 |
| Coupler Solvent (Solv-2) | 0.10 |
| Thirteenth Layer: Ultraviolet Absorbing Layer | |
| Gelatin | 1.00 |
| Ultraviolet Absorbent (equimolar mixture of Cpd-2, Cpd-4, and Cpd-16) | 0.50 |
| Color Stain Inhibitor (equimolar mixture of Cpd-7 and Cpd-17 | 0.03 |
| Dispersion Medium (Cpd-6) | 0.02 |
| Ultraviolet Absorbent Solvent (equimolar mixture of Solv-2 and Solv-7) | 0.08 |
| Irradiation Preventing Dye (10:10:13:15 mixture of Cpd-18, Cpd-19, Cpd-20 and Cpd-21) | 0.04 |
| Fourteenth Layer: Protective layer | |
| Fine-grained Silver Chlorobromide (having a chloride content of 97 mol % and an average grain size of 0.2 micron) | 0.03 |
| Acryl Modified Copolymer of polyvinyl alcohol | 0.01 |

-continued

| | |
|---|---|
| Equimolar Mixture of Polymethylmethacrylate particles (average particle size: 2.4 microns) and Silicon Oxide (average grain size: 5 microns) | 0.05 |
| Gelatin | 1.80 |
| Gelatin Hardener (equimolar mixture of H-1 and H-2) | 0.18 |
| Fifteenth Layer: Backing Layer | |
| Gelatin | 2.50 |
| Sixteenth Layer: Back Protecting Layer | |
| Equimolar Mixture of Polymethylmethacrylate Particles (average particle size: 2.4 microns) and Silicon Oxide (average grain size: 5 microns) | 0.05 |
| Gelatin | 2.00 |
| Gelatin Hardener (equimolar mixture of H-1 and H-2) | 0.14 |

PREPARATION OF EMULSION EM-1

An aqueous solution of silver bromide and an aqueous solution of silver nitrate were simultaneously added at 75° C. over a 15-minute period to an aqueous solution of gelatin with vigorous stirring to produce octahedral silver bromide grains having an average grain size of 0.40 micron. The resulting emulsion was chemically sensitized by adding thereto, in sequence, 3,4-dimethyl 1,3-thiazoline-2-thione, sodium thiosulfate and chloroauric acid (tetrahydrate) in amounts of 0.3 g, 6 mg and 7 mg, respectively, per mole of silver, and then by heating it at 75° C. for 80 minutes. The thus obtained grains were employed as core grains, and thereon silver bromide was further made to grow under the same circumstances as the first precipitation had been performed, resulting in preparation of an octahedral monodisperse core/shell type silver bromide emulsion having a final average grain size of 0.7 micron. The variation coefficient of the grain sizes was about 10%. This emulsion was chemically sensitized by adding thereto 1.5 mg/mol Ag of sodium thiosulfate and 1.5 mg/mol Ag of chloroauric acid (tetrahydrate), and then heating it at 60° C. for 60 minutes to prepare an internal latent-image type silver halide emulsion.

In each light sensitive layer, the nucleating agent (N-I-10) was used in a concentration of $10^{-3}$ wt %. Therein were further used Alkanol XC (Dupont Co.) and sodium alkylbenzenesulfonate as an emulsifying dispersion assistant, and succinic acid ester and Magefac F-120 (Dai-Nippon Ink & Chemicals Inc.) as a coating aid. In the silver halide-containing layers and colloidal silver containing layer, a mixture of Cpd-23, Cpd-24 and Cpd-25 was used as a stabilizer. The thus prepared material was designated Sample 01.

The compounds used in the above layers are illustrated below.

ExS-1

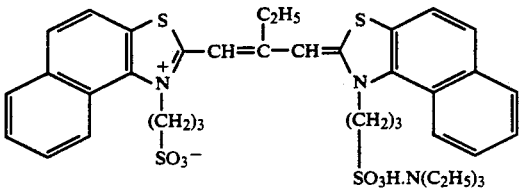

ExS-2

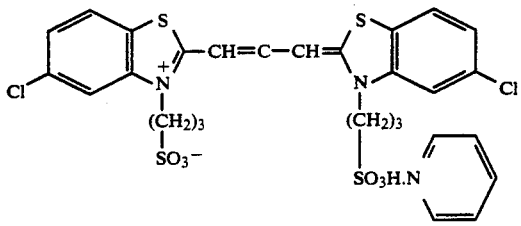

-continued
Ex-S3
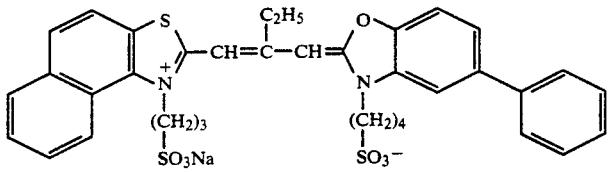
ExX-4
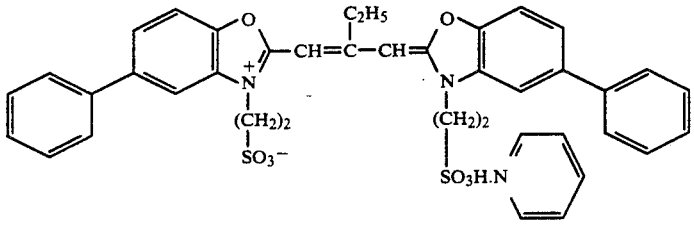
ExS-5
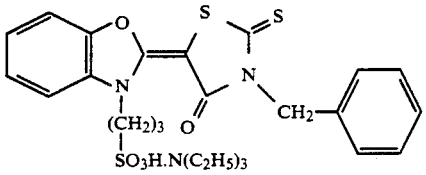
ExS-6
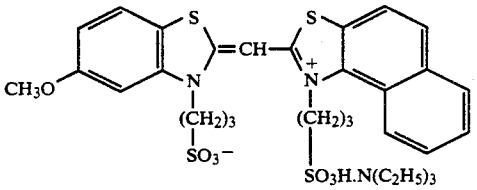
Cpd-1
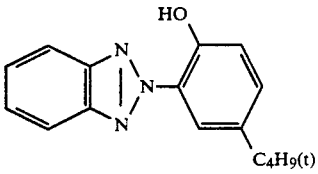
Cpd-2
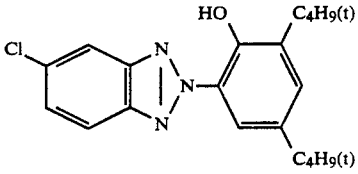
Cpd-3
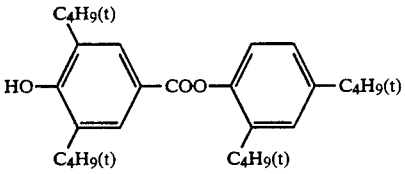
Cpd-4
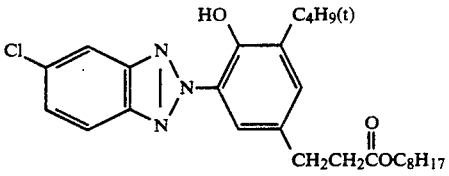
Cpd-5
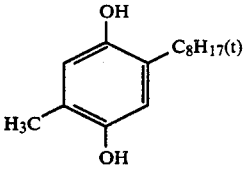
Cpd-6
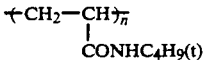
n = 100~1000
Cpd-7
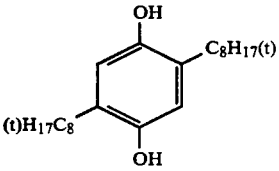
Cpd-8
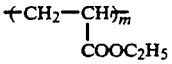
Cpd-9
Cpd-10

-continued
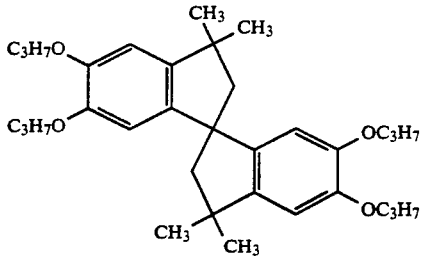
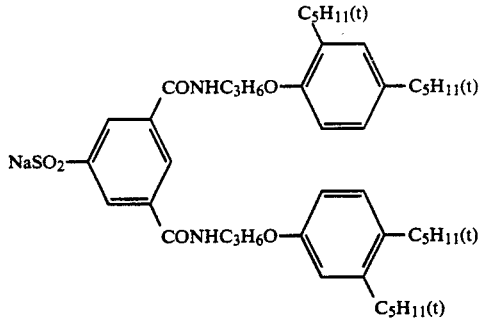
Cpd-11
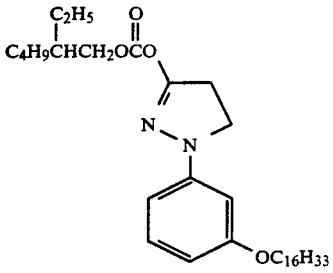
Cpd-12
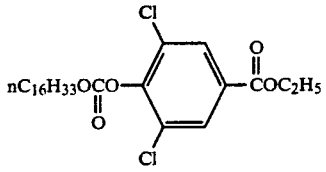
Cpd-13
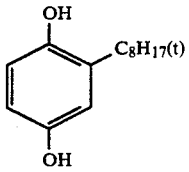
Cpd-14
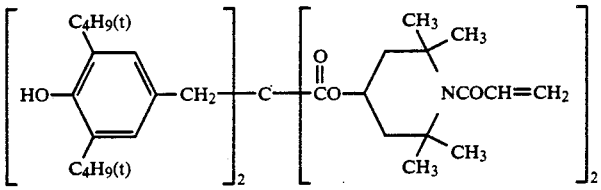
Cpd-15
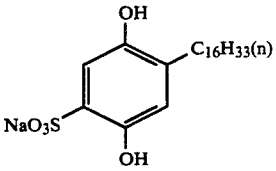
Cpd-16
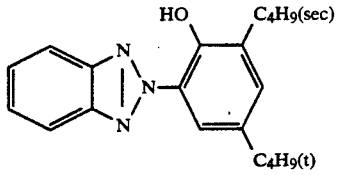
Cpd-17
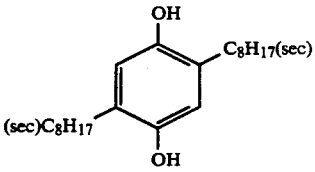
Cpd-18
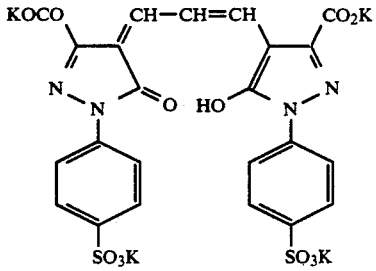
Cpd-19

-continued
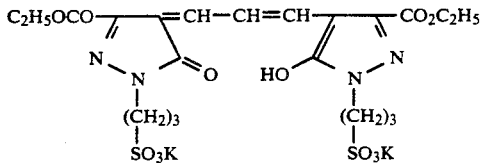
Cpd-20
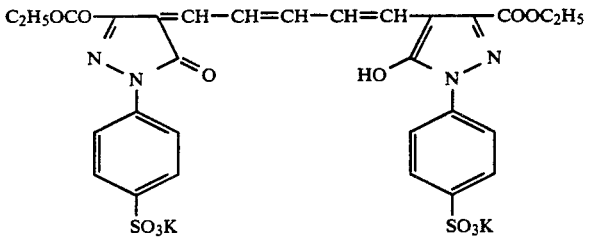
Cpd-21
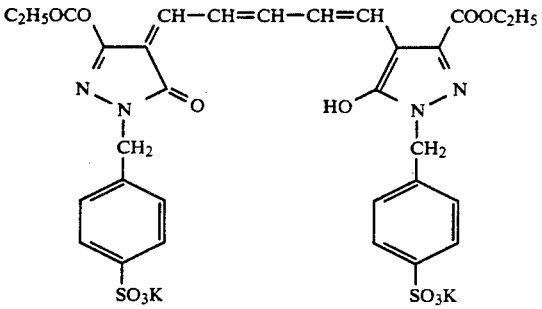
Cpd-23
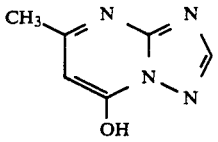
Cpd-24
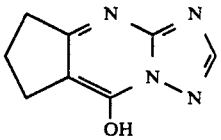
Cpd-25
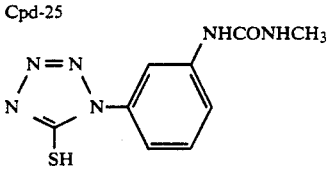
C-2
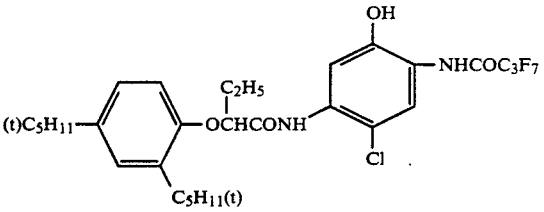
C-23
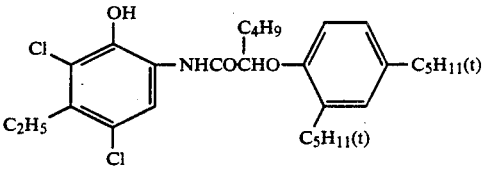
Y-1
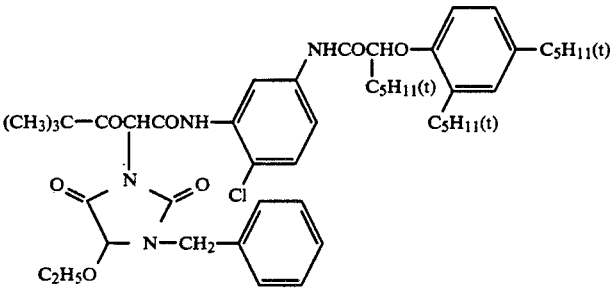
Solv-1 Di(2-ethylhexyl)sebacate
Solv-2 Trinonyl phosphate
Solv-3 Di(3-methylhexyl)phthalate
Solv-4 Tricresyl Phosphate
Solv-5 Dibutyl phthalate
Solv-6 Trioctyl phosphate -continued Solv-7 Di(2-ethylhexyl)phthalate
H-1 1,2-Bis(vinylsulfonylacetamido)ethane
H-2 Sodium salt of 4,6-dichloro-2-hydroxy-1,3,5-triazine A negative type silver halide color photographic material was prepared in the manner described below, which was designated Sample 02.

Initially, a silver halide emulsion (1) for a blue-sensitive silver halide emulsion layer was made as follows:

| | |
|---|---|
| (Solution 1) | |
| $H_2O$ | 1,000 ml |
| NaCl | 8.8 g |
| Gelatin | 25 g |
| (Solution 2) | |
| Sulfuric Acid (1 N) | 20 ml |
| (Solution 3) | |
| Compound having the following chemical structure (1%) | 3 ml |

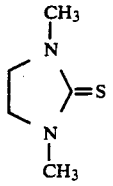

| | |
|---|---|
| (Solution 4) | |
| KBr | 14.01 g |
| NaCl | 1.72 g |
| Water to make | 130 ml |
| (Solution 5) | |
| $AgNO_3$ | 25 g |
| Water to make | 130 ml |
| (Solution 6) | |
| KBr | 56.03 g |
| NaCl | 6.88 g |
| $K_2IrCl_6$ (0.001%) | 1.0 ml |
| Water to make | 285 ml |
| (Solution 7) | |
| $AgNO_3$ | 100 g |
| $NH_4NO_3$(50%) | 2 ml |
| Water to make | 285 ml |

(Solution 1) was heated to 75° C., and thereto were added (Solution 2) and (Solution 3). Thereafter, (Solution 4) and (Solution 5) were simultaneously added over a 40-minute period. After a 10-minute lapse, (Solution 6) and (Solution 7) were further added over a 25-minute period at the same time. Five minutes after the conclusion of the addition, the temperature of the reaction system was lowered, and a desalting treatment was carried out. Then, water and disperse gelatin were added, and the pH of the resulting emulsion was adjusted to 6.2. Thus, a monodisperse cubic silver chlorobromide emulsion (1) having an average grain size of 1.01 μm, a variation coefficient (a value obtained by dividing the standard deviation by the average grain size: s/d) of 0.08 and a bromide content of 80 mol %. This emulsion was chemically sensitized with triethylthiourea to the most appropriate extent.

In addition, a silver halide emulsion (2) for the other blue-sensitive silver halide emulsion layer, silver halide emulsions (3) and (4) for green-sensitive silver halide emulsion layers, and silver halide emulsions (5) and (6) for red-sensitive silver halide emulsion layers were prepared in the same manner as described above, except quantities of the ingredients, reaction temperatures and addition times were changed depending on their respective purposes.

Crystal forms, average grain sizes, halide contents and variation coefficients of the silver halide emulsions (1) to (6) are described below.

| Emulsion No. | Crystal Form | Average Grain Size (μm) | Halogen Content (Br mol %) | Variation Coefficient |
|---|---|---|---|---|
| (1) | cube | 1.01 | 80 | 0.08 |
| (2) | cube | 0.70 | 80 | 0.07 |
| (3) | cube | 0.52 | 80 | 0.08 |
| (4) | cube | 0.40 | 80 | 0.09 |
| (5) | cube | 0.44 | 70 | 0.09 |
| (6) | cube | 0.36 | 70 | 0.08 |

The silver halide emulsions prepared in the foregoing manner were used for the following coating compositions, respectively.

On a paper support laminated with a polyethylene film on both sides thereof, were coated the layers described below in the order listed to prepare a multilayer color photographic material. The coating compositions were prepared in the following manners.

PREPARATION OF COATING COMPOSITION FOR FIRST LAYER

To a mixture of 19.1 g of a yellow coupler (Y-1), 1.91 g of a color image stabilizer (Cpd-1) and 0.46 g of an antifoggant (Cpd-2) were added 27.2 ml of ethyl acetate, 3.8 ml of a solvent (Solv-1) and 3.8 ml of a solvent (Solv-2) to make a solution. The solution was emulsified and dispersed in 185 ml of a 10% aqueous gelatin solution containing 8 ml of a 10% sodium dodecyl benzenesulfonate solution. Separately, the silver halide emulsion (1) and the silver halide emulsion (2) were mixed in a ratio of 6:4, and thereto was added a blue sensitizing dye illustrated below in an amount of $5.0\times10^{-4}$ mol per mol of silver. The resulting silver halide emulsion and the foregoing emulsified dispersion were mixed and dissolved to prepare the coating composition for the first layer having the composition described below.

Coating compositions for the second to the seventh layers were prepared in the same manner as that for the first layer. In each layer, the sodium salt of 1-oxy-3,5-dichloro-s-triazine was present as gelatin hardener.

Spectral sensitizing dyes used in the foregoing layers, respectively, are illustrated below.

Blue-Sensitive Emulsion Layer:

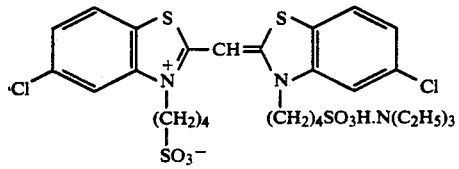

($5.0\times10^{-4}$ mol per mol of silver halide)

Green-Sensitive Emulsion Layer:

-continued

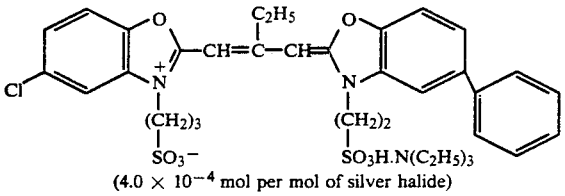

(4.0 × $10^{-4}$ mol per mol of silver halide)

and

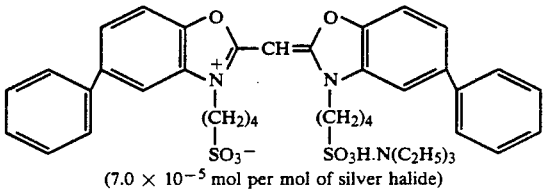

(7.0 × $10^{-5}$ mol per mol of silver halide)

Red-Sensitive Emulsion Layer:

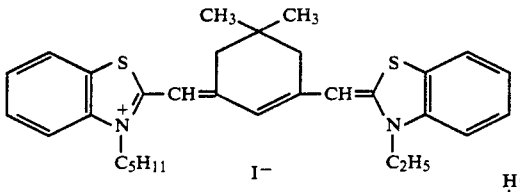

(0.9 × $10^{-4}$ mol per mol of silver halide)

In the red-sensitive emulsion layer, the following compound were further incorporated in an amount of $2.6\times10^{-3}$ mol per mol of silver halide.

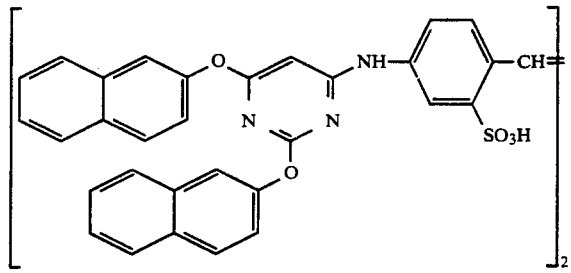

To the blue-sensitive emulsion layer and the green-sensitive emulsion layer, 4-hydroxy-6-methyl-1,3,3a,7-tetraazaindene was added in amounts of $1.2\times10^{-2}$ mol and $1.1\times10^{-2}$ mol, respectively, per mol of silver halide.

Furthermore, 1-(5-methylureidophenyl)-5-mercaptotetrazole was added to the green-sensitive emulsion layer in an amount of $1.0\times10^{-3}$ mol per mol of silver halide, and 2-amino-5-mercapto-1,3,4-thiadiazole was added to the red-sensitive emulsion layer in an amount of $3.0\times10^{-4}$ mol per mol of silver halide.

Moreover, the dyes illustrated below were used as an irradiation preventing dye:

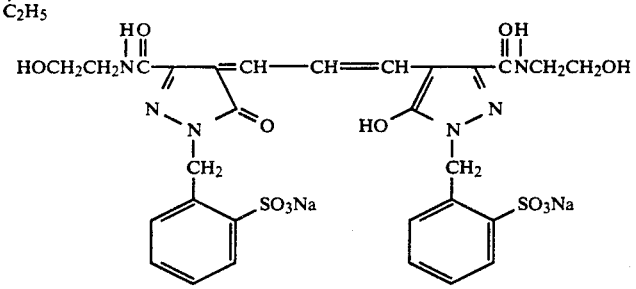

and

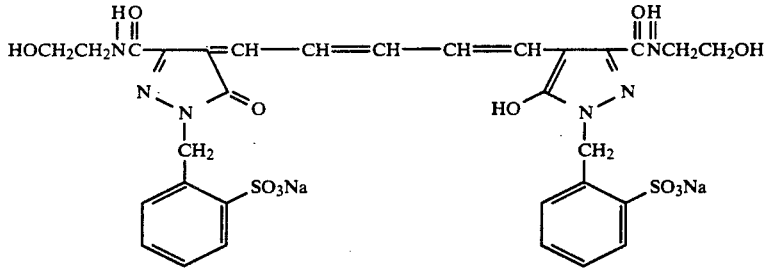

The composition of each layer is described below. The numerals therein are the coverages amounts of the ingredients (g/m²). Making additional remark, only the coverage of silver halide is expressed on a silver basis.

| Layer Construction: | |
|---|---|
| Support | |
| Paper support laminated with polyethylene on both sides (containing a white pigment ($TiO_2$) and a bluish dye (ultramarine dye) on the first layer side). | |
| First Layer: Blue-Sensitive Layer | |
| Silver Halide Emulsions (1) and (2) | 0.26 |
| Gelatin | 1.20 |
| Yellow Coupler (Y-1) | 0.66 |
| Color Image Stabilizer (Cpd-1) | 0.07 |
| Antifoggant (Cpd-2) | 0.02 |
| Solvent (Solv-1) | 0.13 |
| Solvent (Solv-2) | 0.13 |

-continued

| | |
|---|---|
| Second Layer: Color Stain Inhibiting Layer | |
| Gelatin | 1.34 |
| Color Stain Inhibitor (Cpd-3) | 0.04 |
| Solvent (Solv-3) | 0.10 |
| Solvent (Solv-4) | 0.10 |
| Third Layer: Green-Sensitive Layer | |
| Silver Halide Emulsions (3) and (4) | 0.14 |
| Gelatin | 1.30 |
| Magenta Coupler (M-15) | 0.27 |
| Color Image Stabilizer (Cpd-5) | 0.16 |
| Stain Inhibitor (Cpd-11) | 0.025 |
| Stain Inhibitor (Cpd-12) | 0.03 |
| Solvent (Solv-3) | 0.21 |
| Solvent (Solv-5) | 0.33 |
| Fourth Layer: Ultraviolet Absorbing Layer | |
| Gelatin | 1.44 |
| Ultraviolet Absorbent (UV-1) | 0.53 |
| Color Stain Inhibitor (Cpd-2) | 0.05 |
| Solvent (Solv-2) | 0.26 |
| Fifth Layer: Red-Sensitive Layer | |
| Silver Halide Emulsions (5) and (6) | 0.20 |
| Gelatin | 0.89 |
| Cyan Coupler (C-25) | 0.13 |
| Cyan Coupler (C-23) | 0.16 |
| Color Image Stabilizer (Cpd-1) | 0.27 |
| Color Image Stabilizer (Cpd-7) | 0.07 |
| Antifoggant (Cpd-2) | 0.01 |
| Solvent (Solv-1) | 0.19 |
| Sixth Layer: Ultraviolet Absorbing Layer | |
| Gelatin | 0.47 |
| Ultraviolet Absorbent (UV-1) | 0.17 |
| Solvent (Solv-2) | 0.08 |
| Seventh Layer: Protective Layer | |
| Gelatin | 1.25 |
| Acryl Modified Copolymer of Polyvinyl Alcohol (modification degree: 17%) | 0.05 |
| Liquid Paraffin | 0.02 |

(Cpd-1) Color Image Stabilizer $$\left(CH_2-\underset{\underset{CONHC_4H_9(t)}{|}}{CH}\right)_n$$

mean molecular weight: 60,000

(Cpd-2) Antifoggant

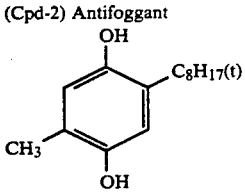

(Cpd-3) Color Stain Inhibitor

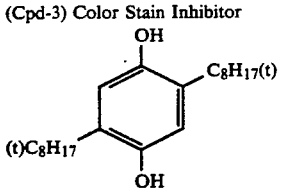

(Cpd-4) Color Image Stabilizer

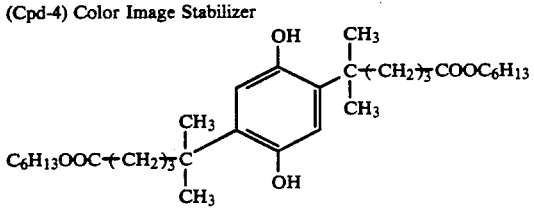

(Cpd-5) Color Image Stabilizer

-continued

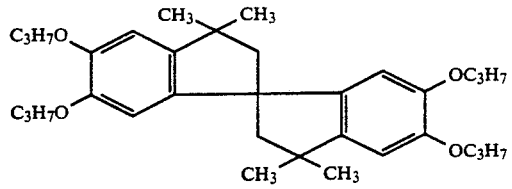

(Cpd-11) Stain Inhibitor

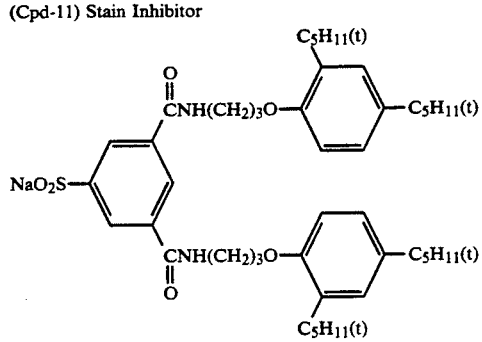

(Cpd-12) Stain Inhibitor

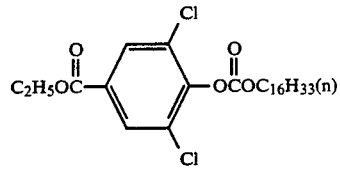

(Cpd-7) Color Image Stabilizer
4:2:5 (by weight) Mixture of

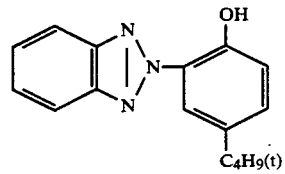

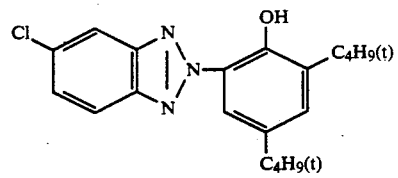

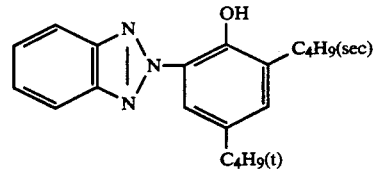

(UV-1) Ultraviolet Absorbent
12:10:3 (by weight) Mixture of

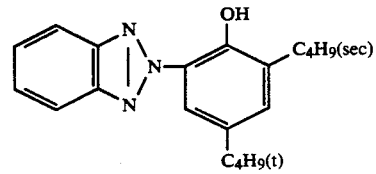

-continued

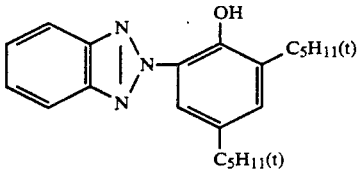

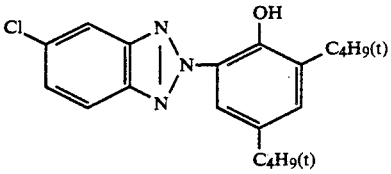

(Solv-1) Solvent $C_8H_{17}-CH(O)CH-(CH_2)_7COOC_8H_{17}$ (Solv-2) Solvent $O=P(-O-C_9H_{19}\text{-iso})_3$ (Solv-3) Solvent

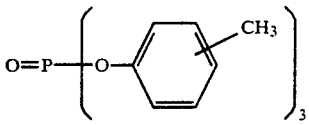

(Solv-4) Solvent

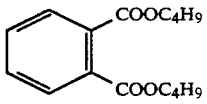

(Solv-5) Solvent

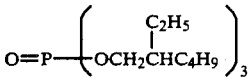

The thus prepared Sample 01 as an internal latent-image type direct positive silver halide color photographic material and the thus prepared Sample 02 as a negative type silver halide color photographic material were processed with the following processes.

(A) Firstly, Sample 01 (an internal latent-image type direct positive silver halide color photographic material) was exposed imagewise, and continuously processed until the accumulated amount of each replenisher came to three times the volume of the corresponding processing tank. Secondly, both Sample 01 and Sample 02 (a negative type silver halide color photographic material) were exposed to light through an R-G-B separation filter fixed to the front of a wedge, and then processed.

Processing Method A (B) After the color developer in the developing tank (the composition of which is described below) was renewed, Sample 02 was exposed imagewise, and continuously processed until the accumulated amount of each replenisher came to three times the volume of the corresponding processing tank. Then, in the same way as the foregoing (A), both Sample 01 and Sample 02 were exposed to light through an R-G-B separation filter fixed to the front of a wedge, and thereafter processed.

Processing Method B (C) After the color developer in the developing tank (the composition of which is described below) was renewed again, both Sample 01 and Sample 02 were exposed imagewise, and then processed alternately in succession by the same area until the accumulated amount of each replenisher came to three times the volume of the corresponding processing tank. Thereafter, in the same manner as the foregoing (A) and (B), both Sample 01 and Sample 02 were exposed to light through an R-G-B separation filter fitted in front of a wedge, and then processed.

Processing Method C

| Processing Step | Time | Temperature | Tank Volume of Mother Liquor | Amount Replenished |
|---|---|---|---|---|
| Color Development | 135 sec. | 38° C. | 15 l | 300 ml/m² |
| Bleach-Fix | 40 sec. | 33° C. | 3 l | 300 ml/m² |
| Washing (1) | 40 sec. | 33° C. | 3 l | — |
| Washing (2) | 40 sec. | 33° C. | 3 l | 320 ml/m² |
| Drying | 30 sec. | 80° C. | | |

The replenishment of the washing water was performed in accordance with the so-called counter current replenishing process, wherein the washing bath (2) was replenished with washing solution, and the solution overflowing the washing bath (2) was introduced into the washing bath (1). Therein, the amount of the bleach-fix solution brought over by the photographic materials from the bleach-fix bath into the washing bath (1) was 35 ml/m². Accordingly, the replenishing factor was 9.1.

The composition of each processing solution used was as follows:

| Color Developer | Mother Liquor | Replenisher |
|---|---|---|
| Ethylenediaminetetrakis-methylenephosphonic Acid | 1.5 g | 1.5 g |
| Diethylene Glycol | 10 ml | 10 ml |
| Benzyl Alcohol | 12.0 ml | 14.4 ml |
| Potassium Bromide | See Table 1 | |
| Sodium Sulfite | 2.4 g | 2.9 g |
| Compound (III-3) | 4.0 g | 4.8 g |
| Triethanolamine | 6.0 g | 7.2 g |
| N-Ethyl-N-(β-methanesulfonamido-ethyl)-3-methyl-4-aminoaniline Sulfate | 6.0 g | 7.2 g |
| Potassium Carbonate | 30.0 g | 25.0 g |
| Brightening Aagent (of diaminostilbene type) | 1.0 g | 1.2 g |
| Water to make | 1000 ml | 1000 ml |
| pH (25° C.) | 10.20 | 11.00 |

| Bleach-Fix Bath | Mother Liquor = Replenisher |
|---|---|
| Disodium Ethylenediaminetetra-acetate Dihydrate | 4.0 g |
| Ammonium Ethylenediaminetetra acetatoferrate (III) Dihydrate | 70.0 g |
| Ammonium Thiosulfate*(700 g/l) | 180 ml |
| Sodium p-Toluenesulfinate | 20.0 g |
| Sodium Bisulfite | 20.0 g |
| 2-Amino-5-mercapto-1,3,4- | 0.6 g |

-continued

| | |
|---|---|
| thiadiazole | |
| Ammonium Nitrate | 10.0 g |
| Water to make | 1000 ml |
| pH (25° C.) | 6.20 |

Washing Solution (Common Between the Mother Liquor and the Replenisher)

City water was purified by passing it through a column of mixed-bed system packed with a strongly acidic H-type cation exchange resin (Amberlite IR-120 B, produced by Rhom & Haas, Co.) and an OH-type anion exchange resin (Amberlite IR-400, produced by Rhom & Haas, Co.) until the calcium and magnesium ion concentrations were each reduced to 3 mg/l or less, and then adding thereto 20 mg/l of sodium dichloroisocyanurate and 1.5 g/l of sodium sulfate. The pH of the resulting water solution was in the range of 6.5 to 7.5.

In accordance with each of the above-described three processing methods, color development was performed using color developers differing in potassium bromide concentration. The color densities of the thus developed images were measured. The photographic properties thus attained were evaluated by the maximum magenta-image density reached (Dmax) and the minimum density (Dmin) in the white areas. The results are shown in Table 1.

TABLE 1

| | | Amount of KBr added to Color Developer (g ion/l) | | | | | | Remark |
|---|---|---|---|---|---|---|---|---|
| | Mother Liquor | $5 \times 10^{-3}$ | $8.4 \times 10^{-3}$ | $2.1 \times 10^{-2}$ | $2.5 \times 10^{-2}$ | $2.9 \times 10^{-2}$ | $4.2 \times 10^{-2}$ | Pretreatment |
| | Replenisher | 0 | $3.4 \times 10^{-3}$ | $1.6 \times 10^{-2}$ | $2.0 \times 10^{-2}$ | $2.4 \times 10^{-2}$ | $3.7 \times 10^{-2}$ | |
| Sample No. | CD-No. | (CD-1) | (CD-2) | (CD-3) | (CD-4) | (CD-5) | (CD-6) | |
| Sample 01 (direct positive) | Dmax | 2.64 | 2.64 | 2.64 | 2.64 | 2.62 | 2.56 | Processing Method A for comparison |
| | Dmin | 0.09 | 0.09 | 0.09 | 0.09 | 0.09 | 0.09 | |
| Sample 02 (negative) | Dmax | 2.56 | 2.56 | 2.55 | 2.54 | 2.50 | 2.42 | |
| | Dmin | 0.14 | 0.14 | 0.13 | 0.13 | 0.13 | 0.13 | |
| Sample 01 | Dmax | 2.60 | 2.60 | 2.59 | 2.58 | 2.55 | 2.48 | Processing Method B for comparison |
| | Dmin | 0.09 | 0.09 | 0.09 | 0.09 | 0.09 | 0.09 | |
| Sample 02 | Dmax | 2.62 | 2.62 | 2.62 | 2.62 | 2.60 | 2.55 | |
| | Dmin | 0.09 | 0.09 | 0.09 | 0.09 | 0.09 | 0.10 | |
| Sample 01 | Dmax | 2.64 | 2.64 | 2.64 | 2.64 | 2.61 | 2.54 | Processing Method C according to invention |
| | Dmin | 0.09 | 0.09 | 0.09 | 0.09 | 0.09 | 0.09 | |
| Sample 02 | Dmax | 2.63 | 2.62 | 2.62 | 2.61 | 2.57 | 2.50 | |
| | Dmin | 0.09 | 0.09 | 0.09 | 0.09 | 0.09 | 0.09 | |

As can be seen from the data in Table 1, in Processing Method A (wherein only Sample 01 as an internal latent-image type direct positive silver halide color photographic material was continuously processed until the accumulated amount of each replenisher used came to three times the volume of the corresponding processing tank, and thereafter both Sample 01 and Sample 02 (as a negative type silver halide color photographic material) were processed), Sample 01 caused nothing but a lowering of the Dmax when a KBr concentration was increased to $2.9 \times 10^{-2}$ g ion/l or more, while the Dmax values attained by Sample 02 were low as a whole, compared with those in other processings, and a tendency for the Dmax of Sample 02 to be lower was observed in KBr concentrations higher than $2.5 \times 10^{-2}$ g ion/l.

On the other hand, in Processing Method B (wherein only Sample 02 as a negative type silver halide color photographic material was continuously processed until the accumulated amount of each replenisher used came to three times the volume of the corresponding processing tank, and thereafter both Sample 01 and Sample 02 were processed, the Dmax values attained by Sample 01, on the contrary, were low as a whole, and there was a tendency for the Dmax of Sample 01 to be lower in KBr concentrations higher than $2.9 \times 10^{-2}$ g ion/l, while Sample 02 merely caused a lowering of the Dmax in KBr concentrations higher than $2.9 \times 10^{-2}$ g ion/l.

EXAMPLE 2

The same internal latent-image type direct positive silver halide color photographic material as described in Example 1 (Sample 01) and the same negative type silver halide color photographic material as described in Example 1 (Sample 02) were processed in the same manner as in Example 1, except a color developer having the following composition was used, and the pretreatment was changed to those shown in Table 2.

| Color Developer | Mother Liquor | Replenisher |
|---|---|---|
| Ethylenediaminetetrakis-methylenephosphonic acid | 1.5 g | 1.5 g |
| Diethylene Glycol | 10 ml | 10 ml |
| Benzyl Alcohol | 12.0 ml | 14.4 ml |
| Potassium Bromide | 1.60 g | 1.0 g |
| Sodium Sulfite | 2.4 g | 2.9 g |
| Compound (III-3) | 4.0 g | 4.8 g |
| Triethanolamine | 6.0 g | 7.2 g |
| N-Ethyl-N-(β-methanesulfonamido-ethyl)-3-methyl-4-aminoaniline Sulfate | 6.0 g | 7.2 g |
| Potassium Carbonate | 30.0 g | 25.0 g |
| Brightening Agent (of diaminostilbene type) | 1.0 g | 1.2 g |
| Water to make | 1000 ml | 1000 ml |
| pH (25° C.) | 10.20 | 10.80 |

TABLE 2

| Processing Method | Sample 01 (%) | Sample 02 (%) |
|---|---|---|
| D | 100 | 0 |
| E | 90 | 10 |
| F | 80 | 20 |
| G | 50 | 50 |
| H | 20 | 80 |
| I | 10 | 90 |
| J | 0 | 100 |

In Method E, for instance, the pretreatment, or the processing to be continued until the accumulated amount of the replenisher was three time the tank volume, was carried out as follows: When the imagewise exposed Sample 01 and Sample 02 were processed in a random order, the ratio between the continuously processed area of Sample 01 and that of Sample 02 was controlled to 90:10 (by percentage), as shown in Table 2, and the replenisher was added.

Sample 01 and Sample 02 were exposed to light through three color separation filters, and then processed with each of the thus pretreated color developers to obtain color images to be used for evaluation of photographic properties.

The evaluation was made using the Dmax and Dmin values of the magenta color images obtained, and the results thereof are shown in Table 3.

TABLE 3

| Processing Method (%) | Ratio Between Samples Used for Pretreatment: Sample 01 (%) | Sample 02 | Sample 01 Δ DMax* | Sample 01 Δ Dmin* | Sample 02 Δ Dmax* | Sample 02 Δ Dmin* |
|---|---|---|---|---|---|---|
| D | 100 | 0 | 0 | 0 | −0.07 | +0.05 |
| E | 90 | 10 | 0 | 0 | −0.03 | +0.01 |
| F | 80 | 20 | 0 | 0 | −0.01 | 0 |
| G | 50 | 50 | 0 | 0 | 0 | 0 |
| H | 20 | 80 | −0.01 | 0 | 0 | 0 |
| I | 10 | 90 | −0.02 | 0 | 0 | 0 |
| J | 0 | 100 | −0.05 | 0 | 0 | 0 |

*Dmax and Dmin attained in case of the pretreatment using Sample 01 alone, and those using Sample 02 alone are taken as their respective references, and the differences in these values resulting from the different pretreatments are shown. A plus mark means an increase, while a minus mark a decrease. In Processing Method D, Sample 01 had Dmax of 2.64 and Dmin of 0.09, and in Processing Method J, Sample 02 had Dmax of 2.62 and Dmin of 0.09.

From the data set forth above, it can be said that the processing is feasible in the case of Sample 01 so long as a ratio Sample 01/Sample 02 is above 5/below 95, and it is also feasible in the case of Sample 02 as far as a ratio of Sample 01/Sample 02 is below 95/above 5. It is clear that the processing of internal latent-image type direct positive and negative type silver halide color photographic materials can be effected within the range of ratios from 5/95 to 95/5, preferably from 10/90 to 90/10.

EXAMPLE 3

The same Sample 01 and Sample 02 as described in Example 1 were processed using color developer CD-2 as described in Example 1 under the following conditions:

(1) The mother liquor of color developer itself just prepared.
(2) The color developer used for continuous processing until the accumulated amount of the replenisher became one-half the tank volume.
(3) The color developer used for continuous processing until the accumulated amount of the replenisher became five times the tank volume.
(4) The color developer (3) used again after a 10-day storage in the tank at room temperature.

In accordance with the foregoing examples, Sample 01 and Sample 02 were exposed to light through a wedge to which a three color separation filter was fixed, and then processed, whereby photographic properties were evaluated. In obtaining Color Developers (2) and (3), Sample 01 and Sample 02 were processed alternately by the same area. The evaluation, similar to that in Example 2, was made by the Dmax and the Dmin values of the magenta color images. The results obtained are shown in Table 4.

TABLE 4

| Color Developer Used | Sample 01 (Direct Positive) ΔDmax* | Sample 01 ΔDmin* | Sample 02 (Negative) ΔDmax* | Sample 02 ΔDmin* |
|---|---|---|---|---|
| (1) Mother liquor itself just prepared | 0 | 0 | +0.02 | 0 |
| (2) Replenished in an amount of one-half the tank volume | 0 | 0 | 0 | 0 |
| (3) Replenished in an amount of 5 times the tank volume | 0 | 0 | 0 | 0 |
| (4) Developer (3) stored for 10 days at room temperature | 0 | 0 | 0 | 0 |

*Dmax and Dmin attained using the color developer pretreated in Condition (3) are taken as their respective references for each sample, and the differences in these values resulting from difference in pretreatment condition are shown. A plus mark means an increase. As for the reference values, the Dmax was 2.64 and the Dmin was 0.09 in Sample 01, while the Dmax was 2.62 and the Dmin was 0.09 in Sample 02.

As can be seen from the data set forth above, almost the same photographic properties were achieved whether the color developer used was the mother liquor itself, or one which was in an equilibrium state after the replenishment continued until the accumulated amount of the replenisher used became 5 times the tank volume, or an intermediate between those in the foregoing two extreme states. That is to say, a stable processing independent of fluctuations in processing conditions becomes feasible. It is also apparent that a stable processing becomes feasible even when an aged color developer is used.

EXAMPLE 4

In the color development, color developers having the following composition were used. The developer contained combinations of sodium sulfite with hydrazine or hydroxylamine derivatives set forth in Table 5 were contained as preservative.

| Color Developer | Mother Liquor | Replenisher |
|---|---|---|
| Ethylenediaminetetrakis-methylenephosphonic Acid | 1.5 g | 1.5 g |
| Diethylene Glycol | 10 ml | 10 ml |
| Benzyl Alcohol | 12.0 ml | 14.4 ml |
| Potassium Bromide | 1.60 g | 1.0 g |
| Sodium Sulfite | 0.5 g | 0.9 g |
| Preservative (See Table 5) | $3 \times 10^{-2}$ mol | $3.6 \times 10^{-2}$ mol |
| Triethanolamine | 6.0 g | 7.2 g |
| N-Ethyl-N-(β-methanesulfonamido- | 6.0 g | 7.2 g |

-continued

| Color Developer | Mother Liquor | Replenisher |
|---|---|---|
| ethyl)-3-methyl-4-aminoaniline Sulfate | | |
| Potassium Carbonate | 30.0 g | 25.0 g |
| Brightening Agent (of diaminostilbene) | 1.0 g | 1.2 g |
| Water to make | 1000 ml | 1000 ml |
| pH (25° C.) | 10.50 | 11.00 |

TABLE 5

| Color Developer (CD No.) | Preservative | Amount Added to Color Developer: Mother | Amount Added to Color Developer: Replenisher |
|---|---|---|---|
| CD-7 | III-2 (Invention) | $3 \times 10^{-2}$ mol/l | $3.6 \times 10^{-2}$ mol/l |
| CD-8 | III-4 (Invention) | $3 \times 10^{-2}$ mol/l | $3.6 \times 10^{-2}$ mol/l |
| CD-9 | III-6 (Invention) | $3 \times 10^{-2}$ mol/l | $3.6 \times 10^{-2}$ mol/l |
| CD-10 | III-8 (Invention) | $3 \times 10^{-2}$ mol/l | $3.6 \times 10^{-2}$ mol/l |
| CD-11 | III-10 (Invention) | $3 \times 10^{-2}$ mol/l | $3.6 \times 10^{-2}$ mol/l |
| CD-12 | III-11 (Invention) | $3 \times 10^{-2}$ mol/l | $3.6 \times 10^{-2}$ mol/l |
| CD-13 | III-12 (Invention) | $3 \times 10^{-2}$ mol/l | $3.6 \times 10^{-2}$ mol/l |
| CD-14 | III-16 (Invention) | $3 \times 10^{-2}$ mol/l | $3.6 \times 10^{-2}$ mol/l |
| CD-15 | III-17 (Invention) | $3 \times 10^{-2}$ mol/l | $3.6 \times 10^{-2}$ mol/l |
| CD-16 | III-19 (Invention) | $3 \times 10^{-2}$ mol/l | $3.6 \times 10^{-2}$ mol/l |
| CD-17 | IV-1 (Invention) | $3 \times 10^{-2}$ mol/l | $3.6 \times 10^{-2}$ mol/l |
| CD-18 | IV-4 (Invention) | $3 \times 10^{-2}$ mol/l | $3.6 \times 10^{-2}$ mol/l |
| CD-19 | IV-10 (Invention) | $3 \times 10^{-2}$ mol/l | $3.6 \times 10^{-2}$ mol/l |
| CD-20* | III-3 | $1.5 \times 10^{-2}$ mol/l | $1.8 \times 10^{-2}$ mol/l |
| | IV-10 (Invention) | $1.5 \times 10^{-2}$ mol/l | $1.8 \times 10^{-2}$ mol/l |
| | III-18 | $1.5 \times 10^{-2}$ mol/l | $1.8 \times 10^{-2}$ mol/l |

TABLE 5-continued

| Color Developer (CD No.) | Preservative | Amount Added to Color Developer: Mother | Amount Added to Color Developer: Replenisher |
|---|---|---|---|
| CD-21 | IV-3 (Invention) | $1.5 \times 10^{-2}$ mol/l | $1.8 \times 10^{-2}$ mol/l |
| | III-19 | $1.5 \times 10^{-2}$ mol/l | $1.8 \times 10^{-2}$ mol/l |
| CD-22 | IV-15 (Invention) | $1.5 \times 10^{-2}$ mol/l | $1.8 \times 10^{-2}$ mol/l |
| CD-23 | Hydroxylamine | $2.0 \times 10^{-2}$ mol/l | $2.4 \times 10^{-2}$ mol/l |
| | Sodium sulfite (Comparison) | $1 \times 10^{-2}$ mol/l | $1.2 \times 10^{-2}$ mol/l |

*From CD-20 to CD-22 triethanolamine was removed.

The same photographic processing as in Example 1, except the compositions of the color developers used were so changed as described above, was carried out. More specifically, after Sample 01 and Sample 02 prepared in Example 1 were exposed imagewise, they were processed alternately by the same area until the accumulated amount of each replenisher became three times the corresponding tank volume. Using the thus pretreated processing solutions, the samples which had been exposed to light through a B-G-R three color separation filter fixed to a wedge were processed. The density measurements of images obtained were carried out, and thereby the photographic properties were evaluated. In Table 6, the Dmax and Dmin values of the magenta colors developed with color developers differing in preservative used are shown.

TABLE 6

| Color Developer CD-No. | Preservative | Sample 01 (Direct Positive) Δ Dmax* | Sample 01 (Direct Positive) Δ Dmin* | Sample 02 (Negative) Δ Dmax* | Sample 02 (Negative) Δ Dmin* |
|---|---|---|---|---|---|
| CD-7 | III-2 (Invention) | 2.65 | 0.09 | 2.64 | 0.09 |
| CD-8 | III-4 (Invention) | 2.65 | 0.09 | 2.65 | 0.09 |
| CD-9 | III-6 (Invention) | 2.65 | 0.09 | 2.65 | 0.09 |
| CD-10 | III-8 (Invention) | 2.64 | 0.09 | 2.65 | 0.09 |
| CD 11 | III-10 (Invention) | 2.64 | 0.09 | 2.64 | 0.09 |
| CD-12 | III-11 (Invention) | 2.65 | 0.09 | 2.65 | 0.09 |
| CD-13 | III-12 (Invention) | 2.63 | 0.09 | 2.64 | 0.09 |
| CD-14 | III-16 (Invention) | 2.64 | 0.09 | 2.63 | 0.09 |
| CD-15 | III-17 (Invention) | 2.64 | 0.09 | 2.65 | 0.09 |
| CD-16 | III-19 (Invention) | 2.65 | 0.09 | 2.65 | 0.09 |
| CD 17 | IV-1 (Invention) | 2.64 | 0.09 | 2.64 | 0.09 |
| CD-18 | IV-4 (Invention) | 2.65 | 0.09 | 2.65 | 0.09 |
| CD-19 | IV-10 (Invention) | 2.65 | 0.09 | 2.65 | 0.09 |
| CD-20 | III-3 (Invention) IV-10 (Invention) | 2.65 | 0.09 | 2.65 | 0.09 |
| CD-21 | III-18 (Invention) IV-3 (Invention) | 2.64 | 0.09 | 2.65 | 0.09 |
| CD-22 | III-19 (Invention) IV-15 (Invention) | 2.64 | 0.09 | 2.64 | 0.09 |
| CD-23 | Hydroxylamine Sodium Sulfite (Comparison) | 2.57 | 0.14 | 2.58 | 0.14 |

As can be seen from the data shown in Table 6, images obtained using the color developers from CD-7 to CD-22, in which the bromide ion concentration was adjusted to 1.6 g/l and the compounds specified by this invention were contained as a preservative, had sufficiently high developed-color densities and low Dmin in the white area, or excellent image quality. On the other hand, the images obtained using the comparative color developer CD-20 had rather low Dmax and high Dmin, and were stained in the white area, that is, inferior in image quality.

EXAMPLE 5

Samples were prepared in the same manner as Sample 01 of Example 1, except the couplers incorporated in the sixth and the seventh layers were replaced by equimolar amounts of the couplers set forth in Table 7.

TABLE 7

| Sample No. | Magenta Coupler in Green-Sensitive Layer (sixth and seventh layers) |
|---|---|
| 03 | M-14 |
| 04 | M-18 |
| 05 | M-11 |
| 06 | M-7 |
| 07 | M-16 |
| 08 | M-15 and M-19 |
| 09 | M-9 |
| 10 | M-15 |
| 11 | Comparative Coupler (A) |

Comparative Coupler (A):

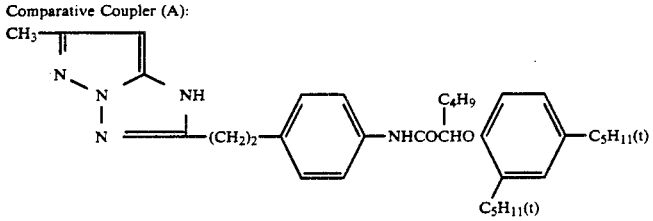

For the purpose of comparison, negative type silver halide color photographic materials were prepared in the same manner as in Example 1. In one of these materials, the couplers used in Sample 01 of the internal latent-image direct positive type, namely C-2 and C-23 as couplers for the red-sensitive layer, M-12 and M-19 as couplers for the green-sensitive layer, and Y-1 as a coupler for the blue-sensitive layer, were incorporated in place of those used in Sample 02 of negative type. The resulting material was designated Sample 12. In a manner similar to the above, the magenta couplers used in the samples of the internal latent-image direct positive type, from Sample 03 to Sample 09, and Sample 11, were used in preparing the other negative type silver halide color photographic materials. The thus prepared samples were designated Samples 13 to 20, respectively.

Samples 03 to 11 and Samples 12 to 20 were each exposed to light, and processed with color developer CD-2, the composition of which is shown in Table 1 of Example 1, in accordance with the Processing Method C described in Example 1. The Dmax and Dmin values of the thus developed magenta color images are shown in Table 8.

TABLE 8

| Sample | | Direct Positive (01, 03-11) | | Negative (02, 12-20) | |
|---|---|---|---|---|---|
| Direct Positive | Negative | Dmax | Dmin | Dmax | Dmin |
| 03 | 13 | 2.66 | 0.09 | 2.65 | 0.09 |
| 04 | 14 | 2.63 | 0.09 | 2.63 | 0.09 |
| 05 | 15 | 2.29 | 0.09 | 2.29 | 0.09 |
| 06 | 16 | 2.57 | 0.10 | 2.58 | 0.10 |
| 07 | 17 | 2.42 | 0.09 | 2.41 | 0.09 |
| 08 | 18 | 2.63 | 0.09 | 2.64 | 0.09 |
| 09 | 19 | 2.48 | 0.09 | 2.47 | 0.09 |
| 10 | (02) | 2.64 | 0.09 | 2.64 | 0.09 |
| (01) | 12 | 2.64 | 0.09 | 2.64 | 0.09 |
| 11 | 20 | 2.18 | 0.09 | 1.85 | 0.09 |

As can be seen from the data shown in Table 8, the magenta couplers of this invention, differing from the comparative coupler, manifested sufficient color developability even when used as color image-forming couplers of internal latent-image type direct positive silver halide color photographic materials, and subjected to the processing performed using one and the same automatic developing machine, the same processing steps and the same processing solutions. Also, these couplers exhibited sufficient color developability when used in negative type silver halide color photographic materials and subjected to the above-described processing. In addition, the photographic materials of both types generated slight stains.

EXAMPLE 6

Samples 03 to 11 prepared in Example 5 and Sample 01 prepared in Example 1 were processed using color developer CD-2 shown in Table 1 in accordance with Processing Method C described in Example 1, resulting in the production of color images. Separately, Samples 12 to 20 prepared in Example 5 and Sample 02 prepared in Example 1 were processed in accordance with the following processing method for negative type silver halide color photographic materials to obtain color images.

The thus processed samples each were examined for light fastness using a xenon fade-o-meter under the following conditions:

Test condition: 120-hour irradiation under illuminance of 100,000 lux.

The results obtained are shown in Table 9 and 10.

Processing of Negative Type Silver Halide Color Photographic Materials

| Processing Step | Temperature | Time | Amount Replenished* | Tank Volume (l) |
|---|---|---|---|---|
| Color Development | 38° C. | 100 sec. | 290 ml | 17 |
| Bleach-Fix | 33° C. | 60 sec. | 150 ml | 9 |
| Rinsing (1) | 30-34° C. | 20 sec. | — | 4 |
| Rinsing (2) | 30-34° C. | 20 sec. | — | 4 |
| Rinsing (3) | 30-34° C. | 20 sec. | 364 ml | 4 |
| Drying | 70-80° C. | 50 sec. | | |

*per $m^2$ of photographic material.
(Rinsing: 3-tank counter current process, in which the replenishment was performed in the direction from (3) to (1)).

The compositions of the processing solutions used were as follows.

| | Tank Solution | Replenisher |
|---|---|---|
| Color Developer | | |
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Benzyl Alcohol | 16 ml | 22 ml |
| Diethylene Glycol | 10 ml | 10 ml |
| Sodium Sulfite | 2.0 g | 2.5 g |
| Potassium Bromide | 0.5 g | — |
| Potassium Carbonate | 30 g | 30 g |
| N-Ethyl-N-(β-methanesulfonamido-ethyl)-3-methyl-4-aminoaniline Sulfate | 5.5 g | 7.5 g |
| Hydroxylamine Sulfate | 2.0 g | 2.5 g |
| Brightening Agent (WHITEX 4B, produced by Sumitomo Chemical Co., Ltd.) | 1.5 g | 2.0 g |
| Water to make | 1000 ml | 1000 ml |
| pH (at 25° C.) | 10.20 | 10.60 |
| Bleach-fix Bath | | |
| Water | 400 ml | 400 ml |
| Ammonium Thiosulfate (70% aqueous solution) | 200 ml | 300 ml |
| Sodium Sulfite | 20 g | 40 g |
| Ammonium Ethylenediaminetetra-acetatoferrate (III) | 60 g | 120 g |
| Disodium Ethylenediamine-tetraacetate | 5 g | 10 g |
| Water to make | 1000 ml | 1000 ml |
| pH (at 25° C.) | 6.70 | 6.30 |

Rinsing Solution

Ion exchange water (calcium and magnesium ion concentrations were each below 3 ppm).

In the foregoing processing, continuous processing was firstly performed until the color developer was replenished in an amount of twice its tank volume, and then the above-described samples of the negative type were processed.

TABLE 9

| Internal Latent-Image Direct Positive Type | G | Gmin* |
|---|---|---|
| 03 | 93 | 0.10 |
| 04 | 92 | 0.10 |
| 05 | 88 | 0.10 |
| 06 | 84 | 0.17 |
| 07 | 92 | 0.10 |
| 08 | 95 | 0.10 |
| 09 | 89 | 0.10 |
| 10 | 93 | 0.10 |
| 01 | 92 | 0.10 |
| 11 | 80 | 0.12 |

TABLE 10

| Negative Type | G* | Gmin** |
|---|---|---|
| 13 | 92 | 0.10 |
| 14 | 92 | 0.10 |
| 15 | 87 | 0.10 |
| 16 | 85 | 0.17 |
| 17 | 92 | 0.10 |
| 18 | 95 | 0.10 |
| 19 | 88 | 0.10 |
| 02 | 93 | 0.10 |
| 12 | 92 | 0.10 |

TABLE 10-continued

| Negative Type | G* | Gmin** |
|---|---|---|
| 20 | 80 | 0.12 |

*Residual densities of the color images in the areas of the initial density 2.0, expressed in percentage.
**Green densities in the white areas.

On the other hand, Samples 12 to 20 and Sample 02, which are negative type silver halide color photographic materials, were processed using the color developer CD-2 in accordance with the Processing Method C, and examined for fastness of the developed color images under the above-described testing condition. The results obtained are the same as shown in Table 10.

It is apparent from the above-described results that there was no difference in light fastness between the color images produced from the couplers of this invention in accordance with the processing of this invention and those produced from the same couplers in accordance with negative processing. In addition, the images produced from the magenta couplers of this invention were distinctly superior in light fastness to those produced from the comparative coupler. Among the magenta couplers of this invention, pyrazoloazole type couplers represented by the general formula (II) were more advantageous than couplers of the general formula (I) in that they had higher light fastness and less stain in white areas.

Further, the samples processed in the various manners as described above were allowed to stand under the storage condition of 80° C. for 3 weeks, or 60° C. 70% RH for 3 weeks. However, no change in color image density was observed in any sample. Accordingly, the images obtained proved to be fast even under high temperature, and high temperature-high humidity conditions.

EXAMPLE 7

Direct positive color paper Samples No. 1 to No. 4 were prepared in the same manner as in Example 1, except the nucleating agent (N-I-10) was replaced by those set forth in Table 11, respectively. After these color paper samples and the negative Sample 02 were exposed wedgewise (3200° K., 0.1", 100 CMS), they were processed with a used processing solution (a running solution exhausted by processing 10 $m^2$ of Sample No. 1, which had been exposed so as to achieve a developing rate of 50%, according to Processing Method D described below) or a fresh processing solution.

Processing Method D

The processing method employed in Example 1, except the color development time was changed to 150" and the color developer described below was used.

| Color Developer | Mother Liquor | Replenisher |
|---|---|---|
| Ethylenediaminetetrakis-methylenephosphonic Acid | 1.5 g | 1.5 g |
| Diethylene Glycol | 10 ml | 10 ml |
| Benzyl Alcohol | 12.0 ml | 14.4 ml |
| Potassium Bromide | 1.60 g | 1.0 g |
| Sodium Sulfite | 2.4 g | 2.9 g |
| N,N-bis(Carboxymethyl)Hydrazine | 4.0 g | 4.8 g |
| Triethanolamine | 6.0 g | 7.2 g |
| N-Ethyl-N-(β-methanesulfonamido-ethyl)-3-methyl-4-aminoaniline Sulfate | 6.0 g | 7.2 g |

-continued

| Color Developer | Mother Liquor | Replenisher |
|---|---|---|
| Potassium Carbonate | 30.0 g | 25.0 g |
| Brightening Agent (of diaminostilbene type) | 1.0 g | 1.2 g |
| Water to make | 1000 ml | 1000 ml |
| pH (25° C.) | 10.50 | 11.00 |
| (The pH was adjusted with sodium hydroxide.) | | |

The densities of the developed magenta colors were measured, and the data shown in Table 11 were obtained.

TABLE 11

| Sample No. | Nucleating Agent | Before Running Dmax | Before Running Dmin | After Running Dmax | After Running Dmin |
|---|---|---|---|---|---|
| 1 | N-I-15 | 2.4 | 0.12 | 2.4 | 0.12 |
| 2 | N-I-14 | 2.3 | 0.11 | 2.4 | 0.12 |
| 3 | N-I-4 | 2.5 | 0.13 | 2.4 | 0.13 |
| 4 | Y* | 1.3 | 0.12 | 1.3 | 0.13 |
| 02 | — | 2.4 | 0.10 | 2.4 | 0.10 |

Y*: Comparative compound

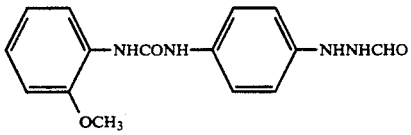

$2.5 \times 10^{-3}$ mol/mol Ag($4.0 \times 10^{-2}$ wt % based on the amount of silver halide)

It can be seen from the data shown above that high Dmax and low Dmin were achieved when the nucleating agents of this invention were used.

EXAMPLE 8

Samples 01 and 02 prepared in the same manner as in Example 1 were imagewise exposed and developed with the developer shown hereinbelow using an automatic developing machine under the following conditions.

| Processing Step | Time (sec.) | Temperature (°C.) | Tank Volume of Mother liquor (l) | Amount Replenished (ml/m²) |
|---|---|---|---|---|
| Color Development | 135 | 38 | 15 | 300 |
| Bleach-Fix | 40 | 33 | 3 | 300 |
| Washing (1) | 40 | 33 | 3 | — |
| Washing (2) | 40 | 33 | 3 | 320 |
| Drying | 30 | 80 | | |

The replenishment of washing water was performed in accordance with the so-called countercurrent replenishing process, wherein the washing bath (2) was replenished with washing solution, and the solution overflowing the washing bath (2) was introduced into the washing bath (1). Therein, the amount of the bleach-fix solution brought over by the photographic materials from the bleach-fix bath into the washing bath (1) was 35 ml/m². Accordingly, the replenishing factor was 9.1.

The composition of each processing solution was as follows. The following color developer was named CD-1.

| Color Developer (CD-1) | Mother Liquor | Replenisher |
|---|---|---|
| Diethylene Glycol | 10 ml | 10 ml |

-continued

| Color Developer (CD-1) | Mother Liquor | Replenisher |
|---|---|---|
| Benzyl Alcohol | 12.0 ml | 14.4 ml |
| Potassium Bromide | $1.35 \times 10^{-2}$ gram · ion | $0.84 \times 10^{-2}$ gram · ion |
| Sodium Sulfite | 2.4 g | 2.9 g |
| Compound (III-3) | 4.0 g | 4.8 g |
| Compound (V-3) | 6.0 g | 7.2 g |
| N-Ethyl-N-(β-methanesulfonamidoethyl)-3-methyl-4-aminoaniline Sulfate | 6.0 g | 7.2 g |
| Potassium Carbonate | 30.0 g | 25.0 g |
| Brightening Agent (of diaminostilbene type) | 1.0 g | 1.2 g |
| Water to make | 1000 ml | 1000 ml |
| pH (25° C.) | 10.50 | 11.00 |

Separately, color developer CD-2 having the following composition was prepared.

| Color Developer (CD-2) | Mother Liquor | Replenisher |
|---|---|---|
| Ethylenediaminetetraacetic Acid | 1.5 g | 1.5 g |
| Diethylene Glycol | 10 ml | 10 ml |
| Benzyl Alcohol | 12.0 ml | 14.4 ml |
| Potassium Bromide | $1.35 \times 10^{-2}$ gram · ion | $0.84 \times 10^{-2}$ gram · ion |
| Sodium Sulfite | 2.4 g | 2.9 g |
| Hydroxylamine Sulfate | 2.0 g | 2.9 g |
| N-Ethyl-N-(β-methanesulfonamidoethyl)-3-methyl-4-aminoaniline Sulfate | 6.0 g | 7.2 g |
| Potassium Carbonate | 30.0 g | 25.0 g |
| Brightening Agent (of diaminostilbene type) | 1.0 g | 1.2 g |
| Water to make | 1000 ml | 1000 ml |
| pH (25° C.) | 10.50 | 11.00 |

| Bleach Fix Bath | Mother Liquor = Replenisher |
|---|---|
| Disodium Ethylenediaminetetraacetate Dihydrate | 4.0 g |
| Ammonium Ethylenediaminetetraacetateferrate (III) Dihydrate | 70.0 g |
| Ammonium Thiosulfate (700 g/l) | 180 ml |
| Sodium p-Toluenesulfinate | 20.0 g |
| Sodium Bisulfite | 20.0 g |
| 2-Amino-5-mercapto-1,3,4-thiadiazole | 0.6 g |
| Ammonium Nitrate | 10.0 g |
| Water to make | 1000 ml |
| pH (25° C.) | 6.20 |

Washing Solution (CL (Common Between the Mother Liquor and the Replenisher)

City water was purified by passing it through a column of mixed-bed system packed with a strongly acidic H-type cation exchange resin (Amberlite IR-120 B, produced by Rhom & Haas, Co.) and an OH-type anion exchange resin (Amberlite IR-400, produced by Rhom & Haas, Co.) until the calcium and magnesium ion concentrations were each reduced to 3 mg/l or less, and then adding thereto 20 mg /l of sodium dichloroisocyanurate and 1.5 g/l of sodium sulfate. The pH of the resulting water solution was within the range of 6.5 to 7.5.

The following Color Developers (running solutions) A to C were prepared using the foregoing color developers CD-1 and CD-2. In the preparation of Color Developers A to C, the same processing steps as described above were employed, and the bleach-fix and the washing baths used were common to all preparations.

Color Developer A

A color developer obtained by continuously processing the imagewise exposed Sample 01 (an internal latent-image type direct positive silver halide color photographic material) until the accumulated amount of the replenisher became to three times the tank volume (which was abbreviated as Solution A).

Color Developer B

A color developer obtained by continuously processing the imagewise exposed Sample 02 (a negative type silver halide color photographic material) until the accumulated amount of the replenisher became three times the tank volume (which was abbreviated as Solution B).

Color Developer C

A color developer obtained by processing both Sample 01 and Sample 02 (exposed imagewise in advance) alternately in succession by the same area until the accumulated amount of the replenisher became three times the tank volume (which was abbreviated as Solution C).

Newly prepared Sample 01 and Sample 02 were exposed to light through an R-G-B three color separation filter fixed to the front of a wedge, and then processed with each of the foregoing Solutions A to C to obtain samples for evaluation of photographic properties.

The densities of the thus developed color images were measured. As a criterion for evaluation of the photographic properties, the maximum densities (Dmax) of the magenta color images and the stain densities in the white areas (Dmin) were employed. These values are shown in Table 12.

TABLE 12

| Processing Process | Color Developer CD-No. | Sample 01 (Direct Positive) Dmax | Sample 01 (Direct Positive) Dmin | Sample 02 (Negative) Dmax | Sample 02 (Negative) Dmin |
|---|---|---|---|---|---|
| Solution A | CD-1 | 2.65 | 0.09 | 2.58 | 0.10 |
| | CD-2 | 2.59 | 0.11 | 2.52 | 0.13 |
| Solution B | CD-1 | 2.60 | 0.14 | 2.64 | 0.09 |
| | CD-2 | 2.53 | 0.16 | 2.57 | 0.11 |
| Solution C | CD 1 | 2.65 | 0.09 | 2.64 | 0.09 |
| | CD-2 | 2.59 | 0.11 | 2.58 | 0.11 |

As can be seen from the Dmax and Dmin values shown in Table 12, although high Dmax and low stain density in the white area were achieved when Sample 01 (an internal latent-image type direct positive silver halide color photographic material) was processed with Solution A obtained by continuously processing Sample 01 alone until the accumulated amount of the replenisher became three times the tank volume, undesirable results or low Dmax and high Dmin in the white area were brought about when Sample 02 (a negative type silver halide color photographic material) was processed with Solution A. In comparison between the color developer CD-1 and the color developer CD-2, the Dmax was higher and the Dmin was lower in both Sample 01 and Sample 02 when CD-1 (containing preservatives of the preent invention) was used.

In the case of Solution B, which was prepared by continuously processing Sample 02 alone until the accumulated amount of the replenisher became three times the tank volume, though desirable results or high Dmax and low fog in the white area were obtained when Sample 02 was processed with Solution B, the processing of Sample 01 produced undesirable results or low Dmax and high Dmin (fog in the white area), compared with the processing with Solution A. In comparison between the color developer CD-1 and the color developer CD-2, on the other hand, there was a tendency for the Dmax to be higher and for the Dmin to be lower in both Sample 01 and Sample 02 when CD-1 was used, that is to say, the color developer improved when it contains preservatives of the present invention.

In the case of Solution C, which was prepared by processing both Sample 01 and Sample 02 alternately in succession by the same area until the accumulated amount of the replenisher became three times the tank volume, it became apparent that both Sample 01 and Sample 02 manifested desirable photographic properties or high Dmax and low Dmin (fog in the white area). In comparison between the color developer CD-1 and the color developer CD-2, CD-1 gave higher Dmax and lower Dmin.

EXAMPLE 9

The same type of sample of an internal latent-image type direct positive silver halide color photographic material (Sample 01) and the same type sample of a negative type silver halide color photographic material (Sample 02) as prepared in Example 1 were processed using the color developer CD-1 which had undergone each of the pretreatments described below. The same processing steps as in Example 1 were employed, and other processing solutions were the same as in Example 1.

Color Developer D

A color developer obtained by using CD-1 in processing Sample 01 and Sample 02 alternately in succession so that the ratio between the continuously processed area of Sample 01 and that of Sample 02 might become 95:5 (by percentage) until the accumulated amount of the replenisher became three time the tank volume (abbreviated as Solution D).

Color Developer E

A color developer obtained by using CD-1 in processing Sample 01 and Sample 02 alternately in succession so that the ratio between the continuously processed area of Sample 01 and that of Sample 02 was 90:10 (by percentage) until the accumulated amount of the replenisher became three times the tank volume (abbreviated as Solution E).

Color Developer F

A color developer obtained by using CD-1 in processing Sample 01 and Sample 02 alternately in succession so that the ratio between the continuously processed area of Sample 01 and that of Sample 02 was 10:90 (by percentage) until the accumulated amount of the replenisher because three times the tank volume (abbreviated as Solution F).

Color Developer G

Color developer obtained by using CD-1 in processing Sample 01 and Sample 02 alternately in succession so that the ratio between the continuously processed area of Sample 01 and that of Sample 02 was 5:95 (by percentage) until then accumulated amount of the replenisher because three times the tank volume (abbreviated as Solution G).

Sample 01 and Sample 02 were exposed to light through a wedge fitted with a B-G-R three color separation filter, and then processed with each of the thus pretreated color developers, from Solution D to Solution G.

The color densities of the thus obtained color images were measured, and the evaluation of photographic properties was made.

The Dmax (maximum density) and Dmin (fog in the white area) values of magenta color images obtained are shown in Table 13.

TABLE 13

| Processing Solution | Ratio between Sample Areas in Pretreatment Sample 01 (%) | Sample 02 (%) | Sample 01 (Direct Posi) Dmax | Dmin | Sample 02 (Nega) Dmax | Dmin |
|---|---|---|---|---|---|---|
| A | 100 | 0 | 2.65 | 0.09 | 2.58 | 0.10 |
| D | 95 | 5 | 2.65 | 0.09 | 2.62 | 0.09 |
| E | 90 | 10 | 2.65 | 0.09 | 2.64 | 0.09 |
| C | 50 | 50 | 2.65 | 0.09 | 2.64 | 0.09 |
| F | 10 | 90 | 2.65 | 0.09 | 2.64 | 0.09 |
| G | 5 | 95 | 2.63 | 0.10 | 2.64 | 0.09 |
| B | 0 | 100 | 2.60 | 0.14 | 2.64 | 0.09 |

From the data set forth above, it is apparent that the processing of Sample 01 and Sample 02 was effectively achieved within the range of the processed area ratios from 5/95 to 95/5. Namely, although a lowering of Dmax and an increase of Dmin occurred when Sample 01 or Sample 02 was processed with the color developer used in the continuous processing of Sample 02 alone or Sample 01 alone, respectively, fluctuations of photographic properties were markedly reduced by mixing Sample 01 or Sample 02 with the other in a proportion of 5% based on the area, resulting in the achievement of sufficient color developability (high Dmax) and less stain in the white area (low Dmin). Further, it became apparent that a quite stable processing is feasible as long as the ratio between the processed areas ranges from 90/10 to 10/90.

EXAMPLE 10

The same color developer as described in Example 1 was subjected to each of the pretreatments described below.

(1) The color developer obtained just after preparation.

(2) The color developer used for processing Sample 01 and Sample 02 described in Example 1 alternately in succession in the same area until the accumulated amount of the replenisher became one-half the tank volume.

(3) The color developer used for continuous processing as in (2) until the accumulated amount of the replenisher became five times the tank volume.

(4) The color developer (3) used again after a 10-day storage in the tank at room temperature.

Sample 01 and Sample 02 were exposed to light through a wedge fitted with a B-G-R three color separation filter, and then processed with each of the solutions (1) to (4) described above. The evaluation of photographic properties was made by density measurements of each sample. The Dmax and Dmin values of the magenta color images produced with the foregoing processing solutions are shown in Table 14.

TABLE 14

| Color Developer Used | Sample 01 (Direct Positive) Dmax | Dmin | Sample 02 (Negative) Dmax* | Dmin |
|---|---|---|---|---|
| (1) Just after preparation | 2.65 | 0.09 | 2.64 | 0.09 |
| (2) Replenished in an amount of one-half the tank volume (alternate processing of Samples 01 and 02 with same area) | 2.65 | 0.09 | 2.64 | 0.09 |
| (3) Replenished in an amount of 5 times the tank volume (alternate processing of Samples 01 and 02 with same area) | 2.65 | 0.09 | 2.64 | 0.09 |
| (4) Solution (3) stored in the tank for 10 days at room temperature | 2.65 | 0.09 | 2.64 | 0.09 |

As can be seen from the data set forth above, the development processing of Samples 01 and 02 was stable and photographic properties without variation were achieved whether the color developer used was fresh one, or one which was in an equilibrium state after the replenishment continued untill the accumulated amount of the replenisher used became 5 times the tank volume. Of course, no difference in photographic properties was observed also in the case of solution (2) corresponding to the less replenished state. In addition, even when solution (3), in which equilibrium was reached by being replenished in an amount of 5 times the tank volume was stored in the tank for 10 days at room temperature, and then used again as a processing solution, no change in photographic properties attained occurred. That is, it has proved that the color developers containing the preservative of this invention have improved keeping quality in processing of two photographic material.

Further, the processed area ratio between Samples 01 and 02 was changed to 90/10 or 10/90, and the same treatments as the foregoing (2) and (3) were performed. Then, Sample 01 and Sample 02 were processed with the thus treated color developers, and the Dmax and Dmin of the magenta color images obtained therein were examined to evaluate the photographic properties. The same results as those of (2) and (3) set forth in Table 13 were obtained. That is, excellent color developability and slight stain in white areas were achieved even when the ratios between the processed areas of the photographic materials of internal latent-image direct positive and negative types were 90/10 and 10/90.

From the above-described experimental results, it is apparent that the developing processing of this invention enabled constant achievement of excellent photographic properties in both photographic materials of internal latent-image direct positive and negative types.

EXAMPLE 11

Color developments were performed using color developers having the following compositions which preservatives had been added thereto. These preservatives, having the general formulae (III), (IV), (V) and (VI) illustrated hereinbefore, are set forth in Table 15.

| Color Developer | Mother Liquor | Replenisher |
|---|---|---|
| Diethylene Glycol | 10 ml | 10 ml |
| Benzyl Alcohol | 12.0 ml | 14.4 ml |
| Potassium Bromide | $1.35 \times 10^{-2}$ gram · ion | $0.84 \times 10^{-2}$ gram · ion |
| Sodium Sulfite | 0.8 g | 0.2 g |
| Preservative of this Invention, General Formulae (III) to (VI) | (see Table 15) | |
| N-Ethyl-N-(β-methanesulfonamidoethyl)-3-methyl-4-aminoaniline Sulfate | 6.0 g | 7.2 g |
| Potassium Carbonate | 30.0 g | 25.0 g |
| Brightening Agent (of diaminostilbene type) | 1.0 g | 1.2 g |
| Water to make | 1000 ml | 1000 ml |
| pH (25° C.) | 10.50 | 11.00 |

TABLE 15

| Color Developer CD-No. | Preservative (mol/l) General Formula (III) or (IV) Compound | Mother Liquor | Replenisher | General Formula (V) or (VI) Compound | Mother Liquor | Replenisher |
|---|---|---|---|---|---|---|
| CD-9 | III-3 | $0.5 \times 10^{-2}$ | $0.6 \times 10^{-2}$ | V-3 | $4.0 \times 10^{-2}$ | $4.8 \times 10^{m-2}$ |
| CD-10 | " | $10.0 \times 10^{-2}$ | $12.0 \times 10^{-2}$ | " | " | " |
| CD-11 | III-11 | $0.5 \times 10^{-2}$ | $0.6 \times 10^{-2}$ | V-3 | " | " |
| CD-12 | " | $2.5 \times 10^{-2}$ | $3.0 \times 10^{-2}$ | " | " | " |
| CD-13 | " | $10.0 \times 10^{-2}$ | $12.0 \times 10^{-2}$ | " | " | " |
| CD-14 | III-19 | $0.5 \times 10^{-2}$ | $0.6 \times 10^{-2}$ | V-3 | " | " |
| CD-15 | " | $2.5 \times 10^{-2}$ | $3.0 \times 10^{-2}$ | " | " | " |
| CD-16 | " | $10.0 \times 10^{-2}$ | $12.0 \times 10^{-2}$ | " | " | " |
| CD-17 | III-1 | $0.5 \times 10^{-2}$ | $0.6 \times 10^{-2}$ | V-3 | " | " |
| CD-18 | " | $10.0 \times 10^{-2}$ | $12.0 \times 10^{-2}$ | " | " | " |
| CD-19 | IV-5 | $0.5 \times 10^{-2}$ | $0.6 \times 10^{-2}$ | V-3 | " | " |
| CD-20 | " | $10.0 \times 10^{-2}$ | $12.0 \times 10^{-2}$ | " | " | " |
| CD-21 | IV-7 | $0.5 \times 10^{-2}$ | $0.6 \times 10^{-2}$ | V-3 | " | " |
| CD-22 | " | $10.0 \times 10^{-2}$ | $12.0 \times 10^{-2}$ | " | " | " |
| CD-23 | IV-12 | $0.5 \times 10^{-2}$ | $0.6 \times 10^{-2}$ | V-3 | " | " |
| CD-24 | " | $2.5 \times 10^{-2}$ | $3.0 \times 10^{-2}$ | " | " | " |
| CD-25 | " | $10.0 \times 10^{-2}$ | $12.0 \times 10^{-2}$ | " | " | " |
| CD-26 | III-3 | $2.5 \times 10^{-2}$ | $3.0 \times 10^{-2}$ | V-3 | $1.0 \times 10^{-2}$ | $1.2 \times 10^{-2}$ |
| CD-27 | " | " | " | " | $8.0 \times 10^{-2}$ | $9.6 \times 10^{-2}$ |
| CD-28 | III-3 | $2.5 \times 10^{-2}$ | $3.0 \times 10^{-2}$ | V-2 | $4.0 \times 10^{-2}$ | $4.8 \times 10^{-2}$ |
| CD-29 | " | " | " | V-4 | $4.0 \times 10^{-2}$ | " |
| CD-30 | III-3 | $2.5 \times 10^{-2}$ | $3.0 \times 10^{-2}$ | VI-1 | $1.0 \times 10^{-2}$ | $1.2 \times 10^{-2}$ |
| CD-31 | " | " | " | " | $8.0 \times 10^{-2}$ | $9.6 \times 10^{-2}$ |
| CD-32 | " | " | " | VI-3 | $1.0 \times 10^{-2}$ | $1.2 \times 10^{-2}$ |
| CD-33 | " | " | " | " | $4.5 \times 10^{-2}$ | $5.4 \times 10^{-2}$ |
| CD-34 | " | " | " | " | $18.0 \times 10^{-2}$ | $19.6 \times 10^{-2}$ |
| CD-35 | " | " | " | VI-12 | $1.0 \times 10^{-2}$ | $1.2 \times 10^{-2}$ |
| CD-36 | " | " | " | " | $4.5 \times 10^{-2}$ | $5.4 \times 10^{-2}$ |
| CD-37 | " | " | " | " | $18.0 \times 10^{-2}$ | $19.6 \times 10^{-2}$ |
| CD-38 | IV-1 | $2.5 \times 10^{-2}$ | $3.0 \times 10^{-2}$ | VI-1 | $1.0 \times 10^{-2}$ | $1.2 \times 10^{-2}$ |
| CD-39 | " | " | " | " | $18.0 \times 10^{-2}$ | $19.6 \times 10^{-2}$ |
| CD-40 | IV-5 | $2.5 \times 10^{-2}$ | $3.0 \times 10^{-2}$ | VI-1 | $1.0 \times 10^{-2}$ | $1.2 \times 10^{-2}$ |
| CD-41 | " | " | " | " | $18.0 \times 10^{-2}$ | $19.6 \times 10^{-2}$ |
| CD-42 | IV-7 | $2.5 \times 10^{-2}$ | $3.0 \times 10^{-2}$ | VI-1 | $1.0 \times 10^{-2}$ | $1.2 \times 10^{-2}$ |
| CD-43 | " | " | " | " | $18.0 \times 10^{-2}$ | $19.6 \times 10^{-2}$ |
| CD-44 | Sodium sulfite | $2.0 \times 10^{-2}$ | $2.4 \times 10^{-2}$ | Hydroxylamine sulfate | $2.5 \times 10^{-2}$ | $3.0 \times 10^{-2}$ |

The photographic processing was performed in the same manner as in Example 1, except the compositions of the color developers used were changed as described in the above Table. More specifically, after Sample 01 and Sample 02 as described in Example 1 were exposed imagewise, they were processed alternately in the same area until the accumulated amount of the replenisher became three times the tank volume. Using the thus treated processing solutions, the samples which had been exposed to light through a B-G-R three color separation filter fixed to a wedge were processed. The density measurements of the images obtained were carried out, and thereby the photographic properties were evaluated. In Table 16, the Dmax and Dmin values of the magenta colors developed with color developers which differed in the preservative used are shown.

TABLE 16

| Color Developer CD-No. | Sample 01 (Direct Positive) Dmax | Dmin | Sample 02 (Negative) Dmax | Dmin |
|---|---|---|---|---|
| CD-9 | 2.65 | 0.09 | 2.64 | 0.09 |
| CD-10 | 2.63 | " | 2.61 | " |
| CD-11 | 2.65 | 0.09 | 2.64 | 0.09 |
| CD-12 | 2.65 | " | 2.64 | " |
| CD-13 | 2.63 | " | 2.62 | " |
| CD-14 | 2.65 | 0.09 | 2.64 | 0.09 |
| CD-15 | 2.65 | " | 2.63 | " |
| CD-16 | 2.61 | " | 2.61 | " |
| CD-17 | 2.63 | 0.09 | 2.61 | 0.09 |
| CD-18 | 2.59 | " | 2.57 | " |
| CD-19 | 2.63 | 0.09 | 2.62 | 0.09 |
| CD-20 | 2.59 | " | 2.58 | " |
| CD-21 | 2.65 | 0.09 | 2.64 | 0.09 |
| CD-22 | 2.63 | " | 2.62 | " |
| CD-23 | 2.65 | 0.09 | 2.64 | 0.09 |
| CD-24 | 2.65 | " | 2.63 | " |
| CD-25 | 2.62 | 0.09 | 2.61 | 0.09 |

TABLE 16-continued

| Color Developer CD-No. | Sample 01 (Direct Positive) Dmax | Dmin | Sample 02 (Negative) Dmax | Dmin |
|---|---|---|---|---|
| CD-26 | 2.65 | 0.09 | 2.64 | 0.09 |
| CD-27 | 2.64 | 0.09 | 2.63 | 0.09 |
| CD-28 | 2.64 | 0.09 | 2.63 | 0.09 |
| CD-29 | 2.64 | 0.09 | 2.62 | 0.09 |
| CD-30 | 2.65 | 0.09 | 2.64 | 0.09 |
| CD-31 | 2.63 | " | 2.62 | " |
| CD-32 | 2.64 | 0.09 | 2.63 | 0.09 |
| CD-33 | 2.65 | " | 2.63 | " |
| CD-34 | 2.61 | " | 2.60 | " |
| CD-35 | 2.65 | 0.09 | 2.62 | 0.09 |
| CD-36 | 2.64 | " | 2.61 | " |
| CD-37 | 2.60 | " | 2.59 | " |
| CD-38 | 2.65 | 0.09 | 2.61 | 0.09 |
| CD-39 | 2.59 | " | 2.56 | " |
| CD-40 | 2.64 | 0.09 | 2.61 | 0.09 |
| CD-41 | 2.59 | 0.09 | 2.56 | 0.09 |
| CD-42 | 2.65 | 0.09 | 2.64 | 0.09 |
| CD-43 | 2.63 | " | 2.61 | " |
| CD-44 | 2.59 | 0.11 | 2.58 | 0.11 |

As can be seen from the data shown in Table 16, the preservatives used in this invention caused only slight fluctuations in photographic properties even when the addition amounts thereof were changed by about 20 times, and high color developability and low fog density (Dmin) were achieved. On the other hand, the combination of sodium sulfite and hydroxylamine used for comparison provided rather low Dmax and high Dmin in white area. In particular, high fog density has a tendency to impair the image quality of the prints.

Of the color developers used in this example, those containing preservatives in small amounts, i.e., CD-9, 11, 14, 17, 19, 21, 23, 26, 28, 30, 32, 35, 38, 40 and 42, were put and sealed up in separate vinyl chloride containers immediately after the preparation thereof, and stored at 40° C. for one month. Thereafter, the same photographic processing as described above was performed using each of these stored color developers. However, no change in photographic properties was observed. This result indicates that the preservatives used in this invention can prevent the deterioration of color developers even when added in small amounts, that is, they have high preservability.

EXAMPLE 12

Direct positive photographic materials were prepared in the same manner as Sample 01 of Example 1, except the nucleating agent (N-II-2) was incorporated in each light-sensitive layer in a proportion of $10^{-3}$ wt % to silver halide present in each layer, and further each of the nucleation accelerators set forth in Table 17 was added.

After a 5 $m^2$ portion of the thus prepared autoposi color paper samples No. 1 to 10 and a 5 $m^2$ portion of the negative color paper Sample 02 were each exposed so as to achieve a developing rate of 50%, they were processed in accordance with the processing process employed in Example 1 using an automatic developing machine. Further, the above-described samples were exposed wedgewise (3200° K., 0.1", 100 CMS), and then processed using a running solution exhausted by the foregoing processing or a fresh processing solution in accordance with the foregoing processing process. The magenta image densities achieved are shown in Table 17.

TABLE 17

| Sample No. | Nucleation Accelerator Kind | Amount added (mol/mol Ag) | Before Running Dmax | Dmin | After Running Dmax | Dmin |
|---|---|---|---|---|---|---|
| 1 | A-5 | $5.6 \times 10^{-4}$ | 2.4 | 0.12 | 2.3 | 0.12 |
| 2 | A-6 | " | 2.4 | 0.12 | 2.4 | 0.12 |
| 3 | A-9 | " | 2.4 | 0.12 | 2.4 | 0.12 |
| 4 | A-12 | " | 2.4 | 0.12 | 2.4 | 0.12 |
| 5 | A-21 | " | 2.4 | 0.12 | 2.4 | 0.12 |
| 6 | A-22 | " | 2.4 | 0.12 | 2.4 | 0.12 |
| 7 | A-27 | " | 2.4 | 0.12 | 2.3 | 0.12 |
| 8 | A-30 | " | 2.4 | 0.12 | 2.4 | 0.12 |
| 9 | A-32 | " | 2.4 | 0.12 | 2.4 | 0.12 |
| 10 | — | — | 1.8 | 0.18 | 1.2 | 0.25 |
| 02 | — | — | 2.4 | 0.11 | 2.3 | 0.11 |

In the samples from No. 1 to No. 9 which contained the nucleation accelerators used in this invention, respectively, a decrease in Dmax and an increase in Dmin caused by running processing were insignificant, compared with those in the sample No. 10 which contained no nucleation accelerator. Therefore, it is advantageous to use these nucleation accelerators. Similar effects were produced on cyan and yellow image densities by these nucleation accelerators.

While the invention has been described in detail and with reference to specific embodiments thereof, it will be apparent to one skilled in the art that various changes and modifications can be made therein without departing from the spirit and scope thereof.

COMPARATIVE EXAMPLE 1

The direct positive photographic material in Example 6 of U.S. Pat. No. 4,830,948 was singly and continuously treated in the same manner as Example 1 of U.S. Pat. No. 4,830,948.

The concentration of $Br^-$ in the developer was $0.67 \times 10^{-2}$ gram ion/l, and the developer was free from benzyl alcohol.

The results obtained are shown below.

| | At Start | After Continuous Treatment |
|---|---|---|
| Dmax | 2.01 | 1.83 |
| Dmin | 0.15 | 0.16 |

From the results it can be seen that by this method a low Dmax is obtained and the Dmax is unstable.

COMPARATIVE EXAMPLE 2

The direct positive photographic material in Example 6 of U.S. Pat. No. 4,830,948 was singly and continuously treated in the same manner as Example 5 of U.S. Pat. No. 4,830,948.

The concentration of $Br^-$ in the developer was $4.37 \times 10^{-2}$ gram ion/l.

The results obtained are shown below.

| | At Start | After Continuous Treatment |
|---|---|---|
| Dmax | 2.01 | 1.83 |
| Dmin | 0.15 | 0.16 |

From the results it can be seen that by this method a low Dmax is obtained and the Dmax is unstable.

COMPARATIVE EXAMPLE 3

The direct positive photographic material in Example 6 of U.S. Pat. No. 4,830,948 was singly and continuously treated in the same manner as Example 12 of U.S. Pat. No. 4,830,948.

The concentration of $Br^-$ in the developer was $1.26\times10^{-2}$ gram ion/l, and the developer was free from benzyl alcohol.

| | At Start | After Continuous Treatment |
|---|---|---|
| Dmax | 1.63 | 1.85 |
| Dmin | 0.28 | 0.16 |

Although the concentration of $Br^-$ is within the range of that of the present invention, the Dmax was low, and the Dmax and Dmin are unstable.

What is claimed is:

1. A method of producing color images comprising continuously developing (1) a negative silver halide color photographic light-sensitive material, which has been subjected to image-wise exposure, and which has at least one silver halide emulsion layer on a support and contains a nondiffusible coupler capable of forming a dye by a coupling reaction with an oxidation product of an aromatic primary amine developing agent, and (2) a direct positive silver halide color photographic light-sensitive material, which has been exposed to image-wise exposure, and which has at least one silver halide emulsion layer on a support and contains a nondiffusible coupler capable of forming a dye by a coupling reaction with an oxidation product of an aromatic primary amine developing agent, with the same developer having a pH of 10.15 to 11.0, wherein the color developer used for development is one which has been used for development of the direct positive silver halide color photographic material and the negative silver halide color photographic material in a ratio of the area of the former to the area of the latter is from 5/95 to 95/5, and which has become stable by continuous use and replenishment until the constituents of the developer have substantially achieved an equilibrium state, wherein the bromide ion concentration in the color developer is from $1.0\times10^{-2}$ to $2.5\times10^{-2}$ gram ion/l, wherein the amount of benzyl alcohol in the color developer is from $5\times10^{-2}$ to $2\times10^{-1}$ mol/l, said direct positive photographic material containing i) at least one compound represented by formula (N-I),

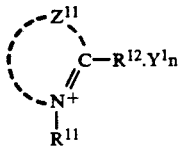

(N-I)

wherein $Z^{11}$ represents a nonmetallic atomic group necessary to complete a 5- or 6-membered heterocyclic ring, which may be substituted;

$R^{11}$ represents a unsubstituted or substituted aliphatic hydrocarbon residue;

$R^{12}$ represents a hydrogen atom, an unsubstituted or substituted aliphatic or aromatic hydrocarbon residue, or a residue forming a ring by binding to the heterocyclic ring completed by $Z^{11}$;

provided at least one of the groups $R^{11}$, $R^{12}$ and $Z^{11}$ contains a alkynyl group, an aliphatic or aromatic acyl group, a hydrazino group or a hydrazono group, or $R^{11}$ and $R^{12}$ combine with each other to complete a 6-membered ring as a dihydropyridinium skeleton, and at least one of the groups $R^{11}$, $R^{12}$ and $Z^{11}$ may contain a group capable of accelerating adsorption onto silver halide grains;

$Y^1$ represents a counter ion for maintaining charge balance; and n represents 0 or 1, and (ii) at least one magenta coupler selected from the group consisting of compounds represented by formula (II-2) or (II-3):

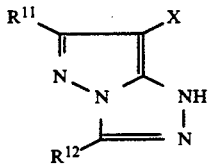

(II-2)

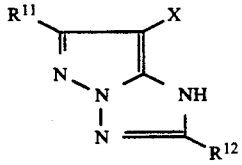

(II-3)

wherein $R^{11}$ and $R^{12}$ each represents a hydrogen atom, a halogen atom, a cyano group, an aliphatic or aromatic hydrocarbon group, or a heterocyclic group, $R'_1O-$, $R'_1\underset{\underset{O}{\|}}{C}-$, $R'_1\underset{\underset{O}{\|}}{C}O-$, $R'_1SO-$, $R'_1SO_2-$, $R'_1SO_2NH-$, $R'_1CNH-$, $R'_1NH-$, $R'_1S-$, $R'_1NH-\underset{\underset{O}{\|}}{C}-NH-$, $\begin{matrix} R'_1 \\ R'_1 \end{matrix}\!\!>N-\underset{\underset{O}{\|}}{C}-NH-$, $R'_1O\underset{\underset{O}{\|}}{C}NH-$, (wherein $R'_1$ represents a hydrogen atom, a halogen atom, a cyano group an aliphatic or aromatic hydrocarbon or heterocyclic group), a silyl group, a silyloxy group, a sililamino group, an imido group, a carbamoyl group, a sulfamoyl group, or a sulfamoylamino group, and X is an eliminatable group; and $R^{11}$ and $R^{12}$ and X each may be a divalent group via which the corresponding coupler may form a dimer, or a linking group connecting the polymer chain to the mother nucleus of the corresponding coupler.

2. The method of producing color images as in claim 1, wherein said developer contains at least one compound selected from the group consisting of compounds represented by the formula (III) or formula (IV) and salts thereof:

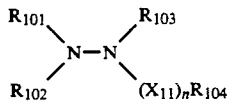

(III)

wherein $R_{101}$, $R_{102}$ and $R_{103}$ each represents a hydrogen atom, an alkyl group, an aryl group, or a heterocyclic group;

$R_{104}$ represents a hydrogen atom, a hydroxyl group, a hydrazino group, an alkyl group, an aryl group, a heterocyclic group, an alkoxy group, an aryloxy group, a carbamoyl group, or an amino group;

$X^{11}$ represents a divalent group;

n represents 0 or 1, but when n is 0, $R_{104}$ must be an alkyl group, an aryl group or a heterocyclic group; and further, $R_{103}$ and $R_{104}$ may form a hetero ring by combining with each other,

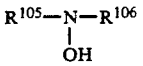

(IV)

wherein $R^{105}$ and $R^{106}$ each represents a hydrogen atom, an unsubstituted or substituted alkyl group, an unsubstituted or substituted alkenyl group, an unsubstituted or substituted aryl group, an unsubstituted or substituted aromatic heterocyclic group, and further they may combine with each other to form a hetero ring together with the nitrogen atom, but with the proviso that $R^{105}$ and $R^{106}$ are not simultaneously a hydrogen atom.

3. The method of producing color images as in claim 2, wherein said developer contains at least one compound selected from the group consisting of compounds represented by formula (V) or formula (VI), and salts thereof:

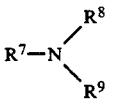

(V)

wherein $R^7$ represents a hydroxyalkyl group containing 2 to 6 carbon atoms;

$R^8$ and $R^9$ each represent a hydrogen atom, an alkyl group containing 1 to 6 carbon atoms, a hydroxyalkyl group containing 2 to 6 carbon atoms, a benzyl group, or a group of the formula

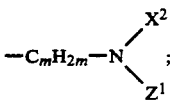

m represents an integer from 1 to 6;

$X^2$ and $Z^1$ each represents a hydrogen atom, an alkyl group containing 1 to 6 carbon atoms, or a hydroxyalkyl group containing 2 to 6 carbon atoms;

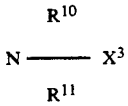

(VI)

wherein $X^3$ represents a trivalent group necessary to complete a condensed ring;

$R^{10}$ and $R^{11}$, where may be the same or different, each represents an alkylene group, an arylene group, an alkenylene group, or an aralkylene group.

4. The method of producing color images as in claim 1, wherein said direct positive photosensitive material contains at least one compound selected from the group consisting of compounds represented by formula (VII) or formula (VIII):

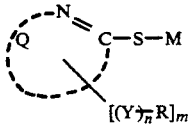

wherein

Q represents atoms necessary to complete a 5- or 6-membered heterocyclic ring, which may be fused together with an aromatic carbon ring or an aromatic hetero ring;

Y represents a divalent linking group comprising an atom or atomic group selected from hydrogen, carbon, nitrogen, oxygen and sulfur atoms;

R represents an organic group containing at least one thioether, amino, ammonium, ether or heterocyclic moiety;

n represents 0 or 1;

m represents 0, 1 or 2; and

M represents a hydrogen atom, an alkali metal atom, an ammonium group, or a group dissociable under alkaline conditions:

(VIII)

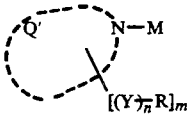

wherein

Q' represents atoms necessary to complete a 5- or 6-membered hetero ring capable of forming iminosilver;

Y, R, n and M have the same meanings as in (VII), respectively;

m represents 1 or 2.

5. The method of producing color images as in claim 1, wherein said heterocyclic ring completed by $Z^{11}$ in formula (N-I) is a ring selected from the group consisting of a substituted or unsubstituted quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium naphthoxazolium, and benzoxazolinium nuclei.

6. The method of producing color images as in claim 1, wherein $Z^{11}$ in formula (N-1) is substituted with a substituent selected from the group consisting of an alkyl group, an alkenyl group, an aralkyl group, an aryl group, an alkynyl group, a hydroxy group, an alkoxy group, an aryloxy group, a halogen atom, an amino group, an alkylthio group, an arylthio group, an aliphatic or aromatic acyloxy group, an aliphatic or aromatic acylamino group, an aliphatic or aromatic sulfonyl group, an aliphatic or aromatic sulfonyloxy group, an aliphatic or aromatic sulfonylamino group, a carboxyl group, an aliphatic or aromatic acyl group, a carbamoyl group, a sulfamoyl group, a sulfo group, a cyano group, a ureido group, a urethane group, a carboxylate group, a hydrazino group, a hydrazono group, an imino group, said substituents may further be substituted with any of the foregoing substituents; or said $Z^{11}$ is substituted with a substituent selected from the group consisting a heterocyclic quaternary ammonium group completed by $Z^{11}$ via an linkage selected from the group consisting of a bonding, an atom or atomic group containing at least one atom selected from among C, N, S, and O.

7. The method of producing color images as in claim 5, wherein said aliphatic hydrocarbon group represented by $R^{11}$ and $R^{12}$ in formula (N-I) is an unsubstituted alkyl group containing 1 to 18 carbon atoms, or a substituted alkyl group whose alkyl moiety contains 1 to 18 carbon atoms; said aryl group represented by $R^{12}$ in formula (N-I) contains 6 to 20 carbon atoms; and a substituent for the substituted alkyl group or a substituent with which said aryl group may be substituted is a substituent selected from the group consisting of an alkyl group, an alkenyl group, an aralkyl group, an aryl group, an alkynyl group, a hydroxy group, an alkoxy group, an aryloxy group, a halogen atom, an amino group, an alkylthio group, an arylthio group, an aliphatic or aromatic acyloxy group, an aliphatic or aromatic acylamino group, an aliphatic or aromatic sulfonyl group, an aliphatic or aromatic sulfonyloxy group, an aliphatic or aromatic sulfonylamino group, a carboxyl group, an aliphatic or aromatic acyl group, a carbamoyl group, a sulfamoyl group, a sulfo group, a cyano group, a ureido group, a urethane group, a carboxylate group, a hydrazino group, a hydrazono group, an imino group, said substituents may further be substituted with any of the foregoing substituents.

8. The method of producing color images as in claim 1, wherein Y' for charge balance in formula (N-I) is a counter ion selected from the group consisting of a bromine ion, a chlorine ion, an iodine ion, a p-toluenesulfonic acid ion, an ethylsulfonic acid ion, a perchloric acid ion, a trifluoromethanesulfonic acid ion, a thiocyanic acid ion, $BF_4^-$, and $PF_6^-$.

9. The method of producing color images as in claim 1, wherein the compound represented by formula (N-I) is incorporated in an amount of from 0.2 to 2.0 g/m$^2$.

10. The method of producing color images as in claim 2, wherein said compound is incorporated in the developer in an amount of $1\times10^{-4}$ to $5\times10^{-1}$ mol per liter of the developer.

11. The method of producing color images as in claim 3, wherein said compound represented by formula (V) is incorporated in an amount of 0.01 to 20 g per liter of the developer.

12. The method of producing color images as in claim 3, wherein said compound represented by formula (VI) is incorporated in an amount of 0.01 to 100 g per liter of the developer.

13. The method of producing color images as in claim 4, wherein said compound of formula (VII) and/or (VIII) is incorporated in an amount of $1\times10^{-6}$ to $1\times10^{-2}$ mol per mol of silver.

14. The method of producing color images as in claim 1, wherein said magenta coupler is incorporated in an amount of 0.001 to 1 mole per mole of light-sensitive silver halide.

15. The method of producing color images as in claim 1, wherein said direct positive photographic material contains at least one nucleating agent represented by formula (N-II);

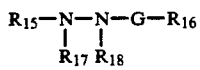

(N-II)

wherein $R_{15}$ represents an aliphatic hydrocarbon residue, an aromatic hydrocarbon residue or a heterocyclic group; $R_{16}$ represents a hydrogen atom, an alkyl group, an aralkyl group, an aryl group, an alkoxy group, an aryloxy group, or an amino group;

G represents a carbonyl group, a sulfonyl group, a sulfoxy group, a phosphoryl group, or an iminomethylene

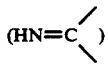

group;

$R_{17}$ and $R_{18}$ are both a hydrogen atom, or one of them is a hydrogen atom and the other is an alkylsulfonyl group, an arylsulfonyl group or an acyl group; and wherein G, $R_{16}$, and $R_{18}$ and the hydrazine nitrogen together may form a hydrazone structure

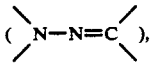

said groups set forth above may be substituted.

16. The method of producing color images as in claim 15, wherein said nucleating agent represented by formula (N-I) is incorporated in an amount of 50 wt % or more of the total amount of nucleating agent.

17. The method of producing color images as in claim 4, wherein said compound represented by formula (VII) is a compound represented by formula (VII-1), (VII-2), (VII-3) or (VII-4);

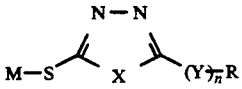

(VII-1)

wherein

M, R, Y and n have the same meaning as those in the formula (VII); and

X represents an oxygen, sulfur or selenium atom;

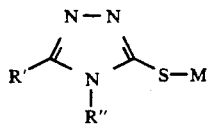

(VII-2)

wherein

R′ represents a hydrogen atom, a halogen atom, a nitro group, a mercapto group, an unsubstituted amino group, a substituted or unsubstituted alkyl, alkenyl, aralkyl or aryl group, or —Y)$_n$R;

R″ represents a hydrogen atom, unsubstituted amino, or —Y)$_n$R;

when both R′ and R″ represent —Y)$_n$R, they may be the same or different; but where at least either R′ or R″ must represent —Y)$_n$R;

M, R, Y and n have the same meanings as in the formula (VII), respectively;

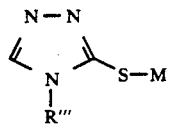

(VII-3)

wherein

R‴ represents —Y)$_n$R; and

M, R, Y and n have the same meanings as in the foregoing (VII), respectively;

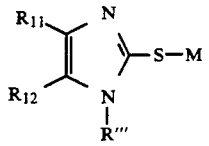

(VII-4)

wherein $R_{11}$ and $R_{12}$ each represent a hydrogen atom, a halogen atom, a substituted or unsubstituted amino group, a nitro group, or a substituted or unsubstituted alkyl, alkenyl, aralkyl or aryl group; and M and R‴ have the same meanings as those in the formula (VII-3), respectively.

18. The method of producing color images as in claim 3, wherein said compound represented by formula (VI) is a compound represented by the formulae (VI-a) or (VI-b);

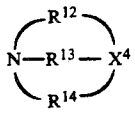

(VI-a)

wherein $X^4$ represents

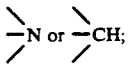

$R^{12}$ and $R^{13}$ are defined as $R^{10}$ and $R^{11}$ in the formula (VI); and $R^{14}$ represents the same group as $R^{10}$ and $R^{11}$, or —$CH^2CO$—;

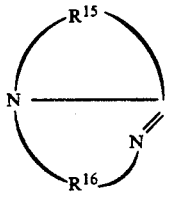

(VI-b)

wherein $R^{15}$ and $R^{16}$ have the same meaning as $R^{10}$ and $R^{11}$ in the formula (VI).

19. The method of producing color images as in claim 1, wherein the pH of the developer is from 10.20 to 10.5.

20. The method of producing color images as in claim 1, wherein the ratio of the area is from 10/90 to 90/10.

21. The method of producing color images as in claim 1, wherein the processing temperature of the color developer is from 36° to 50° C.

22. The method of producing color images as in claim 1, wherein the amount of benzyl alcohol in the color developer is from $1\times10^{-1}$ to $2\times10^{-1}$ mol/l.

23. The method of producing color images as in claim 1, wherein the color developer is substantially free from iodide ions.

24. The method of producing color images as in claim 1, wherein the silver halide in the direct positive silver halide color photographic material is silver bromochloride or silver bromide.

25. The method of producing color images as in claim 1, wherein the bromide ion concentration in the color developer is from $1.0\times10^{-2}$ to $2.0\times10^{-2}$ gram ion/l.

* * * * *